US007221895B2

(12) United States Patent
Omata et al.

(10) Patent No.: US 7,221,895 B2
(45) Date of Patent: May 22, 2007

(54) IMAGE FORMING APPARATUS AND BELT UNIT THEREFOR, AND IMAGE FORMING SYSTEM

(75) Inventors: Yasukuni Omata, Chigasaki (JP); Hideaki Mochimaru, Yokohama (JP)

(73) Assignee: Ricoh Company, Ltd, Tokyo (JP)

( * ) Notice: Subject to any disclaimer, the term of this patent is extended or adjusted under 35 U.S.C. 154(b) by 0 days.

(21) Appl. No.: 11/171,545

(22) Filed: Jul. 1, 2005

(65) Prior Publication Data

US 2005/0244190 A1 Nov. 3, 2005

Related U.S. Application Data

(63) Continuation of application No. 10/321,455, filed on Dec. 18, 2002, now Pat. No. 6,941,094.

(30) Foreign Application Priority Data

Dec. 18, 2001 (JP) ..... 2001-385316
Dec. 26, 2001 (JP) ..... 2001-395508
Nov. 7, 2002 (JP) ..... 2002-324421

(51) Int. Cl.
*G03G 15/01* (2006.01)

(52) U.S. Cl. ..... 399/302; 399/121; 399/124

(58) Field of Classification Search ..... 399/308, 399/302, 121, 124, 125; 347/116
See application file for complete search history.

(56) References Cited

U.S. PATENT DOCUMENTS 4,939,541 A 7/1990 Sugiura
5,089,858 A 2/1992 Ohno et al.
5,184,178 A 2/1993 Takayanagi et al.
5,208,612 A 5/1993 Obu et al.
5,758,204 A 5/1998 Haneda et al.
5,787,326 A 7/1998 Ogawa et al.
5,802,426 A * 9/1998 Miyazaki et al. ..... 399/121

(Continued)

FOREIGN PATENT DOCUMENTS

JP H03-167580 7/1991

(Continued)

*Primary Examiner*—Susan Lee
(74) *Attorney, Agent, or Firm*—Oblon, Spivak, McClelland, Maier & Neustadt, P.C.

(57) ABSTRACT

An image forming apparatus includes an optical unit emitting light in accordance with image information that is inclined in a prescribed direction. At least two image bearing members bearing a latent image formed by the light emitted from the optical unit are provided that have shafts arranged on a line inclining in the prescribed direction. At least two developing units are provided for developing the at least two latent images with toner. Shafts of the at least two developing means units are also arranged on a line inclining in the prescribed direction. An intermediate transfer belt is provided to receive and superimpose the toner images from the at least two image bearing members at a first transfer station. The intermediate transfer belt also inclines in the prescribed direction. A transfer unit is connected to a cover of a main body and transfers the superimposed toner images from the intermediate transfer belt to a recording medium at a second transfer station. This transfer unit is arranged in a vicinity of the lower end of the intermediate transfer belt with the transfer unit being separated from the intermediate transfer belt when the cover is opened.

11 Claims, 32 Drawing Sheets

U.S. PATENT DOCUMENTS

| | | | | |
|---|---|---|---|---|
| 5,839,032 | A | 11/1998 | Yasui et al. | |
| 6,157,799 | A | 12/2000 | Asakura et al. | |
| 6,259,880 | B1 * | 7/2001 | Jia et al. | 399/302 |
| 6,647,227 | B2 | 11/2003 | Yokoi et al. | |
| 6,697,586 | B2 | 2/2004 | Yamamoto et al. | |
| 6,697,590 | B2 * | 2/2004 | Inoue et al. | 399/124 |
| 6,714,755 | B2 * | 3/2004 | Abe | 399/302 |
| 2003/0118367 | A1 | 6/2003 | Omata et al. | |

FOREIGN PATENT DOCUMENTS

| | | | |
|---|---|---|---|
| JP | H09-311521 | | 12/1997 |
| JP | 11-095519 | | 4/1999 |
| JP | 11272036 | A | 10/1999 |
| JP | 2000-056521 | | 2/2000 |
| JP | 2000172132 | A | 6/2000 |
| JP | H2000-298386 | | 10/2000 |
| JP | H2001-002330 | | 1/2001 |
| JP | 2001-100488 | | 4/2001 |
| JP | 2001282075 | A * | 10/2001 |

* cited by examiner

IMAGE FORMING APPARATUS AND BELT UNIT THEREFOR, AND IMAGE FORMING SYSTEM

This application is a Continuation application of Ser. No. 10/321,455 filed on Dec. 18, 2002 now U.S. Pat. No. 6,941,094.

BACKGROUND OF THE INVENTION

1. Field of the Invention

The present invention relates to an image forming apparatus that forms a visible image on an image bearing member to obtain a recorded image, a belt unit used in the image forming apparatus, and an image forming system including the image forming apparatus.

2. Discussion of the Background

Image forming apparatuses in which a recorded image is obtained by forming a visible image on an image bearing member are known, e.g., an electrophotographic copying machine, a printer, a facsimile apparatus, and a multi-function apparatus having at least two functions of copying, printing and facsimile functions. Various types of image forming apparatuses having different functions are known. For example, some image forming apparatuses can form an image of relative large size, others can only form an image of relatively small size. Further, while some image forming apparatuses can form an image on each side of a recording medium, others form an image only on one side of a recording medium. Each user selects and obtains one of these image forming apparatuses having different functions based on its needs. However, it often happens that after obtaining an image forming apparatus having certain functions, the needs of the user change and it becomes necessary to obtain image forming apparatuses having different functions. In this case, the user is forced to bear a great financial burden.

An image forming apparatus is known to form a full color image on each side of a recording medium by first transferring visible images of different colors formed on a plurality of image bearing members onto an intermediary transfer member by superimposing one image of different color upon another, thereby forming a first full color image thereupon, transferring the first full color image onto an intermediary image bearing member, then transferring further visible images of different colors subsequently formed on the plurality of image bearing members onto an upper surface of a recording medium being conveyed between the plurality of image bearing members and the intermediary transfer member by superimposing one further image of different color upon another, thereby forming a second full color image on the upper surface of the recording medium, and further, transferring the first full color image on the intermediary image bearing member onto a lower surface of the recording medium.

In the above-described image forming apparatus, if an image to be formed is smaller in size than a surface size of the intermediary image bearing member, the image can be formed on each side of the recording medium. Accordingly, if the surface size of the intermediary image bearing member is set to such a size that corresponds to a recording medium of a maximum size that can be used in the image forming apparatus, a color image can be formed on each side of any recording medium used in the image forming apparatus. For example, when the maximum size of a recording medium that can be used in an image forming apparatus is A3, by setting the circumferential length of an intermediary image bearing member of the image forming apparatus to a size greater than the long side of a recording medium of A3 size and the width of the intermediary image bearing member to a size greater than the short side of the recording medium of A3 size, a color image can be formed on each side of any recording medium used in the image forming apparatus. However, providing such an image forming apparatus including an intermediary image bearing member having such a large surface size results in a higher cost apparatus relative to an image forming apparatus including an intermediary image bearing member having a smaller surface size.

Demands of users for an image forming apparatus vary, as described above. Thus, some users only use a recording medium of A4 size as a maximum. If this user can only obtain an expensive image forming apparatus including an intermediary image bearing member having a large surface size corresponding to a recording medium of, e.g., A3 size, the user is forced to bear an unnecessary cost burden in light of their needs. Further, when an intermediary image bearing member having a relatively long circumferential length is used, as compared to using an intermediary image bearing member of shorter circumferential length, the time required for forming an image is increased, resulting in decreased image forming efficiency.

Conversely, a user who has obtained an image forming apparatus including an intermediary image bearing member that is small in surface size because of an existing need to form an image on each side of only a small-sized recording medium has a problem if a need to form images on each side of a larger sized recording medium a rises. In this case, the user must obtain a second image forming apparatus that includes an intermediary image bearing member that is of a sufficiently large surface size to meet this new need, and thereby bear an excessive cost burden. The same kind of problem arises when the user who has obtained an image forming apparatus including an intermediary image bearing member having a large circumferential surface no longer needs to form an image on each side of a large-sized recording medium any more and desires to obtain an image forming apparatus including an image bearing member having a small circumferential surface.

Another image forming apparatus is known, in which at least one image bearing member is provided, visible images of different colors are formed on the image bearing member, and the visible images of different colors are transferred onto an intermediary transfer member by superimposing one image of different color upon another so that a full color image is formed on the intermediary transfer member. The full color image is then transferred onto a recording medium by a transfer device. The above-described image forming apparatus forms a color image on only one side of a recording medium. Still another image forming apparatus is known, in which a first image formed on an intermediary transfer member by superimposed visible images transferred from an image bearing member is transferred onto an intermediary image bearing member. The first image is then transferred onto a first side of a recording medium and at the same time a second image formed on the intermediary transfer member by subsequent superimposed visible images transferred from the image bearing member is transferred onto the second side of the recording medium. The image forming apparatus having this configuration forms a color image on each side of a recording medium in a relatively short time.

The former image forming apparatus forms a color image only on one side of a recording medium, whereas the latter image forming apparatus forms a color image on each side of a recording medium. Therefore, in terms of functions, the latter image forming apparatus is superior to the former image forming apparatus. However, the cost of making the latter image forming apparatus is higher than that of the former image forming apparatus, so that the price thereof is also higher than that of the former image forming apparatus.

Also, an image forming apparatus is known, in which visible images are formed on at least one image bearing member and the visible images are immediately transferred by a transfer device onto a recording medium, being superimposed one upon another, thereby forming a color image on the recording medium. Further, another image forming apparatus is known, in which visible images formed on an image bearing member are transferred onto an intermediary image bearing member, being superimposed one upon another, thereby forming a first image thereupon, the first image is then transferred onto one side of a recording medium, and visible images subsequently formed on the image bearing member are transferred onto the other side of the recording medium, being superimposed one upon another, thereby forming a second image on the other side of the recording medium. In this case also, the former image forming apparatus forms a color image only on one side of a recording medium, whereas the latter image forming apparatus forms a color image on each side of a recording medium. Therefore, in terms of functions, the latter image forming apparatus is superior to the former image forming apparatus. However, the cost of making the latter image forming apparatus is higher than that of the former image forming apparatus, so that the price thereof is higher than that of the former image forming apparatus.

As described above, demands of users for an image forming apparatus are diverse because while one user desires to obtain an image forming apparatus capable of forming an image on each side of a recording medium at a high speed even if the price is high, while another user prefers an inexpensive image forming apparatus even if an image cannot be formed on each side of a recording medium. The former user obtains an image forming apparatus capable of forming an image on each side of a recording medium, and the latter user obtains an image forming apparatus capable of forming an image only on one side of a recording medium. However, the latter user who has obtained an image forming apparatus capable of forming an image only on one side of a recording medium may be later required to obtain an image forming apparatus capable of forming an image on each side of a recording medium because of a change in needs. In this case, this user must purchase a second image forming apparatus that is capable of forming an image on each side of a recording medium, being forced to bear a great financial burden as to purchasing two different image forming apparatuses.

SUMMARY OF THE INVENTION

The present invention has been made in view of the above-discussed and other problems and addresses the above-discussed and other problems.

Preferred embodiments of the present invention provide an image forming apparatus forming an image one each side of a recording medium, that can meet different demands of a user at a relatively low cost, a belt unit for use in the image forming apparatus, and an image forming system using the image forming apparatus.

According to a preferred embodiment of the present invention, an image forming apparatus for forming an image on a recording medium includes a main body housing, a recording medium conveying path formed in the main body housing, and an installing part provided in the main body housing along a part of the recording medium conveying path and configured such that either of at least two devices having different functions that are performed when each is detachably and alternatively easily installed in the installing part of the main body housing. The image forming apparatus can further include a receiving and guiding mechanism provided to the main body housing and configured to receive and guide either of the at least two devices having different functions to be installed in and removed from the installing part of the main body housing.

According to another preferred embodiment of the present invention, an image forming apparatus includes at least one image bearing member on which a visible image is formed, an intermediary transfer member onto which visible images of different colors formed on the at least one image bearing member are transferred to be superimposed one upon another, thereby forming a first image thereupon, and an installing part provided in a main body housing of the apparatus and configured such that either of at least two intermediary image bearing members different in size can be easily installed and removed, wherein each of the intermediary image bearing members of different size is configured such that when installed in the installing part of the main body housing of the apparatus, will have the first image transferred thereupon. The image forming apparatus is configured such that when the either of at least two intermediary image bearing members different in size is installed in the installing part of the main body housing of the apparatus, the first image on the installed either of at least two intermediary image bearing members is transferred onto one side of a recording medium and a second image formed on the intermediary transfer member by another visible images subsequently transferred from the at least one image bearing member being superimposed one upon another is transferred onto the other side of the recording medium. The image forming apparatus can further include a receiving and guiding mechanism provided to the main body housing of the apparatus that is configured to receive and guide any of at least two intermediary image bearing members of different size being installed in or removed from the installing part of the main body housing of the apparatus.

According to still another preferred embodiment of the present invention, an image forming apparatus includes at least one image bearing member on which a visible image is formed, an intermediary transfer member onto which visible images of different colors formed on the at least one image bearing member are transferred to be superimposed one upon another, thereby forming a first image thereupon, and an installing part provided in a main body housing of the apparatus and configured such that either of a transfer device configured such that when installed in the installing part of the main body housing of the apparatus, the first image formed on the intermediary transfer member is transferred onto a recording medium, or an intermediary image bearing member configured such that when installed in the installing part of the main body housing of the apparatus, the first image formed on the intermediary transfer member is transferred thereupon, can be easily installed therein or removed therefrom in a detachable manner. The image forming apparatus is configured such that when the intermediary image bearing member is installed in the installing part of the main body housing of the apparatus, the first image transferred onto the intermediary image bearing member from the intermediary transfer member is transferred onto a first side of the recording medium and a second image formed on the intermediary transfer member by other visible images of different colors, subsequently transferred from the at least one image bearing member being superimposed one upon another, is transferred onto a second side of the recording medium. The image forming apparatus may further include a receiving and guiding mechanism provided to the main body housing of the apparatus that is configured to receive and to guide the either of a transfer device or an intermediary image bearing member being installed in and being removed from the installing part of the main body housing.

According to still another preferred embodiment of the present invention, an image forming apparatus includes at least one image bearing member on which a visible image is formed, and an installing part provided in a main body housing of the apparatus and configured such that either of a transfer device configured such that when installed in the installing part of the main body housing of the apparatus, the visible image formed on the at least one image bearing member is transferred onto a recording medium, or an intermediary image bearing member configured such that when installed in the installing part of the main body housing of the apparatus, visible images formed on the at least one image bearing member are transferred thereon to be superimposed one upon another, thereby forming a first image thereupon, can be easily installed therein or removed therefrom in a detachable manner. The image forming apparatus is configured such that when the intermediary image bearing member is installed in the installing part of the main body housing of the apparatus, the first image on the intermediary image bearing member is transferred onto a first side of the recording medium and a second image formed by another visible images subsequently formed on the at least one image bearing member is transferred onto a second side of the recording medium. The image forming apparatus may further include a receiving and guiding mechanism provided to the main body housing of the apparatus and configured to receive and to guide the either of a transfer device and an intermediary image bearing member to be installed in or removed from the installing part of the main body housing.

According to still another preferred embodiment of the present invention, a belt unit includes an intermediary image bearing member formed as an endless belt, and a plurality of supporting rollers supporting the intermediary image bearing member formed in an endless belt. The intermediary image bearing member formed as an endless belt and the plurality of supporting rollers supporting the intermediary image bearing member are integrated to form a belt unit, and the belt unit is configured to be installed in the installing part of the main body housing of any of the above-described image forming apparatuses.

According to still another preferred embodiment of the present invention, an image forming system includes any of the above-described image forming apparatuses and a host computer connected with the image forming apparatus.

BRIEF DESCRIPTION OF THE DRAWINGS

A more complete appreciation of the present invention and many of the attendant advantages thereof will be readily obtained as the same becomes better understood by reference to the following detailed description when considered in conjunction with accompanying drawings, wherein:

FIG. 31 is installed in and removed from the installing part of the main body housing.

DETAILED DESCRIPTION OF THE PREFERRED EMBODIMENTS

Figure 1:
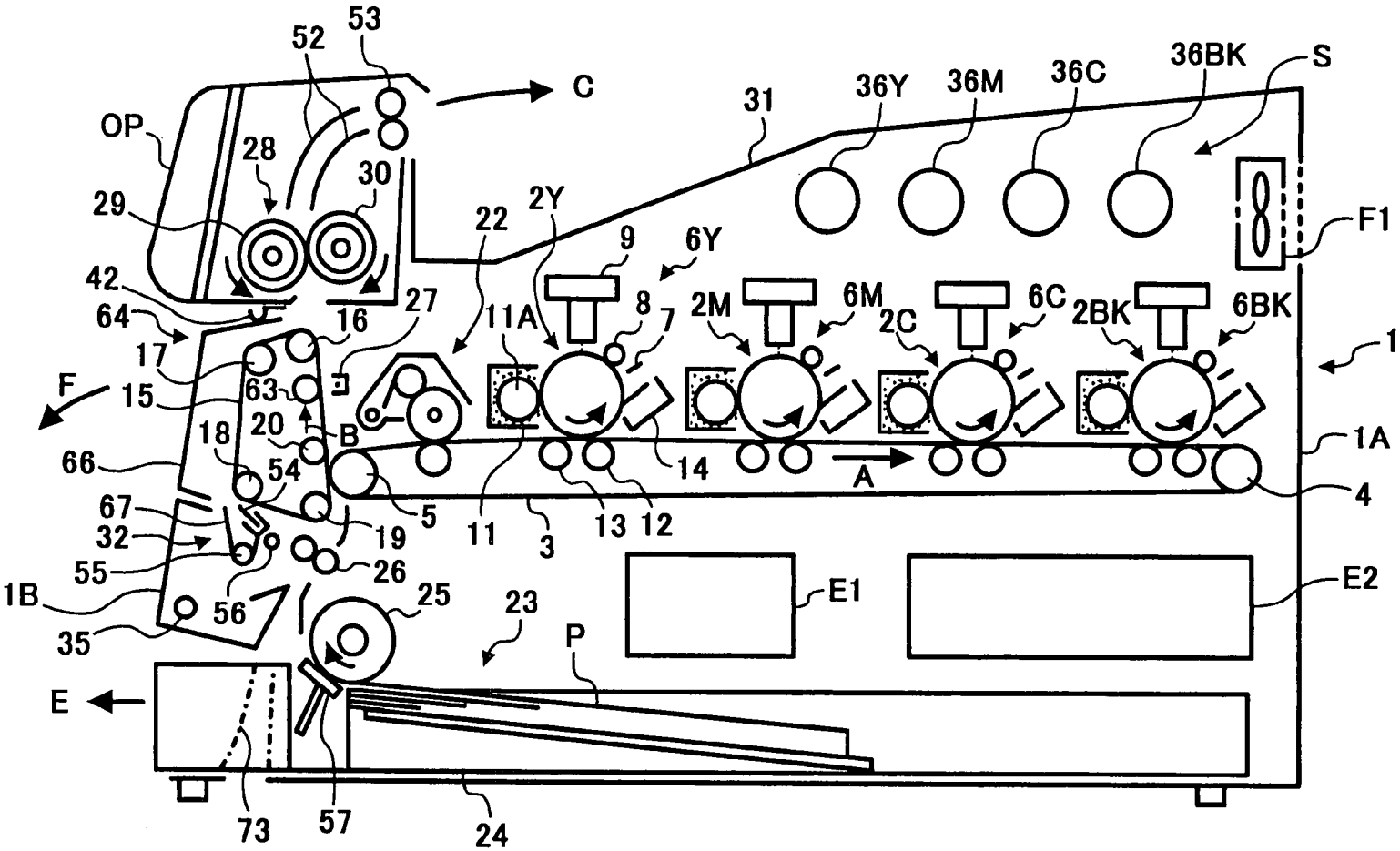
FIG. 1 is a vertical sectional view of an image forming apparatus configured to function as a printer according to an embodiment of the present invention.

Referring now to the drawings, wherein like reference numerals designate identical or corresponding parts throughout several views, preferred embodiments of the present invention are described.

FIG. 1 is a vertical sectional view of an image forming apparatus configured to function as a printer according to an embodiment of the present invention. The image forming apparatus includes a plurality of image bearing members arranged inside of a main body housing 1 of the image forming apparatus. In this example, four image bearing members are provided, a first image bearing member 2Y, a second image bearing member 2M, a third image bearing member 2C, and a fourth image bearing member 2BK. Visible toner images of different colors are formed on the image bearing members 2Y, 2M, 2C, and 2BK, respectively. Which color's toner image is to be formed on which image bearing member may be appropriately determined. In this example, yellow toner images, magenta toner images, cyan toner images, and black toner images are formed on the first through fourth image bearing members 2Y, 2M, 2C and 2BK, respectively.

A drum-like shaped photo conductor is used for each of the image bearing members 2Y, 2M, 2C and 2BK in this example. A photo conductor formed as an endless belt and spanned around a plurality of rollers to be rotated may be also used for each of the image bearing members 2Y, 2M, 2C and 2BK. A drum-like shaped image bearing member may be configured such that a layer of a photoconductive organic semiconductor is provided on a surface of a cylindrical base body of aluminum about 30 to 100 mm in diameter. It is needless to say that the drum-like shaped image bearing member may be configured otherwise.

Further, as described later, the image forming apparatus may be configured to include only one image bearing member. Thus, the present invention can be applied to any image forming apparatus having at least one image bearing member.

An intermediary transfer member 3 is arranged to oppose the first through fourth image bearing members 2Y, 2M, 2C and 2BK, and each of the image bearing members 2Y, 2M, 2C and 2BK contacts a surface of the intermediary transfer member 3. As the intermediary transfer member 3, a drum-like shaped member may be also used. However, in the example illustrated in FIG. 1, an endless belt spanned around supporting rollers 4 and 5 and configured to be driven to rotate in a direction of an arrow A is used for the intermediary transfer member 3. Visible toner images of respective colors formed on the image bearing members 2Y, 2M, 2C, and 2BK are transferred onto the intermediary transfer member 3 to be superimposed one upon another.

First through fourth image forming devices 6Y, 6M, 6C and 6BK are provided to the image bearing members 2Y, 2M, 2C, and 2BK to form visible images thereupon, respectively. Configurations and operations of the image forming devices 6Y, 6M, 6C and 6BK for forming visible images on the image bearing members 2y, 2M, 2C and 2BK are substantially the same except that colors of the visible images are different. Also, configurations and operations of transfer rollers 12 provided to the image bearing members 2Y, 2M, 2C, and 2BK for transferring the visible images onto the intermediary transfer member 3, respectively, are substantially the same. Therefore, description of the configurations and operations of the image forming devices 6Y, 6M, 6C and 6BK and the transfer rollers 12 will only be made with respect to an operation of forming a toner image on the first image bearing member 2Y and transferring the toner image onto the intermediary transfer member 3.

The image bearing member 2Y is rotated in a counter-clockwise direction in FIG. 1. At this time, a light from a discharging device 7 is irradiated on a surface of the image bearing member 2Y so that a surface potential of the image bearing member 2Y is initialized. The initialized surface of the image bearing member 2Y is uniformly charged to a predetermined polarity, in this example to a minus polarity, by a charging device 8. A light emitted by an exposure device 9 is irradiated on the charged surface of the image bearing member 2Y, so that an electrostatic latent image corresponding to writing information is formed on the image bearing member 2Y. In the example illustrated in FIG. 1, the exposure device 9 including an LED array and an imaging device is used. However, a laser writing device configured to emit a modulated laser light may be also used for the exposure device 9.

The electrostatic latent image formed on the image bearing member 2Y is developed to a visible yellow toner image when passing a developing device 11. The developing device 11 in this example includes a developing roller 11A bearing and conveying a dry-type developer, and the developing device 11 is configured to develop an electrostatic latent image on the image bearing member 2Y into a visible image with the dry-type developer born by the developing roller 11A. A developing device using a wet-type developer can also be used.

The transfer roller 12 as an example of a transfer device and a backing roller 13 are arranged inside of the intermediary transfer member 3 formed as an endless belt at positions where the transfer roller 12 and the backing roller 13 substantially oppose the image bearing member 2Y, sandwiching the intermediary transfer member 3 with the image bearing member 2Y and the transfer roller 12 and the backing roller 13. The transfer roller 12 and the backing roller 13 contact a backside of the intermediary transfer member 3, so that a suitable transfer nip is securely formed by the image bearing member 2Y and the intermediary transfer member 3. Another transfer device, such as a transfer brush, a transfer blade, or a corona discharger, may be also used for performing the function of the transfer roller 12. However, when the transfer roller 12 is used, transfer efficiency may be enhanced by pressing the intermediary transfer member 3 to the image bearing member 2Y with the transfer roller 12 when transferring a visible image on the image bearing member 2Y onto the intermediary transfer member 3.

A transfer voltage having a polarity opposite to the charging polarity of a visible toner image formed on the image bearing member 2Y is applied to the transfer roller 12. In this example, a transfer voltage of a plus polarity is applied. Thereby, a transfer electric field is formed between the image bearing member 2Y and the intermediary transfer member 3, so that a toner image formed on the image bearing member 2Y is electrostatically transferred onto the intermediary transfer member 3 rotated in synchronism with the image bearing member 2Y. Residual toner remaining on a surface of the image bearing member 2Y after transferring the toner image onto the intermediary transfer member 3 is removed by a cleaning member of a cleaning device 14, so that the surface of the image bearing member 2Y is cleaned.

As described above, visible images maybe repeatedly formed on the image bearing member 2Y by charging, exposing, developing and cleaning operations of the image forming device 6Y. It is needless to say that an appropriate image forming device other than the one described above and illustrated in FIG. 1 may be also used.

In substantially similar manners, visible magenta toner images, cyan toner images, and black toner images are formed respectively on the second through fourth image bearing members 2M, 2C and 2BK by the second through fourth image forming devices 6M, 6C and 6BK. The developing devices 6M, 6C and 6BK arranged to oppose the image bearing members 2M, 2C and 2BK form toner images of different colors on the image bearing members 2M, 2C and 2BK, respectively. The toner images of different colors formed on the image bearing members 2M, 2C and 2BK are electrostatically transferred by the transfer rollers 12, arranged to oppose the image bearing members 2M, 2C and 2BK sandwiching the intermediary transfer member 3 with the image bearing members 2M, 2C and 2BK and the transfer rollers 12, respectively, onto the intermediary transfer member 3 on which a yellow toner image has been previously transferred to be sequentially superimposed one upon another. Thus, an image formed by superimposed visible toner images of different colors is formed on the intermediary transfer member 3. The image is herein referred to as a first image.

A seamless heat-resisting belt having resistance enabling transferring of toner images from the image bearing members 2Y, 2M, 2C and 2BK and bearing of the toner images thereupon is used for the intermediary transfer member 3. For example, a belt configured such that a surface layer of a low surface energy is formed on a belt base of a resin film or rubber 50–500 μm in thickness may be used for the intermediary transfer member 3. The volume resistivity of the entire part of the belt may be set, for example, to $10^6$–$10^{12}$ Ω cm, and the surface resistivity thereof, for example, to $10^5$–$10^{12}$ Ω/□.

An intermediary image bearing member 15 onto which the first image formed on the intermediary transfer member 3 by transferred superimposed visible images is arranged at the left side of the intermediary transfer member 3 in FIG. 1. The intermediary image bearing member 15 may be formed in a drum-like shape and be configured to be driven to rotate. In this example, the intermediary image bearing member 15 is configured by an endless belt spanned around a plurality of supporting rollers 16, 17, 18 and 19 and rotated in a direction of an arrow B in synchronism with the intermediary transfer member 3.

A transfer roller 20 as an example of a transfer device is arranged inside of the intermediary image bearing member 15 near the supporting roller 19. In the example illustrated in FIG. 1, the transfer device for the intermediary image bearing member 15 is also constituted by a roller, i.e., the transfer roller 20 contacting a backside of the intermediary image bearing member 15, and the supporting roller 5 for the intermediary transfer member 3 is pressed to contact apart of the intermediary image bearing member 15 between the transfer roller 20 and the supporting roller 19. Thereby, the intermediary transfer member 3 and the intermediary image bearing member 15 contact each other, forming an appropriate nip between them. Other members such as a corona discharging device, a transfer brush, a transfer blade, etc., maybe also used for the transfer device.

A transfer voltage of a polarity opposite to the toner charging polarity of the first image on the intermediary transfer member 3 (in this example, a positive polarity) is applied to the transfer roller 20 provided inside of the intermediary image bearing member 15, so that a transfer electric field is formed between the intermediary transfer member 3 and the intermediary image bearing member 15.

Thereby, when the first image on the intermediary transfer member 3 reaches a transfer position between the intermediary transfer member 3 and the intermediary image bearing member 15, the first image is electrostatically transferred onto the intermediary image bearing member 15. Thus, the transfer roller 20 performs a function of transferring the first image, which has been formed on the intermediary transfer member 3 by visible images transferred from the plurality of image bearing members 2Y, 2M, 2C and 2BK to be superimposed one upon another, onto the intermediary image bearing member 15. Residual toner adhering to a surface of the intermediary transfer member 3 after transfer of the first image onto the intermediary image bearing member 15 is removed, together with paper dust, etc., by a cleaning device 22.

When a surface of the intermediary transfer member 3 moves to reach a predetermined position, in substantially the same manner as described above, subsequent visible toner images of yellow, magenta, cyan and black colors are sequentially started to be formed on the plurality of image bearing members 2Y, 2M, 2C and 2BK, and these visible images are electrostatically transferred onto the intermediary transfer member 3 in sequence so as to be superimposed one upon another. An image thus formed by visible images superimposed each other on the intermediary transfer member 3 is herein referred to as a second image.

A sheet feeding device 23 is provided at a lower part of the main body housing 1. The sheet feeding device 23 includes a sheet feeding cassette 24 stacking and accommodating therein a recording medium P, e.g., a transfer sheet, a resin sheet, etc., a feeding roller 25 to feed out the recording medium P from the sheet feeding cassette 24, and a separating pad 57 preventing double-feeding of the recording medium P. The feeding roller 25 rotates while contacting an upper surface of a top recording medium P in the sheet feeding cassette 24, thereby the top recording medium P being fed out to a registration roller pair 26.

The registration roller pair 26 feeds out the recording medium P upward at a timing that the second image on the intermediary transfer member 3 and the first image on the intermediary image bearing member 15 are transferred onto respective surfaces of the recording medium P to be aligned with each other. The recording medium P thus fed out by the registration roller pair 26 passes the nip part of the intermediary transfer member 3 and the intermediary image bearing member 15, being rotated in the arrow directions A and B respectively in synchronism with each other, to be conveyed upward, and while being conveyed, the first image on the intermediary image bearing member 15 is electrostatically transferred onto one side of the recording medium P and the second image on the intermediary transfer member 3 is electrostatically transferred onto the other side of the recording medium P. The timing of feeding out the recording medium P from the registration roller pair 26 may be controlled, for example, by reading a mark (not shown), which is provided on each of the intermediary transfer member 3 and the intermediary image bearing member 15 as a criterion for image formation, with a sensor (not shown).

The order of starting transfer of the first image and the second image onto respective sides of a recording medium P may be arbitrary, or transfer of the first image onto one side and the second image onto the other side of a recording medium P may be started at the same time. In this example, first, the second image on the intermediary transfer member 3 starts to be transferred onto the other side of the recording medium P, and then the first image on the intermediary image bearing member 15 starts to be transferred onto the one side of the recording medium P. That is, when the recording medium P passes between the intermediary transfer member 3 and the intermediary image bearing member 15, a transfer voltage of a polarity (in the example, a plus polarity) that is opposite to the toner charging polarity of the second image on the intermediary transfer member 3 is applied to the transfer roller 20, and thereby the second image on the intermediary transfer member 3 is electrostatically transferred onto the other side of the recording medium P. The recording medium P onto which the second image has been transferred is continuously conveyed upward while being in close contact with a surface of the intermediary transfer member 3. At this time, a transfer voltage of a polarity (in this example, a plus polarity) that is opposite to the toner charging polarity of the first image on the intermediary image bearing member 15 is applied to a corona discharging device 27 as an example of a transfer device arranged to be separated from a surface of the intermediary image bearing member 15. Thereby, a transfer electric field is formed between the intermediary image bearing member 15 and the recording medium P, and the first image on the intermediary image bearing member 15 is electrostatically transferred onto the other side of the recording medium P.

The corona discharging device 27 is a known discharging device having a corona wire to which a transfer voltage is applied. The corona discharging device 27 is arranged in a position separated from a surface of the intermediary image bearing member 15 not to contact a recording medium P being conveyed in close contact with the intermediary image bearing member 15. Accordingly, the second image on the other side of the recording medium P is never disturbed by the corona discharging device 27. Another transfer device other than the corona discharging device 27 may be used as long as it has substantially the same function as that of the corona discharging device 27. An opposing electrode 63 is arranged for the corona discharging device 27 sandwiching the intermediary image bearing member 15 with the corona discharging device 27 and the opposing electrode 63. The opposing electrode 27 is grounded. In this example, a roller that rotates while contacting an internal side of the intermediary image bearing member 15 is used for the opposing electrode 63, however, a plate may be used for the opposing electrode 63.

Separate transfer devices may be arranged for transferring the first image on the intermediary transfer member 3 onto the intermediary image bearing member 15 and for transferring the second image on the intermediary transfer member 3 onto the other side of the recording medium P, respectively. However, in this example, the transfer roller 20 performs both the transferring of the first image and the transferring of the second image so that the configuration of the image forming apparatus is simplified.

The recording medium P onto which the first image and the second image have been transferred is conveyed further upward after having been separated from the intermediary image bearing member 15, and passes between a pair of fixing rollers 29 and 30 of a fixing device 28, rotating in directions indicated by arrows, respectively. The fixing rollers 29 and 30 are heated by a heater (not shown). Heat and pressure are applied to both of the first image and the second image transferred onto the recording medium P, and thereby both images are fixed to the recording medium P at one time. The recording medium P passed the fixing device 28 is expelled, while being guided by a sheet expelling guide 52, onto a sheet expelling part 31 by a sheet expelling roller pair 53 as indicated by an arrow C.

A surface of the intermediary transfer member 3 after transfer of the second image onto the recording medium P is cleaned by the cleaning device 22. Similarly, residual toner adhering to a surface of the intermediary image bearing member 15 after transfer of the first image to the recording medium P is removed by a cleaning device 32, so that the surface of the intermediary image bearing member 15 is cleaned.

The cleaning device 32 includes a case 67 thereof, a cleaning blade 54 as an example of a cleaning member arranged inside of and supported by the case 67, and a toner conveying member 55. The entire part of the cleaning device 32 is supported by a rotating fulcrum 56 to rotate around the fulcrum 56, so that the cleaning blade 54 contacts and separates from a surface of the intermediary image bearing member 15. The cleaning blade 54 of the cleaning device 32 separates from a surface of the intermediary image bearing member 15 when the first image born on the intermediary image bearing member 15 passes the cleaning blade 54 and contacts a surface of the intermediary image bearing member 15 when removing residual toner adhering to the surface of the intermediary image bearing member 15.

Residual toner adhering to a surface of the intermediary image bearing member 15 is scraped to be removed when the cleaning blade 54 contacts a surface of the intermediary image bearing member 15, and the toner removed from the intermediary image bearing member 15 is collected into a residual toner collecting device (not shown) by the toner conveying member 55. The supporting roller 18 supporting the intermediary image bearing member 15 is arranged to oppose the cleaning blade 54 sandwiching the intermediary image bearing member 15 with the supporting roller 18 and the cleaning blade 54. When the cleaning blade 54 is pressed to contact a surface of the intermediary image bearing member 15, the cleaning blade 54 is pressed to the supporting roller 18 via the intermediary image bearing member 15. Thus, the supporting roller 18 functions as a backing member for the cleaning blade 54.

Figure 2:
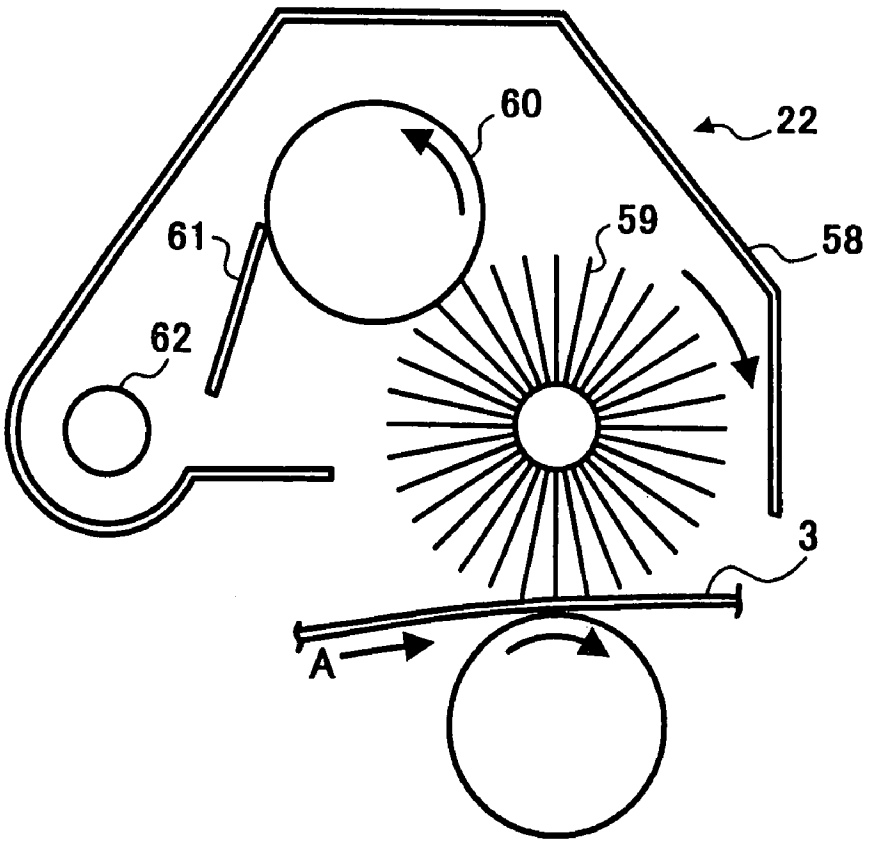
FIG. 2 is an enlarged diagram of a cleaning device for an intermediary transfer member of the image forming apparatus.

An appropriate device can also be used for the cleaning device 22 for the intermediary transfer member 3. The cleaning device 22 illustrated in FIG. 1 includes, as illustrated in an enlarged diagram of FIG. 2, a case 58, a brush roller 59 as an example of a cleaning member rotatably supported by the case 58, and a bias roller 60 also rotatably supported by the case 58 and contacting the brush roller 59. The brush roller 59 is rotated in the direction indicated by an arrow while contacting the intermediary transfer member 3, and the bias roller 60 is also driven to rotate in the direction indicated by an arrow. A voltage having a polarity opposite to the charging polarity of residual toner on the intermediary transfer member 3 is applied to the bias roller 60. Thereby, the residual toner on the intermediary transfer member 3, while being scraped off the intermediary transfer member 3, electrostatically moves to the brush roller 59, and then the toner electrostatically moves to the bias roller 60. Further, the toner on the bias roller 60 is scraped off the bias roller 60 by a blade 61 pressed to a surface of the bias roller 60 to be conveyed by a toner conveying member 62 to a toner collecting part not shown. The brush roller 59 always contacts a surface of the intermediary transfer member 3.

An endless belt having resistance enabling transfer of a toner image from the intermediary transfer member 3 and transfer of the toner image from the intermediary transfer member 3 to a recording medium P is used for the intermediary image bearing member 15. For example, a belt having a releasing-type coating layer of a low surface energy including fluorine resin (e.g., PFA), etc., formed on a belt base of polyimide or polyamide-imide about 50–500 μm in thickness can be used for the intermediary image bearing member 15. The volume resistivity of the entire intermediary image bearing member 15 can be preferably set to $10^6$–$10^{12}$ Ω·cm, and the surface resistivity thereof can be preferably set to $10^5$–$10^{12}$ Ω/□. By configuring the intermediary image bearing member 15 to include such a releasing-type coating layer on its surface, the transferring property of the intermediary image bearing member 15 in transferring the first image on the intermediary image bearing member 15 onto a recording medium P and the cleaning property of the surface of the intermediary image bearing member 15 after transfer of the first image can be enhanced. Further, by setting the surface resistivity of the intermediary image bearing member 15 to $10^5$–$10^{12}$ Ω/□, the first image can be securely born on a surface of the intermediary image bearing member 15.

Figure 3:
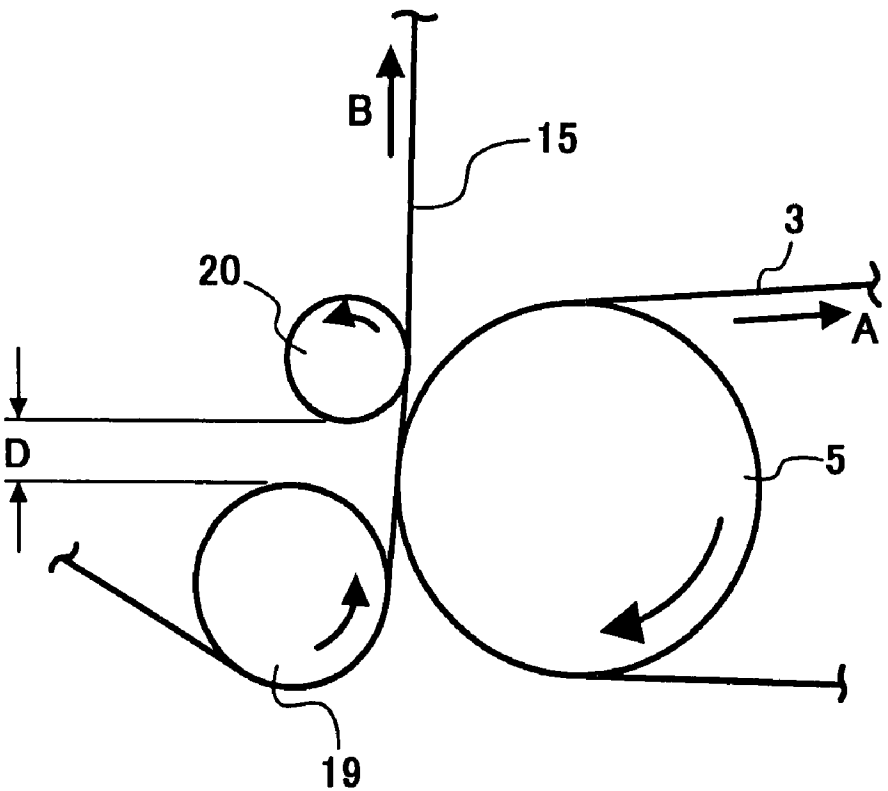
FIG. 3 is an enlarged diagram of neighborhood of a contacting part of the intermediary transfer member and an intermediary image bearing member of the image forming apparatus.

FIG. 3 is an enlarged diagram of neighborhood of a contacting part of the intermediary transfer member 3 and the intermediary image bearing member 15. Because a transfer voltage must be applied to the transfer roller 20, a metal roller is used for the transfer roller 20, the diameter of which is about 10 mm. The supporting roller 19 of the intermediary image bearing member 15 is also a metal roller, and is grounded to prevent frictional charging between the intermediary image bearing member 15 and a recording medium P so that transfer of an image can be satisfactorily performed. The diameter of the supporting roller 19 is about 16 mm. Further, for preventing electric current from leaking to the supporting roller 19, the distance D between the supporting roller 19 and the transfer roller 20 should be preferably equal to or greater than 5 mm. In the example illustrated in FIG. 3, the distance D is set to about 8 mm.

The intermediary image bearing member 15 may be configured to be supported by the supporting roller 16 to swing around the supporting roller 16, so that the intermediary image bearing member 15 can contact and separate from the intermediary transfer member 3. Thereby, when transferring the first image on the intermediary transfer member 3 onto the intermediary image bearing member 15 and when transferring the second image on the intermediary transfer member 15 onto a recording medium P, the intermediary transfer member 3 and the intermediary image bearing member 15 are brought into contact directly or via the recording medium P, and the intermediary transfer member 3 and the intermediary image bearing member 15 are separated from each other at other times.

In order to obtain both of the first image transferred onto one side of a recording medium P and the second image transferred onto the other side of the recording medium P in a correct direction (not upside down), when forming toner images for the first image on the image bearing members 2Y, 2M, 2C and 2BK, respective latent images must be formed upside down on the image bearing members 2Y, 2M, 2C and 2BK, and when forming toner images for the second image on the image bearing members 2Y, 2M, 2C and 2BK, respective latent images must be formed in a correct direction (not upside down) on the image bearing members 2Y, 2M, 2C and 2BK. Switching of exposure for enabling the above-described formation of latent images is controlled by a writing controller (not shown).

Further, when the sheet expelling part 31 is arranged as illustrated in FIG. 1, a recording medium P is stacked on the sheet expelling part 31 with the other side of the recording medium P on to which the second image has been directly transferred from the intermediary transfer member 3 faced down. Therefore, in order to put the page of the recording medium P fed onto the sheet expelling part 31 in order, toner images must be formed on the image bearing members 2Y, 2M, 2C and 2BK such that the first image is on the second page and the second image is on the first page. That is, the order of forming the first and second images is controlled such that the first image is on an even page and the second image on an odd page, and at the same time the sheet conveying path for conveying a recording medium P is configured such that the recording medium P is fed onto the sheet expelling part 31 with the second image face down. With the above-described configuration, even when a large number of sheets of the recording medium P are fed onto the sheet expelling part 31 consecutively, the pages thereof can be put in order using a known technology of storing image data in a memory.

Each of the image bearing members 2Y, 2M, 2C and 2BK, and the charging device 8, the developing device 11, and the cleaning device 14 arranged around each of the image bearing members 2Y, 2M, 2C and 2BK may be integrated to be configured as a process cartridge, so that the process cartridge can be replaced with a new one when the life of the process cartridge ends.

Toner containers 36Y, 36M, 36C and 36BK containing yellow toner, magenta toner, cyan toner, and black toner, respectively, are provided in a toner container accommodating space S above the intermediary transfer member 3 and below the sheet expelling part 31. Toner contained in each of the toner containers 36Y, 36M, 36C and 36BK is replenished to a corresponding developing device 11 by a powder pump (not shown).

A power source unit E1 and a control unit E2 are also provided inside of the main body housing 1. Further, a fan F1 is provided to discharge air to prevent the temperature inside of the main body housing 1 from being excessively raised.

An operation panel OP is provided to the main body housing 1. The operation panel OP is provided with display lamps for displaying conditions and states of the image forming apparatus and other devices connected with the image forming apparatus, and key buttons used for inputting various instructions.

It is possible to form a color image only on one side of a recording medium P with the image forming apparatus of FIG. 1. In this case, toner images of different colors formed on the plurality of image bearing members 2Y, 2M, 2C and 2BK are transferred onto the intermediary transfer member 3 to be superimposed one upon another, so that a superimposed visible image is formed on the intermediary transfer member 3. The superimposed visible image is then transferred onto one side of a recording medium P conveyed from the sheet feeding device 23 by a function of the transfer roller 20. The recording medium P is conveyed upward by being in close contact with a surface of the intermediary image bearing member 15 which is moving. At this time, the corona discharging device 27 acting as a transfer device is not operated. When the recording medium P passes the fixing device 28, the transferred image is fixed to the recording medium P, and subsequently the recording medium P is fed onto the sheet expelling part 31. At this time, the recording medium P is fed onto the sheet expelling part 31 with the side thereof on which the image is fixed face down. Therefore, when the above-described image forming operations are repeated, the pages of a plurality of recording medium P fed onto the sheet expelling part 31 are in order. Thus, a mode for obtaining a recorded image on one side of a recording medium, in which a visible image transferred from an image bearing member onto an intermediary transfer member is transferred, without being transferred onto an intermediary image bearing member, onto the one side of the recording medium, can be realized.

Further, a color image may be formed only on one side of a recording medium P by transferring a visible image formed on the intermediary transfer member 3 by toner images transferred onto the intermediary transfer member 3 from the plurality of image bearing members 2Y, 2M, 2C and 2BK, onto the intermediary image bearing member 15. The visible image on the intermediary image bearing member 15 is transferred onto the recording medium P, and after the visible image on the recording medium P is fixed by the fixing device 28, the recording medium P is fed onto the sheet expelling part 31. A fixing temperature of the fixing device 28 when forming an image on only one side of a recording medium P can be set lower than when forming an image on each side of the recording medium P.

Furthermore, the image forming apparatus of FIG. 1 can form an image of a single color or an image of a plurality of colors by forming visible images only on some of the plurality of image bearing members 2Y, 2M, 2C and 2BK and transferring the visible images onto one side or both sides of a recording medium P in substantially the same manner as described above.

In the image forming apparatus of FIG. 1, the sheet feeding cassette 24 accommodating the recording medium P as described above is installed in the main body housing 1, together with the separating pad 57, such that the sheet feeding cassette 24 can be drawn in the direction of an arrow E relative to the main body housing 1. In the example illustrated in FIG. 1, when the sheet feeding cassette 24 is drawn out, the sheet feeding roller 25 remains inside of the main body housing 1. By thus drawing out the sheet feeding cassette 24 from the main body housing 1, a recording medium P can be replenished to the sheet feeding cassette 24. After replenishing of a recording medium P, by pushing the sheet feeding cassette 24 in the reverse direction relative to the direction of the arrow E, the sheet feeding cassette 24 can be installed in the main body housing 1.

Further, as illustrated in FIG. 1 by dashed lines, a conveying path 73 for a recording medium P may be formed to pass the sheet feeding cassette 24 in an up-and-down direction. Thereby, when another sheet feeding cassette is provided below the sheet feeding cassette 24, a recording medium fed from the another sheet feeding cassette can be fed to the registration roller pair 26 by causing the recording medium to pass the conveying path 73.

In the present invention, at least the intermediary image bearing member 15 and the plurality of supporting rollers 16, 17, 18 and 19 around which the intermediary image bearing member 15 is spanned are integrated to be configured as a belt unit 64. More specifically, as illustrated in FIG. 4, end parts of the supporting rollers 16, 17, 18 and 19 are rotatably supported by both side plates 65, and a screw 68 is fixed to one end of an axis of the supporting roller 16.

Figure 4:
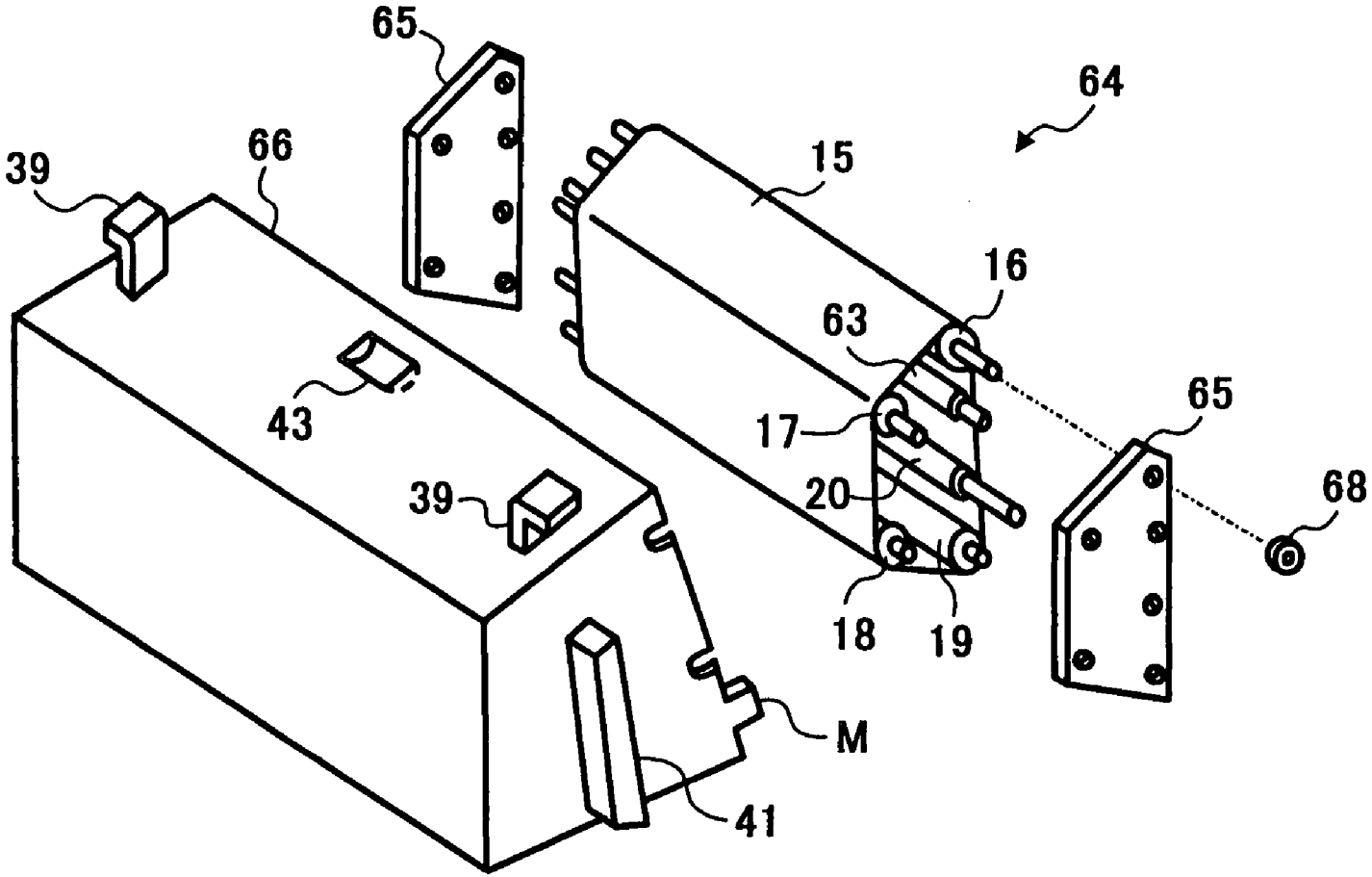
FIG. 4 is an exploded perspective view of a belt unit including the intermediary image bearing member of the image forming apparatus.

In the example illustrated in FIG. 4, both longitudinal ends of axes of the transfer roller 20 as an example of a transfer device and the opposing electrode 63 constituted by a roller contacting an internal side of the intermediary image bearing member 15 are also rotatably supported by the both side plates 65, so that the transfer roller 20 and the opposing electrode 63 are also parts of the belt unit 64.

Figure 5A:
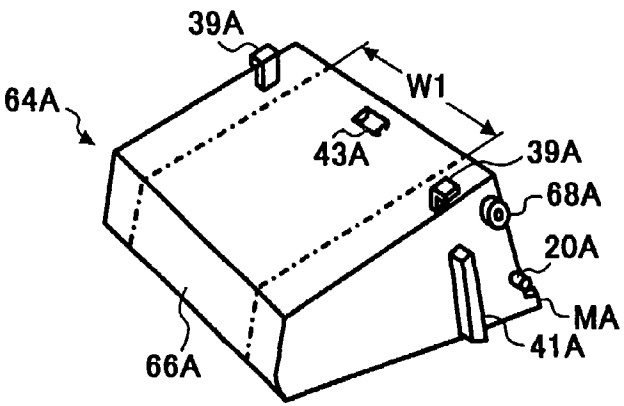
FIG. 5A is a perspective view illustrating an outer appearance of another belt unit including another intermediary image bearing member that is longer in circumferential length.
Figure 5B:
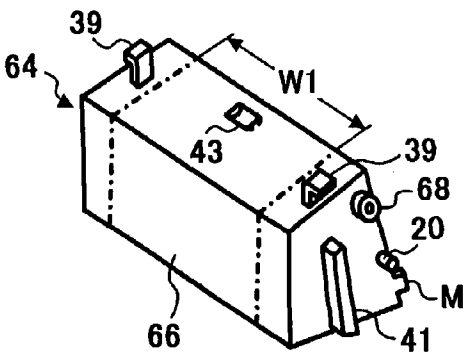
FIG. 5B is a perspective view illustrating an outer appearance of the belt unit installed in the image forming apparatus of FIG. 1.

Furthermore, the belt unit 64 includes a cover 66 covering components of the belt unit 64, such as the intermediary image bearing member 15, the supporting rollers 16, 17, 18 and 19, etc. An exemplary outer appearance of the belt unit 64 is illustrated in FIG. 5B. The screw 68 and one end of the axis of the transfer roller 20 protrude outside of the cover 66, and in a state that the belt unit 64 is installed in an installing part (described later) of the main body housing 1, the screw 68 engages with a driving gear 69 (FIG. 5D) provided to the main body housing 1, so that the supporting roller 16 is driven to rotate via the screw 69 and the screw 68. Thereby, the intermediary image bearing member 15 is rotated in the direction of the arrow B in FIG. 1. Further, in the state that the belt unit 64 is installed in the installing part of the main body housing 1, the axis of the transfer roller 20 contacts an outputting terminal of a power source (not shown), and a predetermined transfer voltage is applied to the axis of the transfer roller 20.

In the image forming apparatus illustrated in FIG. 1, the cleaning device 32 for cleaning a surface of the intermediary image bearing member 15 is provided as a component separate from the belt unit 64. However, the cleaning device 32 may be configured to be a part of the belt unit 64. In FIG. 5B (and FIGS. 5A and 5C also), the cleaning device 32 is omitted.

As described above, the image forming apparatus of the present invention includes at least one image bearing member on which a visible image is formed, an image forming device configured to form the visible image on the at least one image bearing member, an intermediary transfer member onto which visible images of different colors formed on the at least image bearing member are transferred being superimposed one upon another to be formed as a first image, and an intermediary image bearing member onto which the first image on the intermediary transfer member is transferred. The first image transferred onto the intermediary image bearing member is transferred onto one side of a recording medium, and a second image formed on the intermediary transfer member by visible images transferred from the at least one image bearing member being superimposed one upon another is transferred onto the other side of the recording medium.

According to the above-described image forming apparatus, a color image can be formed on each side of a recording medium. Further, a color image can be formed on each side of a recording medium by feeding the recording medium only once between the intermediary transfer member and the intermediary image bearing member. Therefore, the time for forming a color image on each side of a recording medium is relatively short, so that productivity of the image forming apparatus is enhanced. Furthermore, instead of causing a recording medium to be born by an intermediary transfer member to pass a plurality of image bearing members so that visible image are transferred onto the recording medium in succession like a background image forming apparatus, a first image formed on the intermediary transfer member by transferring a plurality of visible images formed on the plurality of image bearing members superimposing one upon another is transferred onto the intermediary image bearing member, a second image is formed on the intermediary transfer member by another plurality of visible images, and the first image and the second image are collectively transferred onto one side and the other side of a recording medium, so that misalignment of colors in each image formed on the recording medium can be prevented from occurring or effectively suppressed.

In the image forming apparatus configured as illustrated in FIG. 1, the intermediary image bearing member 15 must have a surface size suitable to hold at least one page of the first image. If a first image having a size larger than the circumferential length of the intermediary image bearing member 15 is transferred from the intermediary transfer member 3 onto the intermediary image bearing member 15, when a tip end of the first image transferred onto the intermediary image bearing member 15 reaches a transfer position where the first image is started to be transferred from the intermediary transfer member 3 onto the intermediary image bearing member 15, transfer of the entire part of the first image from the intermediary transfer member 3 onto the intermediary image bearing member 15 has not been completed yet, so that the first image is transferred onto the intermediary image bearing member 15 in an overlapped state. Conversely, if the circumferential length of the intermediary image bearing member 15 is excessively larger than a size of a recording medium, transfer of the first image from the intermediary transfer member 3 onto the intermediary image bearing member 15 has been completed long before the tip end of the first image transferred on the intermediary image bearing member 15 reaches the above-described transfer position, so that useless time in which a transfer operation is not performed occurs, decreasing image forming efficiency of the image forming apparatus.

As described earlier, demands of users are diverse. Some users form an image on each side of a large recording medium, and it is sufficient for other users to form an image on each side of a small recording medium. Accordingly, it is necessary that the surface size of the intermediary image bearing member 15 is set to a size meeting diverse demands of users.

Accordingly, the image forming apparatus of the present invention is configured such that either of at least two intermediary image bearing members different from each other in size can be installed in the main body housing 1 in a detachable manner, so that the intermediary image bearing members different in size can be freely exchanged with each other in the image forming apparatus. Here, intermediary image bearing members being different in size includes three cases, one case in which widths of the intermediary image bearing members in a direction perpendicular to surface moving directions of the intermediary image bearing members are different from each other, another case in which circumferential lengths of the intermediary image bearing members are different from each other, and still another case in which both of widths of the intermediary image bearing members in a direction perpendicular to surface moving directions of the intermediary image bearing members and circumferential lengths of the intermediary image bearing members are different from each other.

Figure 6:
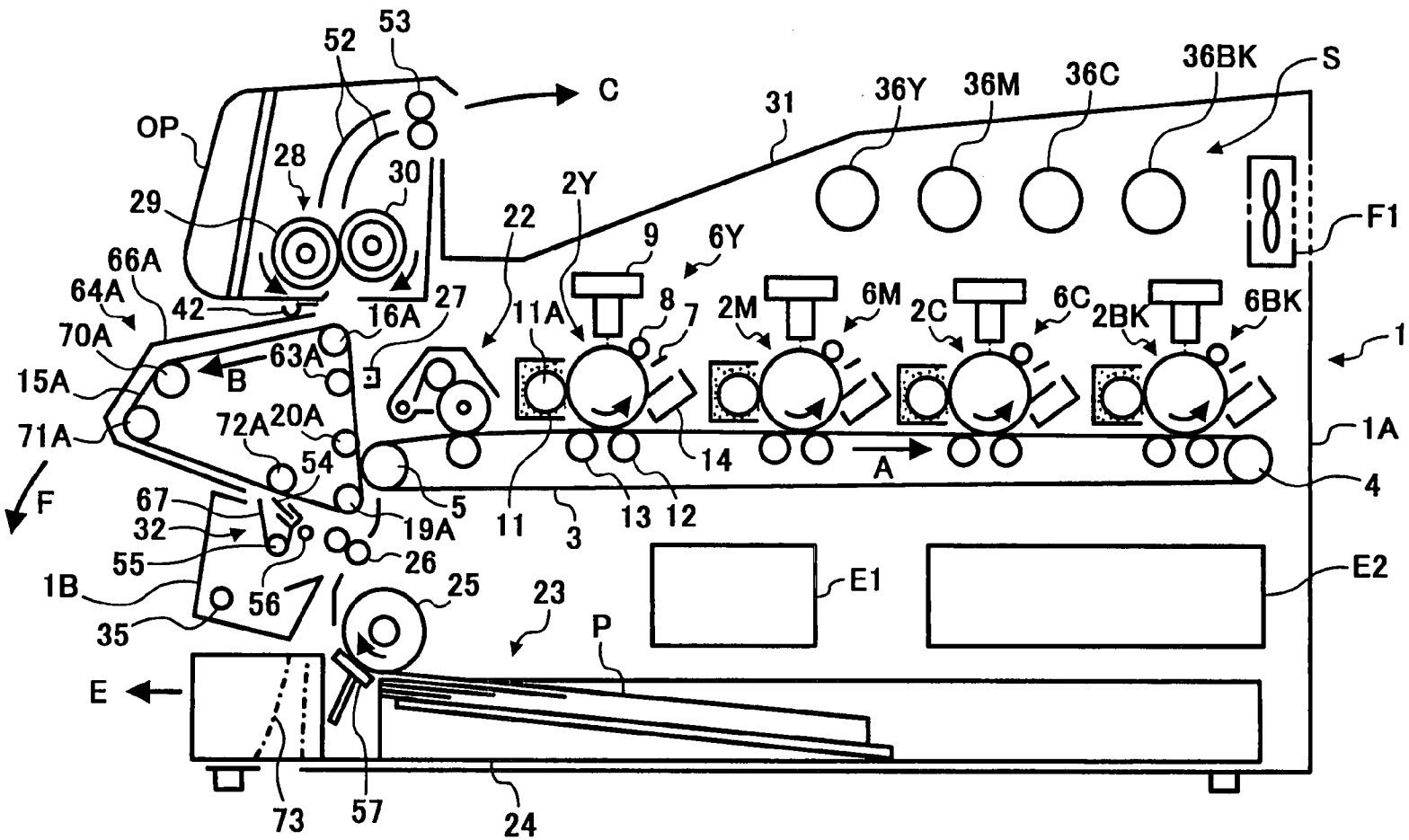
FIG. 6 is a vertical cross section of the image forming apparatus in which the another belt unit including another intermediary image bearing member that is longer in circumferential length is installed.

FIG. 6 illustrates an image forming apparatus in which a belt unit 64A having an intermediary image bearing member 15A, which is longer in circumferential length than and the same in width as the intermediary image bearing member 15 of FIG. 1 is used. In the belt unit 64A illustrated in FIG. 6, two supporting rollers 70A and 71A are arranged, instead of the supporting rollers 17 and 18 of the belt unit 64 illustrated in FIG. 1, to support the intermediary image bearing member 15A, and a backing member 72A is added exclusively for the cleaning blade 54 of the cleaning device 32. Further, a cover 66A covering components of the belt unit 64A is formed large enough to accommodate the intermediary image bearing member 15A that is longer in circumferential length than the intermediary bearing member 15 of FIG. 1, so that the cover 66A is larger than the cover 66 of the belt unit 64 illustrated in FIG. 1. That is, the supporting rollers 70A and 71A are provided to support the intermediary image bearing member 15A which is longer than the intermediary image bearing member 15 of FIG. 1. The backing member 72A illustrated in FIG. 6 is constituted by a roller, and respective axes of the backing member 72A and the supporting rollers 70A and 71A are supported by both side plates of the belt unit 64A (corresponding to the side plates 65 illustrated in FIG. 4) at end parts thereof so as to be freely rotatable. The side plates of the belt unit 64A are also formed larger than the side plates 65 illustrated in FIG. 4 to be able to accommodate the intermediary image bearing member 15A that is longer in circumferential length than the intermediary image bearing member 15. Configuration of the other parts of the belt unit 64A is substantially the same as that of the belt unit 64 illustrated in FIG. 1, and respective components in FIG. 6 corresponding to those of FIG. 1 are denoted by the same references as those used in FIG. 1, respectively appended by A. An exemplary outer appearance of the belt unit 64A is illustrated in FIG. 5A.

The image forming apparatus of FIG. 6 can form an image on one side or each side of a recording medium as in the image forming apparatus of FIG. 1. However, because the intermediary image bearing member 15A that is longer in circumferential length than the intermediary image bearing member 15 of the image forming apparatus of FIG. 1 is used in the image forming apparatus of FIG. 6, a user can form a color image on each side of a larger recording medium with the image forming apparatus of FIG. 6 than with the image forming apparatus of FIG. 1. Conversely, a user who forms an image mostly on a recording medium that is smaller in size can form a color images on each side of the recording medium in an efficient manner with the image forming apparatus of FIG. 1.

Figure 5C:
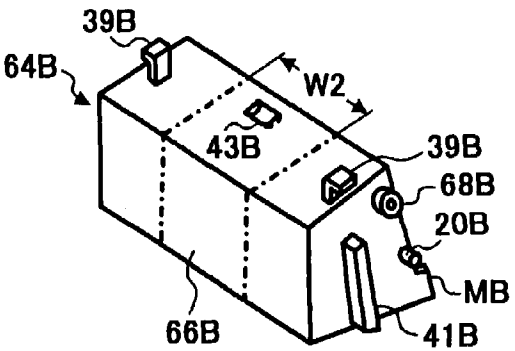
FIG. 5C is a perspective view illustrating an outer appearance of still another belt unit including another intermediary image bearing member that is smaller in width.

A belt unit 64B illustrated in FIG. 5C includes an intermediary image bearing member smaller in width than the intermediary image bearing members 15 and 15A used in the belt units 64 and 64A. Configuration of the other parts of the belt unit 64B is substantially the same as that of the belt unit 64 illustrated in FIG. 5B, and respective components of the belt unit 64B in FIG. 5C corresponding to those of the belt unit 64 in FIG. 5B are denoted by the same references as those used in FIG. 5B, respectively appended by B. In FIGS. 5A, 5B and SC, W1 and W2 indicate widths of respective image bearing members, and the width W2 is smaller than the width W1. Those users who mostly form an image on one or each side of a recording medium small in width, such as a post card, may install the belt unit 64B including the intermediary image bearing member that is smaller in width in the image forming apparatus. The belt unit 64B is less expensive than the belt units 64 and 64A because of the intermediary image bearing member being smaller in width, and thereby the financial burden on the user can be decreased.

Now, a concrete example of an installing mechanism for installing any of a plurality of intermediary image bearing members that are different in size in the main body housing 1 in a detachable manner, so that an installed intermediary image bearing member can be exchanged with another one, is described.

The main body housing 1 of the image forming apparatus illustrated in FIG. 1 and FIG. 6 includes a fixed housing 1A, and a movable housing 1B supported by the fixed housing 1A to open and close relative to the fixed housing 1A. The movable housing 13 is configured to receive and guide either of the intermediary image bearing members 15 or 15A to be installed in the installing part of the main body housing 1. By putting the movable housing 1B in an opened position, either the intermediary image bearing members 15 or 15A can be received by and taken out from the movable housing 1B, respectively. More specifically, the movable housing 1B is supported by the fixed housing 1A via a supporting axis 35 so as to rotate to open and close, and putting the movable housing 1B in the opened position, either of the belt units 64 or 64A, including the respective intermediary image bearing members 15 or 15A, can be received by and taken out from the movable housing 1B.

Figure 7:
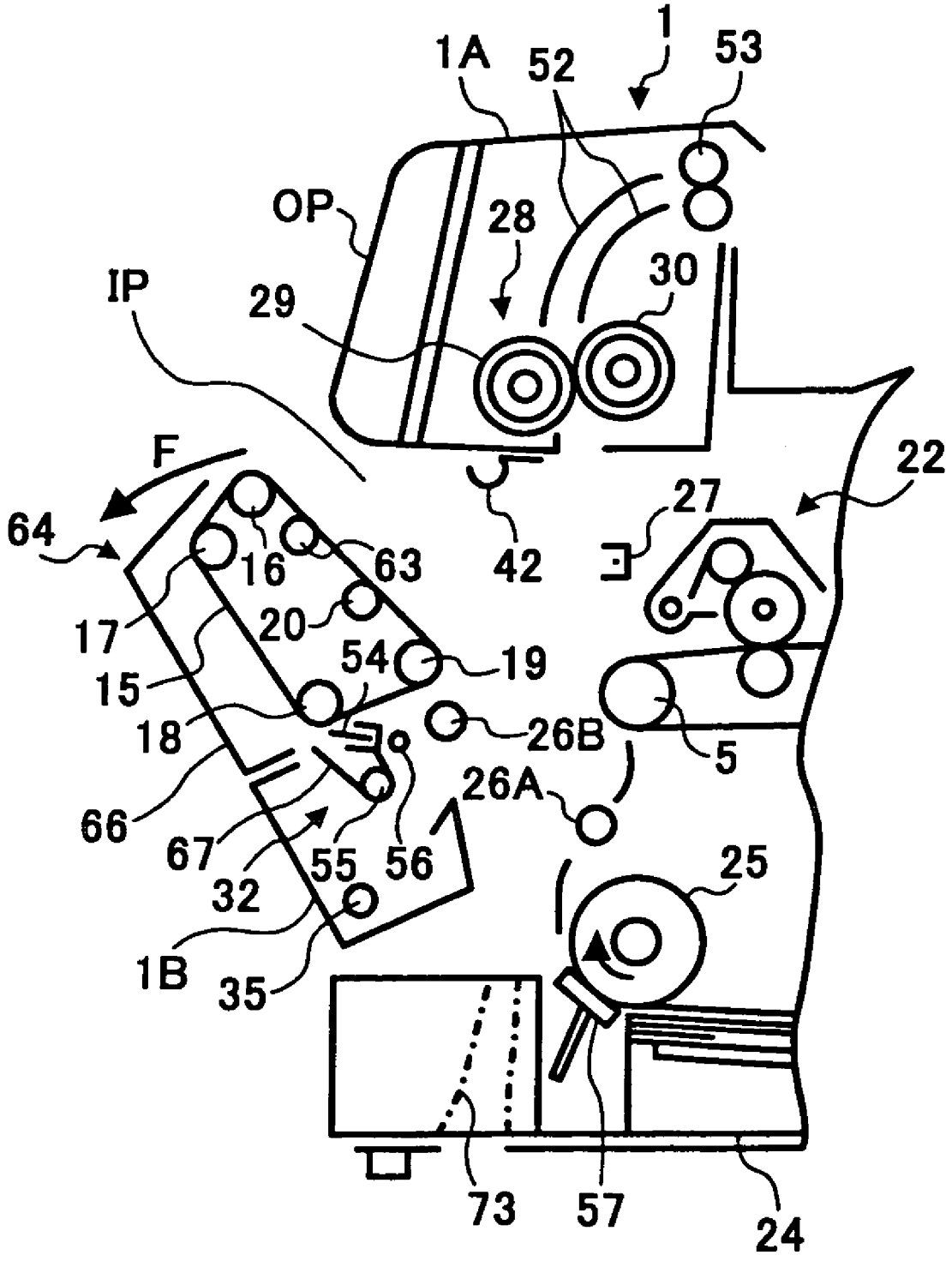
FIG. 7 is a vertical cross section of a part of the image forming apparatus, illustrating a state that the movable housing including the intermediary image bearing member is rotated to a first opened position.
Figure 8:
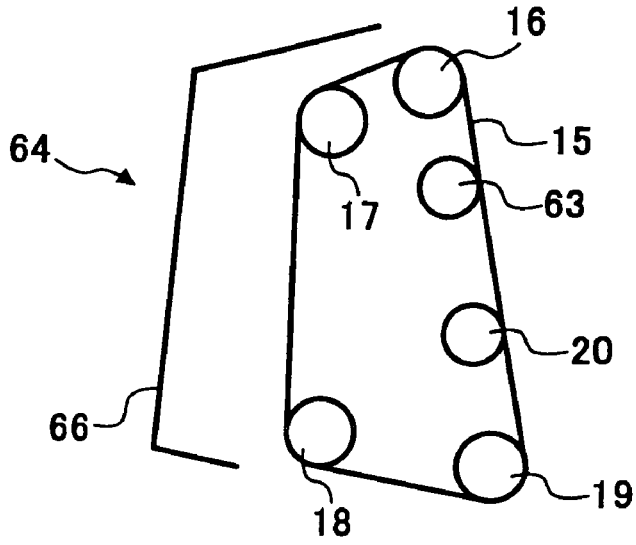
FIG. 8 is a cross section illustrating the belt unit removed from the main body housing of the image forming apparatus.
Figure 9:
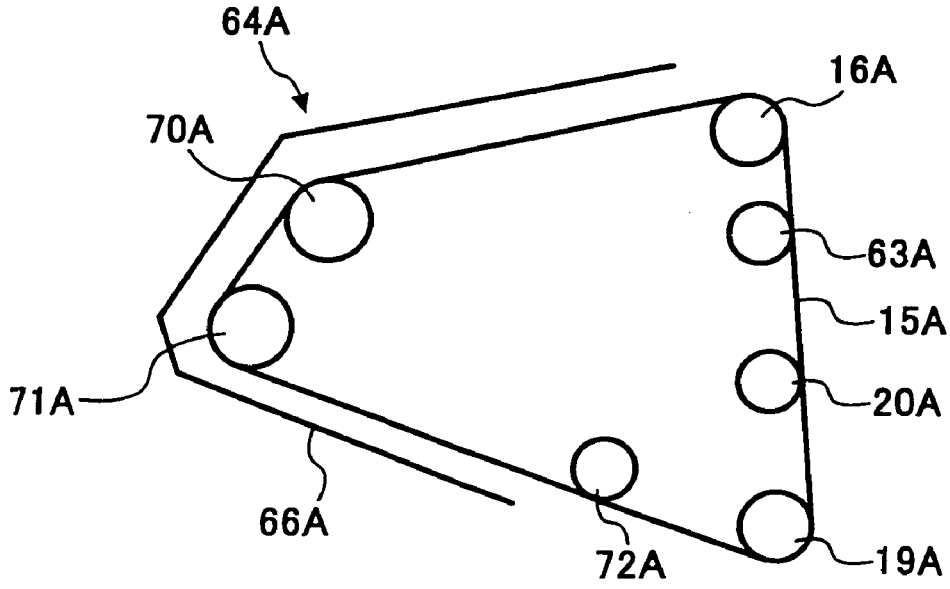
FIG. 9 is a cross section illustrating the another belt unit including another intermediary image bearing member that is longer in circumferential length, removed from the main body housing of the image forming apparatus.

FIG. 7 illustrates a state in which the movable housing 1B illustrated in FIG. 1 has been rotated in the direction of an arrow F around the supporting axis 3 so that the movable housing 1B has been brought into the opened position and thereby the belt unit 64 has been removed from the installing part of the main body housing 1. The installing part of the main body housing 1 is denoted by a reference symbol IP. The installing part IP is configured such that any of the belt units 64 and 64A including the respective intermediary image bearing members 15 or 15A or the belt unit 64B including the intermediary image bearing member that is smaller in width than the intermediary image bearing members 15 and 15A can be installed therein. When the movable housing 1B is opened as illustrated in FIG. 7, the area above the movable housing 1B is opened, so that the belt unit 64 received by the movable housing 1B can be lifted up to be taken out from the movable cover 1B. The belt unit 64A including the intermediary image bearing member 15A that is long in circumferential length and the belt unit 64B including the intermediary image bearing member that is smaller in width can be also removed from the installing part IP of the main body housing land taken out from the movable housing 1 in substantially the same manner as in the belt unit 64. In the image forming apparatus of this example, the cleaning device 32 that is separate from the belt units 64, 64A and 64B is also supported by the movable housing 1B, so that the cleaning device 32 is also rotated together with the movable housing 1B. FIG. 8 and FIG. 9 are cross sections illustrating the belt units 64 and 64A removed from the installing part IP of the main body housing 1 and taken out from the movable housing 1B, respectively.

The movable housing 1B is configured such that any of the belt units 64, 64A and 64B can be received. Therefore, for example, when a user using the image forming apparatus of FIG. 1, in which the intermediary image bearing member 15 that is short in circumferential length is installed and which is therefore relatively inexpensive, is necessitated to obtain an image forming apparatus capable of forming a color image on each side of a recording medium that is larger in size, the user can configure the image forming apparatus of FIG. 1 to the image forming apparatus illustrated in FIG. 6 by simply obtaining the belt unit 64A having the intermediary image bearing member 15A that is long in circumferential length. The user opens the movable housing 1B, thereby removing the belt unit 64 from the installing part IP of the main body housing 1, as illustrated in FIG. 7, then, takes out the belt unit 64 from the movable housing 1B, causes the newly obtained belt unit 64A to be received by the movable housing 1B, and closes the movable housing 1B, and thereby the intermediary image bearing member 15A long in circumferential length is installed in the installing part IP of the main body housing 1 of the image forming apparatus of FIG. 1. Thereby, the image forming apparatus of FIG. 6 that can form an image on a larger recording medium is obtained. Thus, in the image forming apparatus of the present invention, any of the belt units 64, 64A and 64B which has been previously installed in the main body housing 1 can be exchanged with any one of the belt units 64, 64A and 64B, so that, according to the present invention, an image forming apparatus capable of forming a color image on each side of a recording medium having a size desired by the user can be freely realized by exchanging a part thereof with another one.

Further, when manufacturing image forming apparatuses, by causing either of the belt units 64, 64A and 64B to be received by the movable housing 1B of each image forming apparatus, image forming apparatuses having different functions or performances can be manufactured, respectively. Thereby, the need to meet diverse needs of users can be easily realized.

Figure 5D:
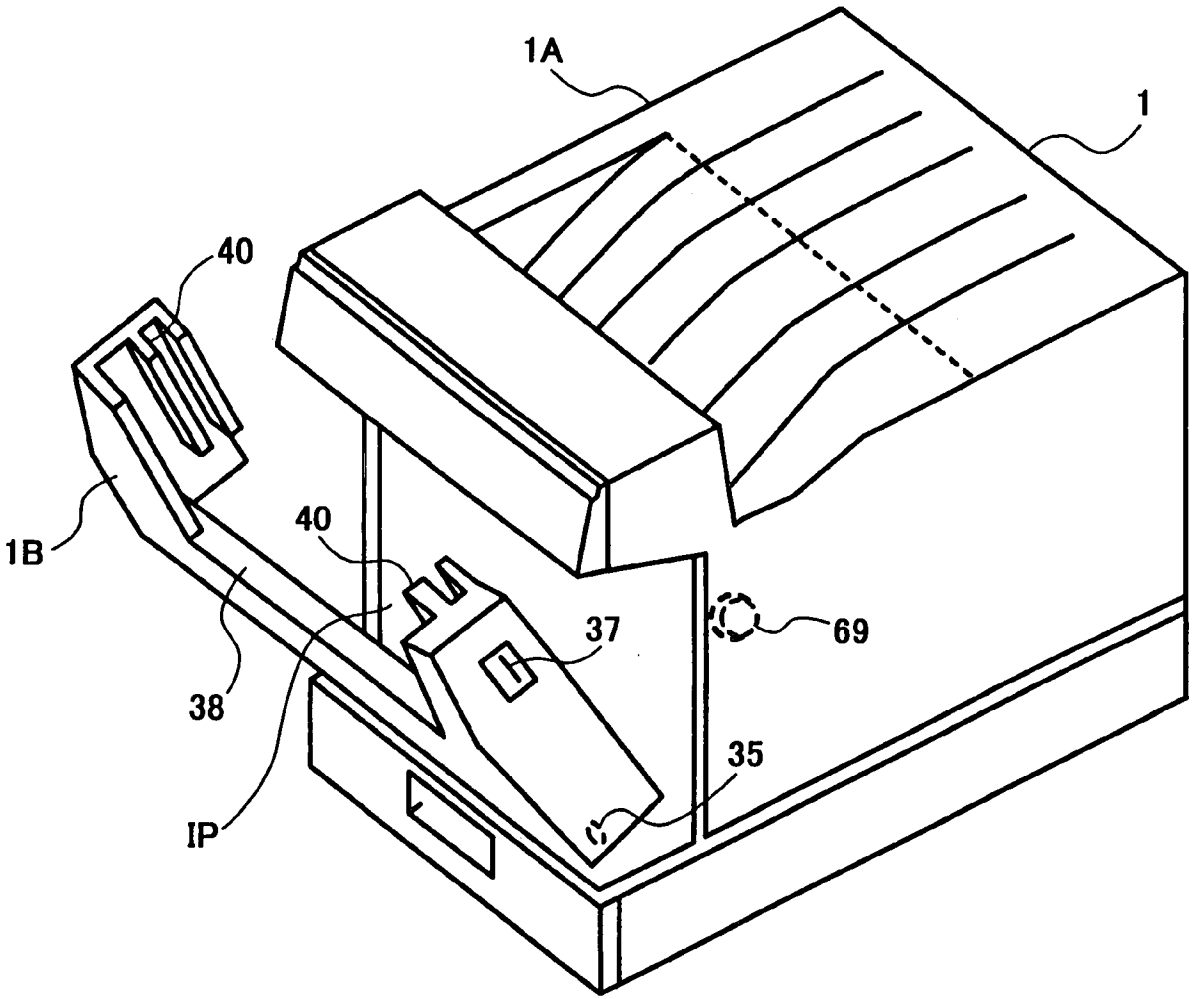
FIG. 5D is a perspective view of the image forming apparatus, in which a movable housing of the main body housing is opened and a belt unit has been removed from an installing part of the main body housing, illustrating an example of a receiving and guiding mechanism configured to receive and guide either of a plurality of belt units including intermediary image bearing members different in size to be installed in and removed from an installing part of the main body housing.
Figure 10:
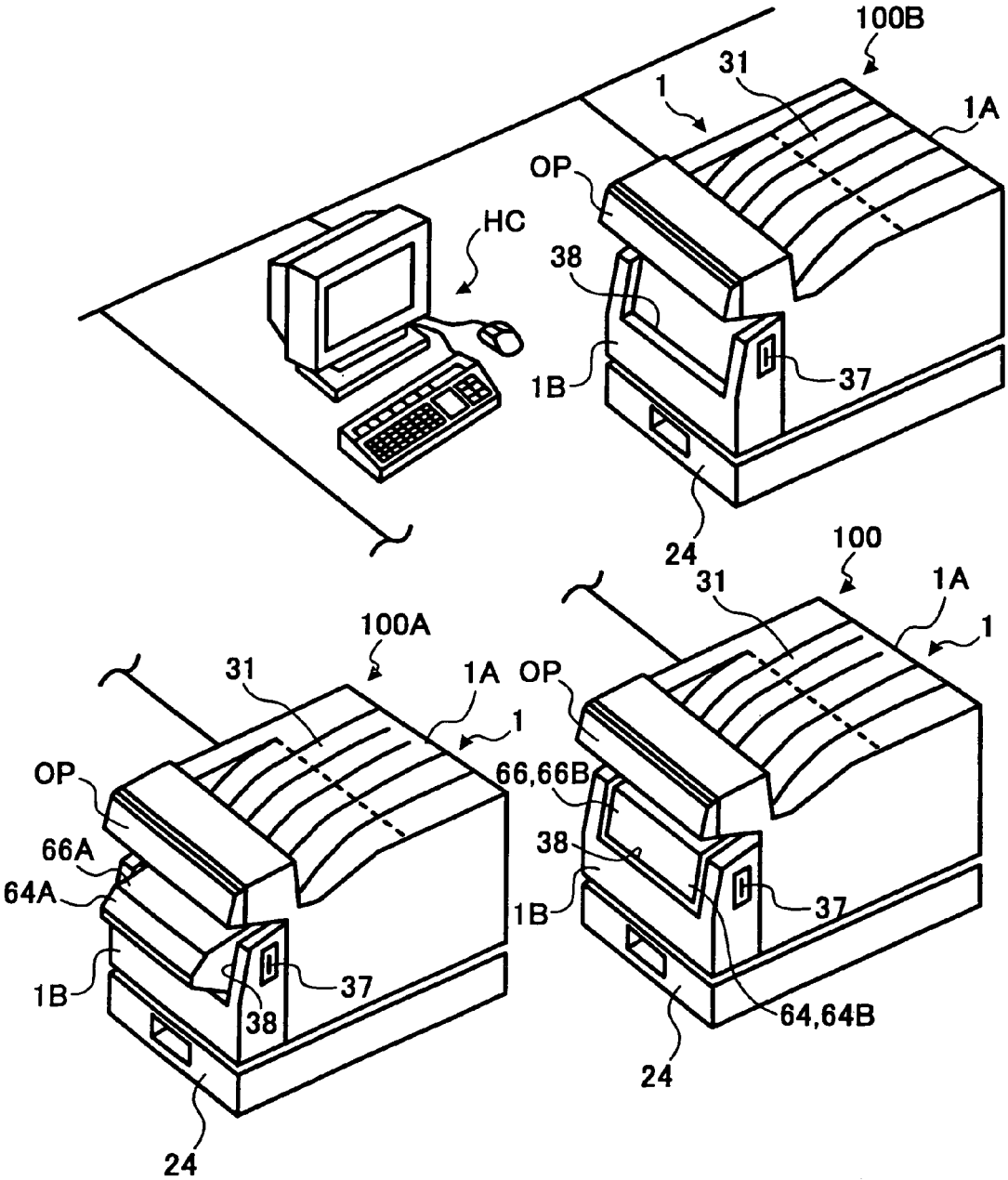
FIG. 10 is a perspective view of an image forming system in which image forming apparatuses are connected with a host computer.

FIG. 5D illustrates a state of the image forming apparatus illustrated in FIG. 1 and FIG. 6, in which the movable housing 1B is opened and thereby the belt unit 64, 64A or 64B has been removed from the installing part IP of the main body housing 1 and the belt unit 64, 64A or 64B has been taken out from the movable housing 1B. In contrast, FIG. 10 illustrates image forming apparatuses 100, 100A and 100B, each in a state that the movable housing 1B is closed. The belt unit 64 or 64B is installed in the image forming apparatus denoted by reference numeral 100, the belt unit 64A is installed in the image forming apparatus denoted by reference numeral 100A, and no belt unit is installed in the image forming apparatus denoted by reference numeral 100B.

As illustrated in FIG. 5D and FIG. 10, a lock releasing lever 37 is provided to the movable housing 1B. When the movable housing 1B is closed, the movable housing 1B is locked to the fixed housing 1A, and in a state that the movable housing 1B is closed, by operating the lock releasing lever 37, the movable housing 1B is released from being locked to the fixed housing 1A, and thereby the movable housing 1B can be rotated to the opened position illustrated in FIG. 5D. An opening 38 is formed in the movable housing 1B such that each of the belt unit 64, 64A and 64B including intermediary image bearing member 15 or 15A different in size can be installed in the installing part P of the main body housing 1 as described later.

Further, as illustrated in FIGS. 5A, 5B and 5C, knobs 39A, 39 and 39B are provided to the covers 66A, 66 and 66B of the belt units 64A, 64 and 64B, respectively, so that the operator can install and remove the belt units 64A, 64 and 64B in and from the installing part IP of the main body housing 1, in this case, via the movable housing 1B, by grasping the knob 39A, 39 and 39B, respectively. The positions of the knobs 39A, 39 and 39B relative to the covers 66A, 66 and 66B are set such that when the movable housing 1B in which the belt unit 64A, 64 or 64B has been received is closed, the knob 39A, 39 or 39B is concealed inside of the movable housing 1B as can be understood from the view of FIG. 10, and when the movable housing 1B is opened, the knob 39A, 39 or 39B is exposed. Thereby, when the image forming apparatus is operating with the movable housing 1B closed, the belt unit 64A, 64 or 64B cannot be removed from the main body housing 1, because the operator cannot grasp the knob 39A, 39 or 39B of the belt unit 64A, 64 or 64B, so that the operator cannot remove the belt unit 64A, 64 or 64B from the main body housing 1. Thereby, when electric current is being supplied to the image forming apparatus so that the image forming apparatus is in an operating condition, it will never occur that the belt unit 64A, 64 or 64B is inadvertently removed from the apparatus. When the movable housing 1B is opened, a switch (not shown) is turned off, so that current distribution to the image forming apparatus is shut off. In that state, the operator can safely take out the belt unit 64A, 64 or 64B removed from the installing part IP of the main body housing 1 from the movable housing 1B by grasping the exposed knob 39A, 39 or 39B.

More specifically, as illustrated in FIG. 5D, guiding grooves 40, serving as an example of a receiving and guiding mechanism configured to receive and to guide any of the belt units 64A, 64 and 64B to be installed in the installing part IP of the main body housing 1, are formed on internal surfaces of side walls of the movable housing 1B. Further, as illustrated in FIG. 5A, 5B and 5C, guiding protrusions 41A, 41 and 41B configured to engage with the guiding grooves 40 of the movable housing 1B are provided to the covers 66A, 66 and 66B of the belt units 64A, 64 and 64B, respectively. By engaging the guiding protrusions 41A, 41 or 41B of the belt unit 64A, 64 or 64B with the guiding grooves 40 of the movable housing 1B, the belt unit 64A, 64 or 64B is received by the movable housing 1B. Thus, each of the belt units 64, 64A and 64B can be easily received by and taken out from the movable housing 1B.

Furthermore, as illustrated in FIG. 1, FIG. 6 and FIG. 7, a locking member 42, e.g., a spring, is arranged to the fixed housing 1A, and as illustrated in FIGS. 5A, 5B and 5C, locking grooves 43A, 43 and 43B with which the locking member 42 is engaged are formed on the covers 66A, 66 and 66B, respectively. When the movable housing 1B is closed as illustrated in FIG. 1 and FIG. 6 in a state that the belt unit 64A, 64 or 64B is received by the movable housing 1B, the locking member 42 engages with the locking groove 43A, 43 or 43B, thereby pressing the cover 66A, 66 or 66B downward so that the belt unit 64A, 64 or 64B is positioned in a predetermined position in the installing part IP of the main body housing 1. At this time, the movable housing 1B is locked relative to the fixed housing 1A, gear 68A, 68 or 68B of the belt unit 64A, 64 or 64B engages with the driving gear 69 supported by the fixed housing 1A, and the transfer roller 20A, 20 or 20B of the belt unit 64A, 64 or 64B is brought into contact with the output contact point of the power source as describe earlier. Thus, the belt unit 64A, 64 or 64B received by the movable housing 1B is installed in the installing part IP of the main body housing 1 by closing the movable housing 1B, and thereby the intermediary image bearing member 15 or 15A included in the belt unit 64A, 64 or 64B is installed in the installing part IP of the main body housing 1.

Figure 11:
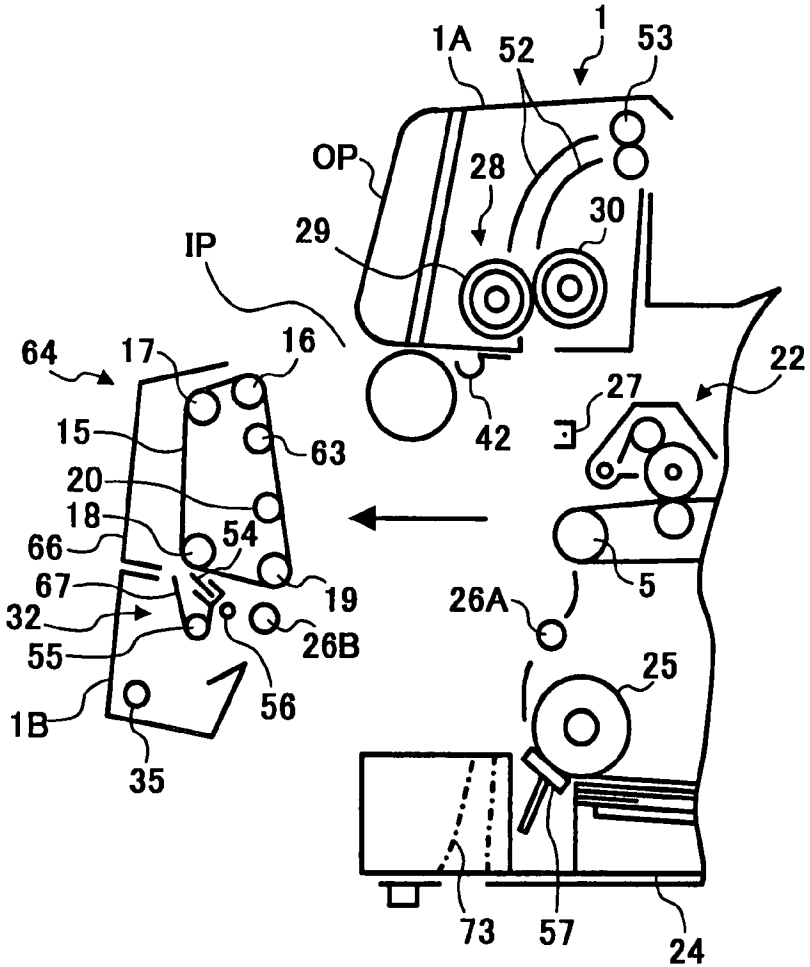
FIG. 11 is a vertical cross section illustrating a state that the movable housing including the belt unit is moved in a horizontal direction to be removed from a fixed housing of the main body housing.

The movable housing 1B may be supported by the fixed housing 1A so as to move in a horizontal direction, instead of being rotatably supported by the fixed housing 1A, to be released from the fixed housing 1A, as illustrated in FIG. 11, for example, using a rail member or a linking mechanism, not shown. In this case also, after bringing the movable housing 1B into an opened position, by engaging the guiding protrusions 41A, 41 or 41B of the belt unit 64A, 64 or 64B with the guiding grooves 40 of the movable housing 1B, the belt unit 64A, 64 or 64B including the intermediary image bearing member 15 or 15A can be received by and taken out from the movable housing 1B. Also, in the image forming apparatus of FIG. 11, the cleaning device 32 is supported by the movable housing 1B. In this example, because the movable housing 1B is moved in a horizontal direction, an advantage is obtained because used toner collected in the case 67 of the cleaning device 32 is difficult to spill from the case 67.

In each of the image forming apparatuses illustrated in FIG. 7 and FIG. 11, the movable housing 1B is supported by the fixed housing 1A such that when the movable housing 1B is brought into the opened position, the intermediary image bearing member 15 of the belt unit 64 received by the movable housing 1B is separated from the intermediary transfer member 3 mounted to the fixed housing 1A. Therefore, when the belt unit 64 is received by and taken out from the movable housing 1B, the intermediary image bearing member 15 never touches the intermediary transfer member 3, so that damage to the intermediary image bearing member 15 or the intermediary transfer member 3 is prevented. Further, when the movable housing 1B is opened, a conveying path of a recording medium is largely opened, so that a recording medium jammed in the conveying path can be easily cleared. Thus, the movable housing 1B can be opened for other purposes than for exchanging the belt unit 64 with another one to facilitate performance of necessary operations such as clearing jams.

In each of the image forming apparatuses illustrated in FIG. 1, FIG. 5D, FIG. 6 and FIG. 7, the movable housing 1B is supported by the fixed housing 1A so as to rotate between the closed position and the opened position. However, the movable housing 1B can be configured to further rotate, exceeding the opened position illustrated in FIG. 7, to another opened position illustrated in FIG. 12, and to be supported at each position. That is, the movable housing 1B is configured to be supported by the fixed housing 1A at two opened positions, a first opened position where the movable housing 1B reaches after rotating a relatively small angle from the closed position, e.g., the opened position of the movable housing 1B in FIG. 7, and a second opened position where the movable housing 1B reaches after rotating a greater angle from the closed position, e.g., the opened position of the movable housing 1B in FIG. 11. The movable housing 1B may be supported, for example, by a stopper (not shown) at the first and second opened positions, respectively.

Figure 12:
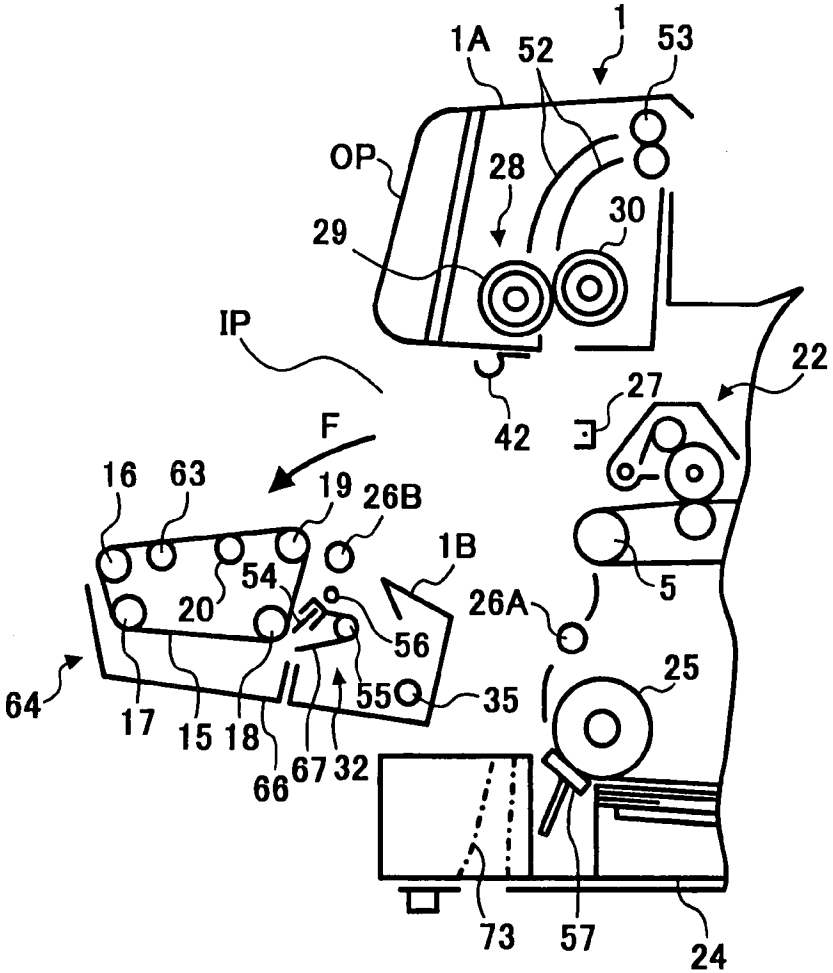
FIG. 12 is a vertical cross section illustrating a state that the movable housing illustrated in FIG. 7 is further rotated to a second opened position.

According to the above-described configuration, a belt unit is received by and taken out from the movable housing 1B in a state that the movable housing 1B is opened to the first opened position, and when a recording medium is jammed, the movable housing 1B may be opened to the second opened position so that the conveying path of the recording medium is greatly opened, and thereby the jammed recording medium can be easily cleared and the inside of the main body housing 1 can be easily cleaned. At that time, as illustrated in FIG. 11 and FIG. 12, because a roller 26A of the registration roller pair 26 is supported by the fixed housing 1A and a roller 26B of the registration roller pair 26 is supported by the movable housing 1B, by rotating the movable housing 1B to the second opened position, the rollers 26A and 26B of the registration roller pair 26 are greatly separated from each other, so that removal of a recording medium jammed between the rollers 26A and 26B and cleaning of the rollers 26A and 26B can be easily performed. Further, because the corona discharging device 27 is supported by the fixed housing 1A, by opening the movable housing 1B to the second opened position, the corona discharging device 27 can be easily accessed, so that cleaning thereof can be easily performed.

Further, in the image forming apparatus of the present invention, the intermediary image bearing members 15 and 15A are constituted of seamless belts driven to rotate, respectively, regardless of their sizes. Therefore, each of the intermediary image bearing members 15 and 15A, regardless of whether it is short or long in circumferential length, can be configured to be compact to be easily accommodated in the installing part IP of the main body housing 1, so that the main body housing 1 can be prevented from being made large.

Furthermore, the image forming apparatus is configured, as described above, such that at least the intermediary image bearing members 15 and 15A, and the plurality of belt supporting rollers 16, 17, 18, 19 and the plurality of belt supporting rollers 16A, 19A, 70A, 71A, around which the intermediary image bearing members 15 and 15A are spanned, respectively, are integrated with each other to be formed as the belt units 64A, 64 and 64B, respectively. Further, the installing mechanism for installing any of the intermediary image bearing members 15 or 15A different in size in the installing part IP of the image forming apparatus is configured such that by installing any of the belt units 64, 64A or 64B having the intermediary image bearing members 15 or 15A different in size in the installing part IP in a detachable manner, the intermediary image bearing member 15 or 15A is installed in the installing part IP of the main body housing 1 of the image forming apparatus, so that a desired intermediary image bearing member can be easily installed in an image forming apparatus and thereby the image forming apparatus meeting a need of a user can be easily configured.

Further, in the image forming apparatus of the present invention, the belt units 64, 64A and 64B including the intermediary image bearing members 15 and 15A that are different in size are configured such that at least some parts of the belt units 64, 64A and 64B are installed in substantially the same positions in the main body housing 1 of the image forming apparatus, respectively. Thereby, control of an image forming operation of the image forming apparatus is prevented from being complicated.

Exemplary configurations of the belt units 64 and 64A achieving the above-described feature of the present invention will be described referring to FIG. 1 and FIG. 6, however, the belt unit 64B can also be configured in a similar manner.

The belt units 64 and 64A having the intermediary bearing members 15 and 15A different from each other in size include the transfer rollers 20 and 20A as transfer devices performing a function of transferring the first image on the intermediary transfer member 3 onto the intermediary image bearing members 15 and 15A as well as a function of transferring the second image on the intermediary transfer member 3 onto the other side of a recording medium P. The belt unit 64 and 64A are configured such that the transfer rollers 20 and 20A of the belt units 64 and 64A having the intermediary image bearing members 15 and 15A that are different from each other in size are installed substantially in the same position in the main body housing 1, respectively. With this configuration, transfer conditions when transferring the first image on the intermediary transfer member 3 onto the intermediary image bearing member 15 or 15A and when transferring the second image on the intermediary transfer member 3 onto the other side of the recording medium P can be made substantially the same when the intermediary image bearing member 15 that is short in circumferential length is installed in the installing part IP of the main body housing 1 and when the intermediary image bearing member 15A that is longer in circumferential length than the intermediary image bearing member 15 is installed in the installing part IP of the main body housing 1. Thereby, control of the image forming operation of the image forming apparatus can be prevented from being complicated.

Further, in the belt units 64 and 64A, recording medium conveying paths extending substantially in a vertical direction are formed by the intermediary image bearing members 15 and 16A constituted by seamless belts such that a recording medium P is conveyed to transfer positions in the recording medium conveying paths, where the second and first images are respectively transferred onto the recording medium P, from positions below the transfer positions, respectively. Here, the belt units 64 and 64A including the intermediary image bearing members 15 and 15A that are different from each other in size are configured such that the supporting rollers 19 and 16, and 19A and 16A, supporting parts of the intermediary image bearing members 15 and 15A, forming the recording medium conveying paths of the belt units 64 and 64A, are installed in substantially the same position in the main body housing 1, respectively. With this configuration, recording medium conveying conditions in the recording medium conveying paths formed by the intermediary image bearing members 15 and 15A of the belt units 64 and 64A can be made substantially the same when the intermediary image bearing member 15 that is short in circumferential length is installed in the installing part IP of the main body housing 1 and when the intermediary image bearing member 15A that is longer in circumferential length than the intermediary image bearing member 15 is installed in the installing part IP of the main body housing 1. Thereby, in the image forming apparatus of the present invention, it is not necessary to change a recording medium conveying condition each time when an intermediary image bearing member of one size is exchanged with another one of a different size, so that control of an image forming operation can be prevented from being complicated.

Furthermore, the belt units 64 and 64A include the opposing electrodes 63 and 63A arranged to oppose a transfer device transferring the first image transferred onto the intermediary image bearing members 15 and 15A onto one side of a recording medium P (i.e., the corona discharging device 27 in each of the illustrated examples) sandwiching the intermediary image bearing members 15 and 15A with the transfer device and the opposing electrodes 63 and 63A, respectively. Here, the belt units 64 and 64A including the intermediary image bearing members 15 and 15A that are different from each other in size are configured such that the opposing electrodes 63 and 63A of the belt units 64 and 64A are installed in substantially the same position in the main body housing 1, respectively. With this configuration, transferring conditions for transferring the first image onto one side of the recording medium P from the intermediary image bearing members 15 and 15A can be made substantially the same when the intermediary image bearing member 15 that is short in circumferential length is installed in the installing part IP of the main body housing 1 and when the intermediary image bearing member 15A that is longer in circumferential length than the intermediary image bearing member 15 is installed in the installing part IP of the main body housing 1, so that control of an image forming operation of the image forming apparatus can be prevented from being complicated.

The cleaning devices 32 for cleaning the intermediary image bearing members 15 and 15A after transferring the first image onto one side of a recording member P are configured, as illustrated in FIG. 1 and FIG. 6, separately from the belt units 64 and 64A, respectively. However, as described earlier, the cleaning devices 32 can be configured as components constituting the belt units 64 and 64A, respectively. When the belt units 64 and 64A are thus configured to include the cleaning devices 32, respectively, the belt units 64 and 64A including the intermediary image bearing members 15 and 15A that are different from each other in size may be configured such that the cleaning devices 32 of the belt units 64 and 64A are installed in substantially the same position in the main body housing 1, respectively. By adopting the above-described configuration, cleaning conditions for the intermediary image bearing members 15 and 15A can be made substantially the same when the intermediary image bearing member 15 that is short in circumferential length is installed in the installing part IP of the main body housing 1 and when the intermediary image bearing member 15A that is longer in circumferential length than the intermediary image bearing member 15 is installed in the installing part IP of the main body housing 1.

The belt units 64 and 64A include the backing members for the cleaning members of the cleaning devices 32 (i.e., the cleaning blades 54 in the illustrated examples)for cleaning surfaces of the intermediary image bearing members 15 and 15A of seamless belts after transferring the first image onto one side of a recording medium P, arranged to oppose the cleaning blades 54 of the cleaning devices 32 sandwiching the intermediary image bearing members 15 and 15A with the backing members and the cleaning members of the cleaning devices 32, respectively. In the belt unit 64 illustrated in FIG. 1, the supporting roller 18 serves as the backing member, and in the belt unit 64A illustrated in FIG. 6, an exclusive backing member 72A is provided. Here, the belt units 64 and 64A having the intermediary image bearing members 15 and 15A that are different from each other in size are configured such that the backing members of the belt units 64 and 64A are installed in substantially the same position in the main body housing 1, respectively. With the above-described configuration also, cleaning conditions for the intermediary image bearing members 15 and 15A can be made substantially the same when the intermediary image bearing member 15 that is short in circumferential length is installed in the installing part IP of the main body housing 1 and when the intermediary image bearing member 15A that is longer than the intermediary image bearing member in circumferential length is installed in the installing part IP of the main body housing 1.

Further, as described above, the screws 68 and 68A are fixed to the supporting rollers 16 and 16A of the belt units 64 and 64A, and when the belt units 64 and 64A are installed in the installing part IP of the main body housing 1, the screws 68 and 68A engage with the driving gear 69 provided to the main body housing 1, respectively. The supporting rollers 16 and 16A are rotated via the screws 68 and 68A, and thereby the intermediary image bearing members 15 and 15A and other supporting rollers are driven. Thus, the supporting rollers 16 and 16A serve as driving rollers. By configuring the belt units 64 and 64A such that the supporting rollers 16 and 16A are installed in substantially the same position in the main body housing 1, respectively, the screws 68 and 68A fixed to the supporting rollers 16 and 16A engage with the driving gear 69 provided to the main body housing 1, so that the intermediary image bearing members 15 and 15A are driven to rotate without any problem, when the belt unit 64 having the intermediary image bearing member 15 that is short in circumferential length is installed in the installing part IP of the main body housing 1 and when the belt unit 64A having the intermediary image bearing member 15A that is longer in circumferential length than the intermediary image bearing member 15 is installed in the installing part IP of the main body housing 1. That is, the belt units 64 and 64A including the intermediary image bearing members 15 and 15A that are different from each other in size are configured such that those of the supporting rollers supporting the intermediary image bearing members 15 and 15A, serving as driving rollers, are installed in substantially the same position in the main body housing 1, respectively.

Thus, by configuring the belt units 64, 64A and 64B such that at least some parts of the belt units 64, 64A and 64B are installed in substantially the same positions in the main body housing 1, respectively, the above-described various advantages can be obtained. Further, in manufacturing, some parts of the belt units 64, 64A and 64B can be made common parts, so that production costs of the belt units 64, 64A and 64B can be reduced.

As can be understood by comparing the cross section of FIG. 1 with that of FIG. 6, the intermediary image bearing member 15A that is long in circumferential length is installed in the installing part IP of the main body housing 1 of the image forming apparatus in such a manner that the intermediary image bearing member 15A protrudes to the side opposite the intermediary transfer member 3 more than the intermediary image bearing member 15 that is shorter than the intermediary image bearing member 15A in circumferential length protrudes. Thereby, the parts of the intermediary image bearing members 15 and 15A opposing the intermediary transfer member 3, i.e., the parts of the intermediary image bearing members 15 and 15A forming the recording medium conveying paths, can always be made substantially the same regardless of the circumferential length of the intermediary image bearing members 15 or 15A installed in the main body housing 1, so that a recording medium can always be conveyed in the same condition, and thereby control of an image forming operation of the image forming apparatus can be prevented from being complicated.

Further, as illustrated in FIG. 5D and FIG. 10, the opening 38 is formed in the movable housing 1B of the main body housing 1, so that when the belt unit 64A including the intermediary image bearing member 15A that is long in circumferential length is installed in the installing part IP of the main body housing 1 as in the image forming apparatus 100A of FIG. 10, the cover 66A of the belt unit 64A protrudes from an adjacent part of the main body housing 1. That is, the belt units 64A, 64 and 64B have the covers 66A, 66 and 66B covering respective components of the belt units 64A, 64 and 64B, as illustrated in FIG. 5A, 5B and 5C, and the opening 38 is formed in the movable housing 1B such that the covers 66A, 66 and 66B are allowed to protrude from parts of the main body housing 1 adjacent to the covers 66A, 66 and 66B, respectively. With this configuration, any of the belt units 64A, 64 and 64B can be installed in the installing part IP of the main body housing 1 without changing the main body housing 1, or only by slightly changing the main body housing 1. Thereby, when an installed belt unit is exchanged with another one, additional increases in cost are prevented.

Furthermore, as can be understood from FIG. 10, exposed parts of the covers 66A, 66 and 66B of the belt units 64A, 64 and 64B are configured to serve as exterior parts of the image forming apparatuses, respectively. With this configuration, whichever of the belt units 64A, 64 and 64B is installed in the main body housing 1, it is not necessary to provide a cover to cover the installed one of the belt unit 64A, 64 and 64B, thus preventing additional increases in cost.

Further, as described earlier referring to FIG. 1, in the image forming apparatus of the present invention, the sheet feeding cassette 24 accommodating the recording medium P is installed to be drawn out in the direction of the arrow E relative to the main body housing 1. The position of the opening 38 is formed such that the cover 66A of the belt unit 64A, for example, protrudes in the direction of the arrow E in which the sheet feeding cassette 24 is drawn out.

By adopting the above-described configuration, even when the belt unit 64A relatively large in size is installed in the main body housing 1, the overall height of the image forming apparatus including the belt unit 64A can be prevented from being increased compared with a case that the belt unit 64 or 64B that is relatively small in size is installed in the main body housing 1. Furthermore, when installing the image forming apparatus, a space must be secured in the direction of the arrow E in which the sheet feeding cassette 24 is drawn out. When the belt unit 64A that is relatively large in size is installed in the main body housing 1, because the belt unit 64A protrudes toward the side of the above-described space that is required for drawing out the sheet feeding cassette 24, the installing space for the image forming apparatus will not be further increased. That is, the installation spaces of the image forming apparatus of this example when the belt unit 64A that is relatively large in size is installed in the main body housing 1 and when the belt unit 64 that is relatively small in size is installed in the main body housing 1 can be the same.

Further, in the image forming apparatus of the present invention, a size recognition device for recognizing the size of an intermediary image bearing member installed in the main body housing 1 of the image forming apparatus is provided. For example, as illustrated in FIGS. 5A, 5B and 5C, recognizing parts MA, M and MB, constituted by protrusions in this example, are provided to the covers 66A, 66 and 66B of the belt units 64A, 64 and 64B, respectively. The recognizing parts MA, M and MB are arranged in such positions of the belt units 64A, 64 and 64B that when the belt units 64A, 64 and 64B are installed in the installing part IP of the main body housing 1, the recognizing parts MA, M and MB are located in positions different from each other in the main body housing 1. The recognizing parts MA, M and MB are detected by detecting devices such as photo-sensors and micro-switches (not shown) provided in the main body housing 1, respectively, and thereby which of the belt units 64A, 64 and 64B is installed in the installing part IP of the main body housing 1 can be automatically determined. Thereby, control corresponding to each intermediary image bearing member can be performed in forming an image.

Furthermore, by providing marks, labels or descriptions indicating the sizes of respective intermediary image bearing members included in the belt units 64A, 64 and 64B at parts of the covers 66A, 66 and 66B, that can be seen from outside when the belt units 64A, 64 and 64B are installed in the installing part IP of the main body housing 1, respectively, a user using the image forming apparatus can surely recognize the maximum size of a recording medium on which an image can be formed with the image forming apparatus. Thereby, the user can operate the image forming apparatus without being uncertain about the maximum size of a recording medium on which an image can be formed.

Figure 14:
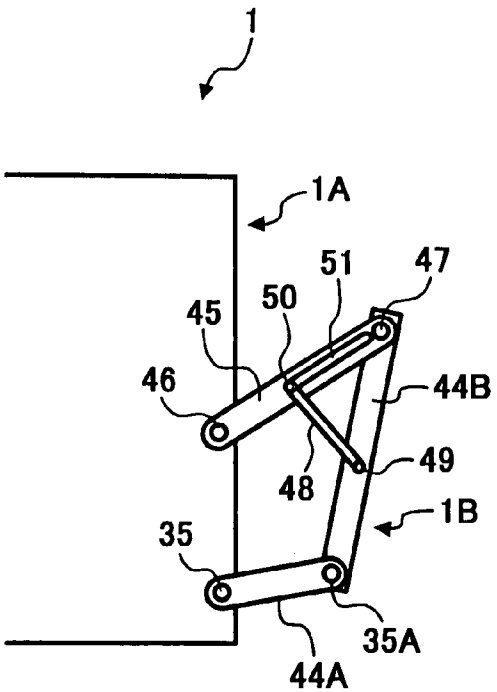
FIG. 14 is a diagram for explaining a mechanism of the movable housing of FIG. 13.
Figure 13:
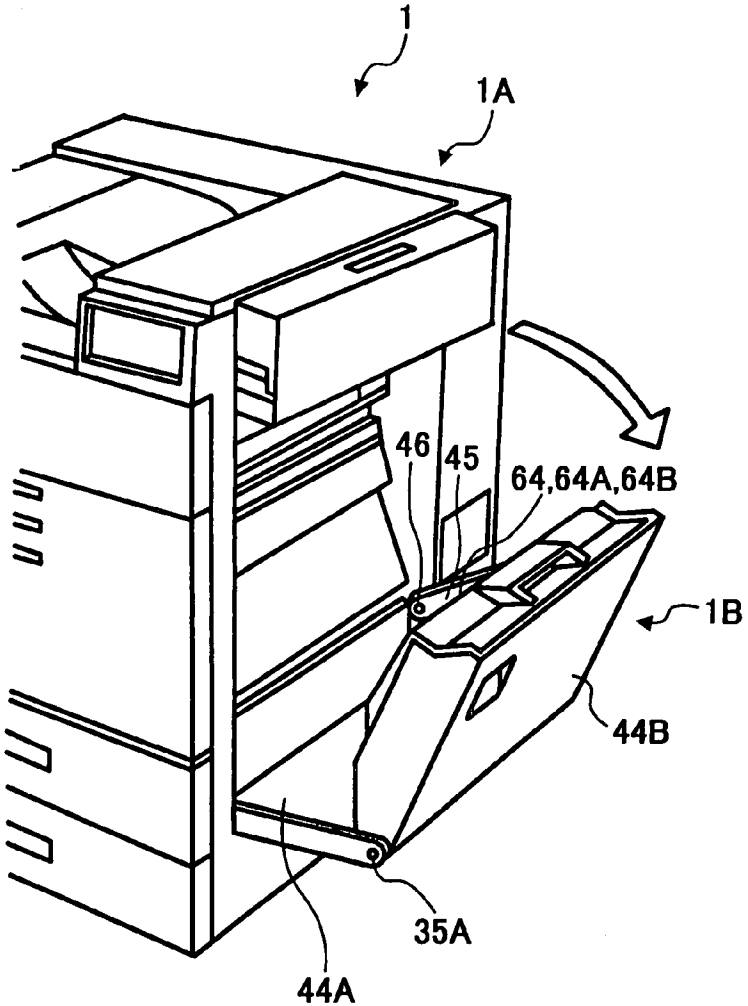
FIG. 13 is a perspective view of the image forming apparatus including a movable housing that bends.

Further, as illustrated in FIG. 13 and FIG. 14, the movable housing 1B may be configured to include a first cover member 44A rotatably supported by the fixed housing 1A via the supporting axis 35 (FIG. 14) and a second cover member 44B rotatably connected with the first cover member 44A via another supporting axis 35A. The supporting axis 35 and the another supporting axis 35A are parallel to each other, and the first cover member 44A rotates in the clockwise direction around the supporting axis 35 and the second cover member 44B rotates in the counterclockwise direction around the another supporting axis 35A in FIG. 13 and FIG. 14, so that the movable cover 1B bends at the position of the another supporting axis 35A. After opening the movable cover 1B as illustrated in FIG. 13 and FIG. 14, the belt units 64, 64A and 64B can be received by and taken out from the movable cover 1B, respectively.

As illustrated in FIG. 14, a connecting member 45 is rotatably attached to the fixed housing 1A and the second cover member 44B at both ends thereof in the longitudinal direction thereof via pins 46 and 47, respectively, and one end of a regulating member 48 is rotatably connected with the second cover member 44B via a pin 49. A guide pin 50 provided to the other end of the regulating member 48 is engaged with a long hole 51 formed in the connecting member 45 to slide therein.

When the movable housing 1B is put in the opened position as illustrated in FIG. 14, the guide pin 50 of the regulating member 49 contacts a lower end of the long hole 51, so that the movable housing 1B is prevented from being further rotated. Thereby, the movable housing 1B is kept in that opened position. As the movable housing 1B is closed, the guide pin 50 slides toward an upper end of the long hole 51, and when the movable housing 1B is completely closed, the first and the second cover members 44A and 44B are put in a state that surfaces thereof are flat in the vertical direction.

The connecting member 45 and the regulating member 48 can be provided at both sides of the movable housing 1B. However, in this example, these members are only provided at the rear side of the apparatus, so that workability from the front side of the apparatus is not hindered, which is advantageous.

The movable housing 1B may be configured by three or more cover members such that the movable housing 1B is bent at respective connecting parts thereof. Thus, by configuring the movable housing 1B by at least two cover members connected with each other such that the movable cover 1B is bent at respective connecting parts thereof when the movable cover 1B is put in an opened position, the space occupied by the movable housing 1B when the movable housing 1B is opened can be minimized, so that the image forming apparatus can be installed in a relatively small place.

In each of the image forming apparatuses described above, the corona discharging device 27, an example of the transfer device transferring the first image on the intermediary image bearing member 15 or 15A onto one side of a recording medium P, is arranged separately from the belt unit 64 or 64A. However, the corona discharging device 27 can be a part of the belt units 64 and 64A. That is, the belt units 64 and 64A can be configured to include a transfer device for transferring the first image on the intermediary image bearing members 15 and 15 A of endless belts onto one side of a recording medium P, respectively.

In this case, although the corona discharging devices 27 as the transfer devices for transferring the first image on the intermediary image bearing members 15 and 15A of endless belts onto one side of a recording medium P are arranged outside of the intermediary image bearing members 15 and 15A, respectively, in the image forming apparatuses illustrated in FIG. 1 and FIG. 6, the transfer devices for transferring the first image on the intermediary image bearing members 15 and 15A of endless belts onto one side of a recording medium P can be arranged inside of the intermediary image bearing members 15 and 15A, respectively.

Figure 15:
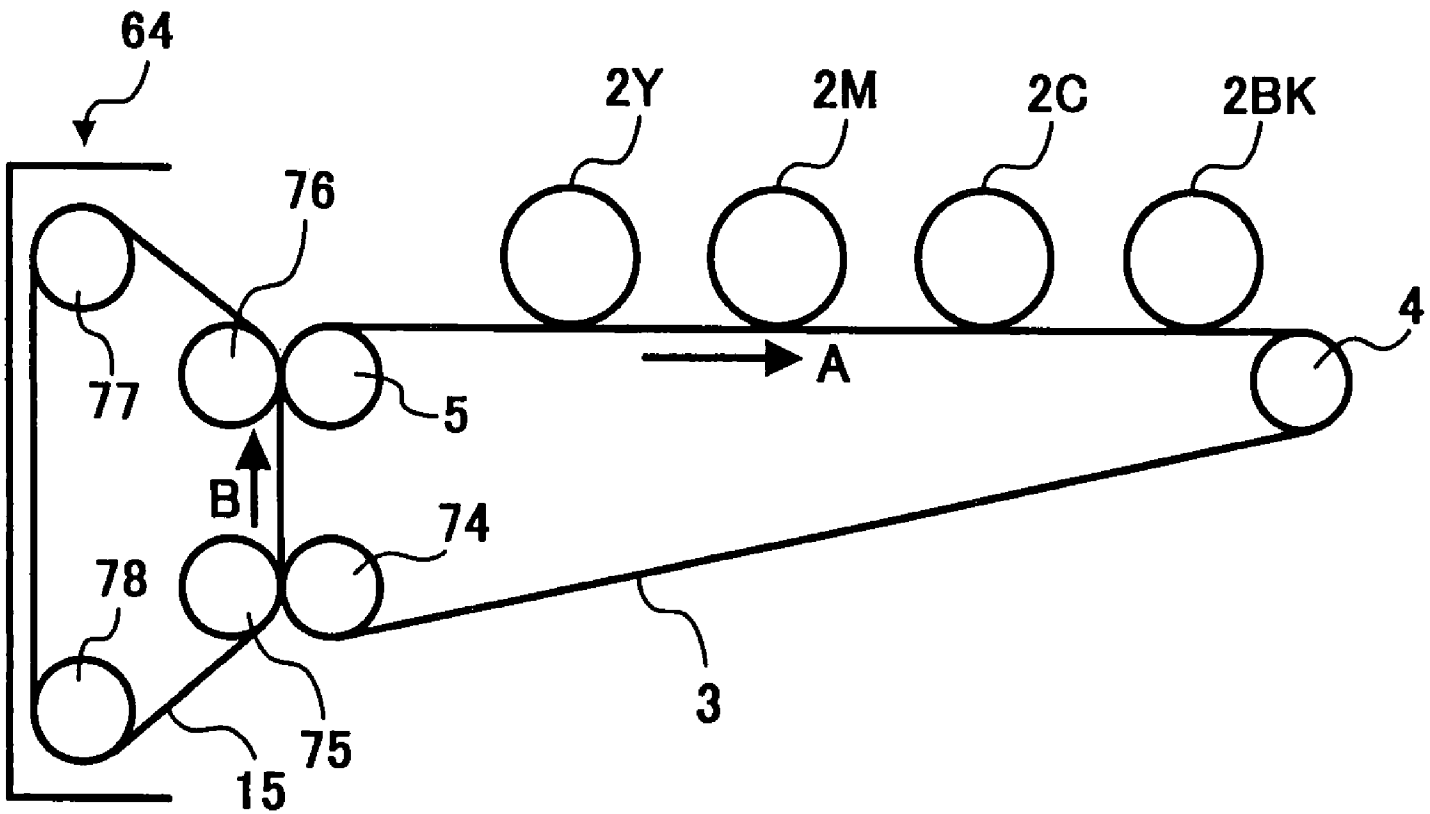
FIG. 15 is a diagram illustrating an exemplary configuration of the image forming apparatus in which a transfer device for transferring the first image formed on the intermediary image bearing member onto one side of a recording medium is arranged inside of the intermediary image bearing member.
Figure 16:
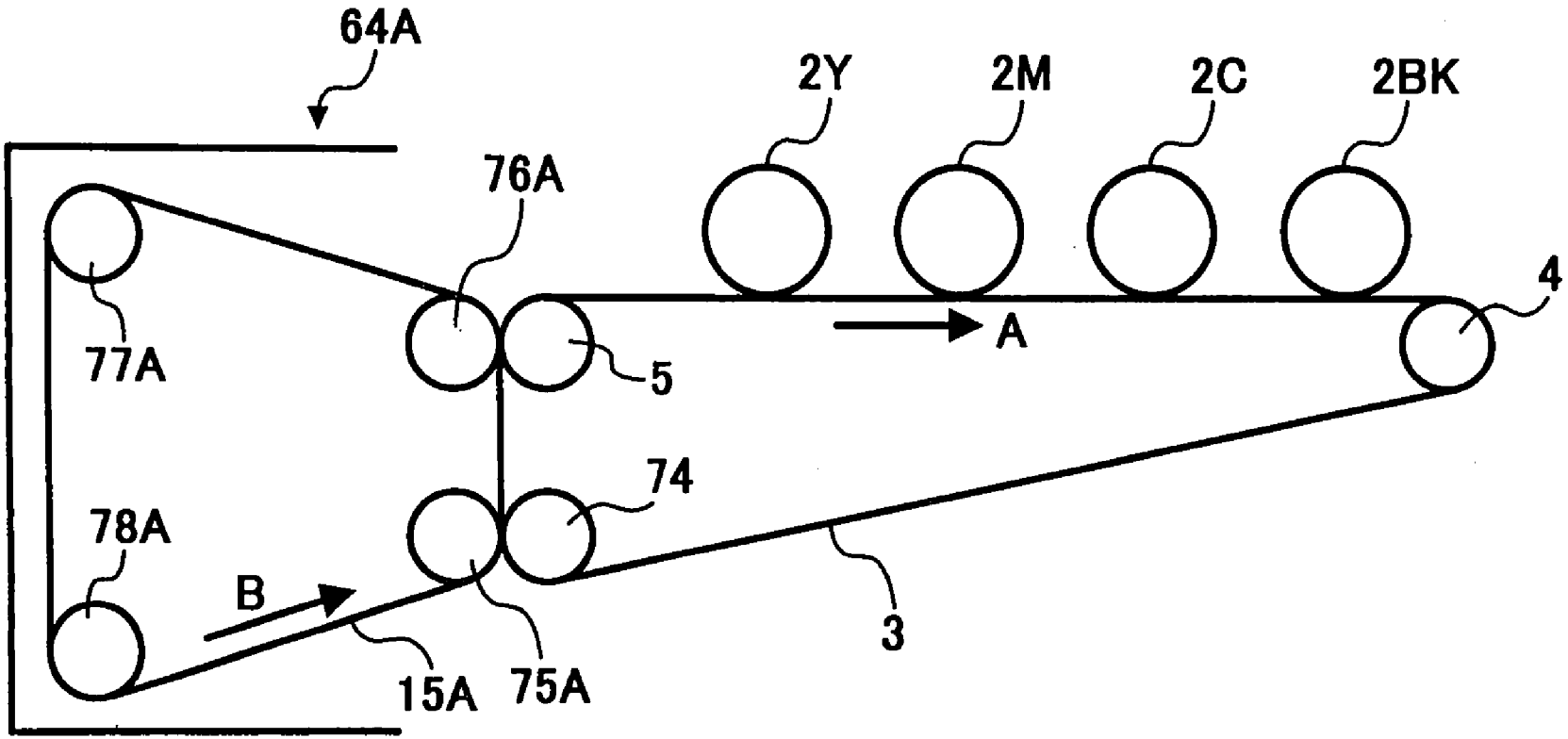
FIG. 16 is a diagram illustrating another exemplary configuration of the image forming apparatus in which a transfer device for transferring the first image on the intermediary image bearing member onto one side of a recording medium is arranged inside of the intermediary image bearing member.

FIG. 15 and FIG. 16 illustrate exemplary configurations of the image forming apparatus in which a transfer device for transferring the first image on the intermediary image bearing member 15 or 15A onto one side of a recording medium is arranged inside of the intermediary image bearing member 15 or 15A, respectively. FIG. 15 illustrates an exemplary configuration of the belt unit 64 including the intermediary image bearing member 15 of an endless belt that is short in circumferential length and the supporting rollers 75, 76, 77 and 78 around which the intermediary image bearing member 15 is spanned. FIG. 16 illustrates an exemplary configuration of the belt unit 64A including the intermediary image bearing member 15A of an endless belt that is long in circumferential length and the supporting rollers 75A, 76A, 77A and 78A around which the intermediary image bearing member 15A is spanned. The intermediary image bearing members 15 and 15A are driven to rotate in the direction indicated by the arrow B, respectively. In each of the configurations, the intermediary transfer member 3 of an endless belt is driven to rotate in the direction indicated by the arrow A.

In each of the configurations, as in the image forming apparatuses described earlier, toner images of different colors are transferred from the image bearing members 2Y, 2M, 2C and 2BK onto the intermediary transfer member 3 to be superimposed one upon another to form a first image thereupon, the first image is then transferred onto one side of a recording medium (not shown), and a second image formed on the intermediary transfer member 3 by visible images subsequently transferred thereupon to be superimposed one upon another is transferred onto the other side of the recording medium. At this time, in the examples illustrated in FIG. 15 and FIG. 16, the supporting rollers 75 and 75A function as a transfer device to transfer the first image on the intermediary transfer member 3 onto the intermediary image bearing members 15 and 15A and to transfer the second image on the intermediary transfer member 3 onto the other side of the recording medium, and the supporting rollers 76 and 76A function as a transfer device to transfer the first image transferred on the intermediary image bearing members 15 and 15A on to the one side of the recording medium, respectively. In these examples, a transfer voltage of plus polarity is applied to the supporting rollers 75 and 75A and a transfer voltage of minus polarity is applied to the supporting rollers 76 and 76A, respectively, so that respective transfer operations are performed. Thus, a transfer device to transfer the first image on an intermediary image bearing member onto one side of a recording medium is arranged inside of the intermediary image bearing member, and further, the transfer device is constituted by a transfer roller to which a transfer voltage is applied, i.e., in the illustrated examples, the supporting rollers 76 and 76A.

Further, a corona discharging device including a corona wire to which a transfer voltage is applied may be arranged as the transfer device inside of the intermediary image bearing member 15 or 15A so that the first image on the intermediary image bearing member 15 or 15A is transferred onto one side of a recording medium.

When the belt units 64 and 64A including the intermediary image bearing members 15 and 15A that are different in size are configured, as described above, to include transfer devices to transfer the first image on the intermediary image bearing members 15 and 15A onto one side of a recording medium, the belt units 64 and 64A can be configured such that the transfer devices are installed in substantially the same position in the main body housing 1, respectively. With these configurations, whichever of the belt units 64 and 64A is installed in the installing part IP of the main body housing 1, the first image can be transferred from the intermediary image bearing member 15 or 15A onto one side of a recording medium at the same position in the main body housing 1.

Other parts of the image forming apparatus illustrated in FIG. 15 and FIG. 16 are substantially the same as those of the previously described image forming apparatus.

Figure 17A:
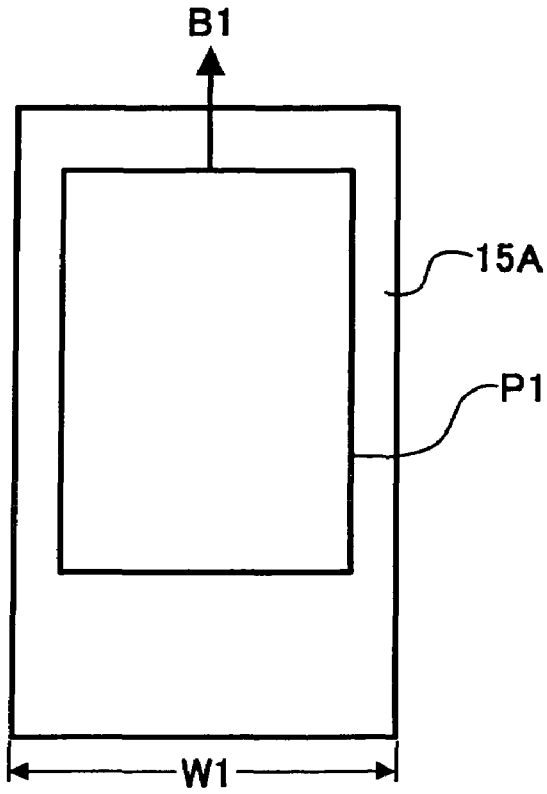
FIG. 17A is a diagram of the another intermediary image bearing member that is longer in circumferential length in a developed state, illustrating a size thereof and a size of a large recording medium.
Figure 17B:
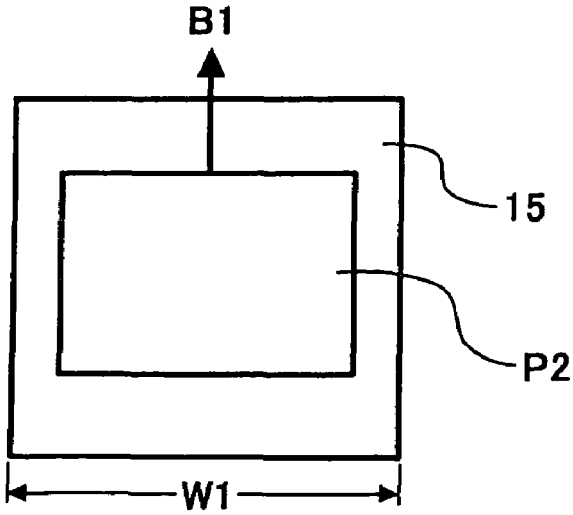
FIG. 17B is a diagram of the intermediary image bearing member that is shorter in circumferential length in a developed state, illustrating a size thereof and a size of a small recording medium.
Figure 18:
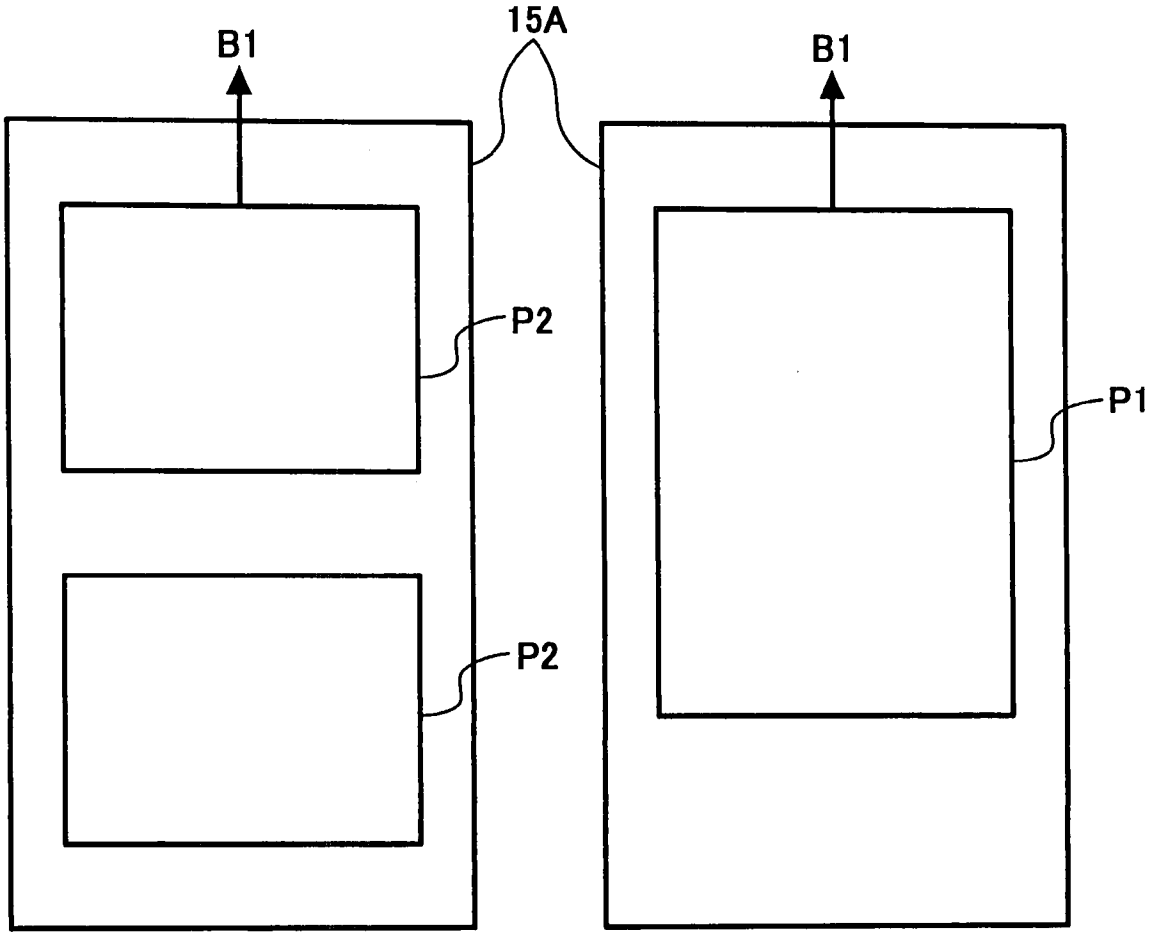
FIG. 18 is a diagram illustrating a case that images for two pages are formed on the intermediary image bearing member longer in circumferential length in a developed state.

The surface size of an intermediary image bearing member used in each image forming apparatus described above can be appropriately set, however, it is advantageous to set the surface size of the intermediary image bearing member as described below. FIG. 17A, FIG. 17B and FIG. 18 are diagrams illustrating the intermediary image bearing members 15 and 15A in developed states, and a recording medium P1 and a recording medium P2 being conveyed by the intermediary image bearing members 15 and 15A. In the diagrams, an arrow B1 indicates a direction in which each recording medium is conveyed. In the example illustrated in FIG. 17A, the intermediary image bearing member 15A is formed in such a size that the first image to be transferred onto the recording medium P1 of a standard size, being conveyed with a long side thereof corresponding to the conveying direction of B1, can be accommodated, and in the example illustrated in FIG. 17B, the intermediary image bearing member 15 is formed in such a size that the first image to be transferred onto the recording medium P2 half in size of the recording medium P1 of a standard size, being conveyed with a short side thereof corresponding to the conveying direction of B1, can be accommodated.

For example, when the size of the recording medium P1 is A3, the size of the recording medium P2 is A4, which is half of A3. Similarly, when the size of the recording medium P1 is A4, the size of the recording medium P2 is A5, and when the size of the recording medium P1 is B3, the size of the recording medium P2 is B4. When the size of the recording medium P1 is a double-letter size (11 inches×17 inches), which is a U.S. standard size, the size of the recording medium P2 is a letter size (8.5 inches×11 inches), half of the double-letter size.

More specifically, because the length of the short side of an A4-sized recording medium is 210 mm, the circumferential length of the intermediary image bearing member 15 that is small in circumferential length is set, for example, to about 310 mm so that the first image of A4 size can be easily accommodated. Similarly, because the length of the long side of an A3-sized recording medium is 420 m, the circumferential length of the intermediary image bearing member 15A that is large in size is set, for example, to about 500 mm so that the first image of A3 size can be accommodated.

By configuring the intermediary image bearing members 15 and 15A as described above, the widths W1 of the intermediary image bearing members 15 and 15A can be made the same. Thereby, components constituting the belt units 64 and 64A including the intermediary image bearing members 15 and 15A, e.g., supporting rollers, transfer rollers, opposing electrodes, etc., can be surely made common, so that the manufacturing costs of the belt unit 64 and 64A can be reduced.

Further, when the intermediary image bearing member 15A having a large size that can accommodate the first image to be transferred onto a recording medium of frequently used A3 size is used as illustrated in FIG. 17A, if a recording medium of also frequently used A4 size is conveyed with the short side thereof corresponding to the recording medium conveying direction B1 and an image is formed on each side of the recording medium of A4 size, then because the circumferential length of the intermediary image bearing member 15A is much longer than the short side of the recording medium of A4 size, a long time is required to complete formation of the image on each side of the recording medium of A4 size, so that useless time is generated and thereby the efficiency of image formation is decreased.

Accordingly, as illustrated in FIG. 18, it is preferable that at least one of the intermediary image bearing members 15 and 15A, in this example, the intermediary image bearing member 15A, is configured in such a size that an image to be transferred onto the recording medium P1 of a standard size, being conveyed with the long side thereof corresponding to the conveying direction of B1, can be accommodated and further at least two pages of the first image, to be transferred in succession, while the intermediary image bearing member 15A makes one revolution, onto two sheets of the recording medium P2 half in size of the recording medium P1 of a standard size, being conveyed with the short side thereof corresponding to the conveying direction of B1, can be accommodated. The two pages of the first image, transferred in succession onto the intermediary image bearing member 15A, are transferred onto one sides of the two sheets of the recording medium P2, conveyed in succession. In this case also, when the size of the recording medium P1 is A3, the size of the recording medium P2 is A4, when the size of the recording medium P1 is A4, the size of the recording medium P2 is A5, when the size of the recording medium P1 is B3, the size of the recording medium P2 is B4, and when the size of the recording medium P1 is a double-letter size, the size of the recording medium P2 is a letter-size.

More specifically, while the intermediary image bearing member 15A makes one revolution, two pages of the first image to be transferred onto two sheets of the recording medium P2 of A4 size are respectively transferred from the intermediary transfer member 3 onto the entire surface of the intermediary image bearing member 15A, the two sheets of the recording medium P2 are fed out from the sheet feeding device 23 in succession, and the two pages of the first image on the intermediary image baring member 15A are successively transferred onto respective one sides of the two sheets of the recording medium P2, one page of the first image on each sheet of the recording medium P2, and two pages of the second image on the intermediary transfer member 3 are respectively transferred onto the other sides of the two sheets of the recording medium P2. With this configuration, when compared with a case in which, when forming images on two sheets of the recording medium P2 of A4 size, first, the first image formed on the intermediary image bearing member 15A that is large in size is transferred onto one side of the first sheet of the recording medium P2 and the second image on the intermediary transfer member 3 is transferred onto the other side of the recording medium P2, thereafter, the next first image is transferred from the intermediary transfer member 3 onto the intermediary image bearing member 15A that is large in size, and the next first image is transferred onto one side of the second sheet of the recording medium P2, conveyed a predetermined time after the first sheet of the recording medium P, and the next second image on the intermediary transfer member 3 is transferred onto the other side of the second sheet of the recording medium P2, the time of image formation can be reduced and thereby the image forming efficiency can be greatly enhanced. In particular, when forming images successively on a great number of sheets of a recording medium, the image forming efficiency can be enhanced. The above-described advantage can be obtained in a similar manner when the recording medium is in other sizes.

In adopting the above-described configuration, when feeding two sheets of an A4-sized recording medium in succession from the sheet feeding device 23, a slight interval is provided between the two sheets of the A4-sized recording medium. Therefore, taking the above-described interval into consideration, the surface size of the intermediary image bearing member 15A must be made slightly larger than the size corresponding to two pages of the A4-sized recording medium. The length of the above-described interval is determined based upon a time in which a recording medium P fed from the sheet feeding device 23 is once stopped by the registration roller pair 26 and is conveyed again having a timing that the recording medium P is registered with an image to be transferred thereupon.

Further, as described earlier, a one-side printing mode for transferring a visible image transferred onto an intermediary transfer member from an image bearing member onto one side of a recording medium without using an intermediary image bearing member can be selected. In this mode, even when the circumferential length of an intermediary image bearing member is short, a color image longer than the circumferential length of the intermediary image bearing member can be formed on one side of a recording medium. Accordingly, when using the intermediary image bearing member 15 that is short in circumferential length, a color image large in size can be formed on a recording medium by using the above-described one-side printing mode.

Furthermore, when the image forming apparatus of the present invention is connected with a host computer as described later, by configuring the control unit E2 of the image forming apparatus such that an image forming operation is not performed when an instruction for forming an image on each side of a recording medium that is larger in size than the surface size of an intermediary image bearing member of the image forming apparatus is given by the host computer or by the operation panel OP provided to the main body housing 1 of the image forming apparatus, only those images that can be correctly accommodated in the recording medium can be formed at any time.

FIG. 10 also illustrates an example of an image forming system configured by connecting the image forming apparatuses 100, 100A and 100B of the present invention with a host computer HC via a network. The image forming apparatuses 100, 100A and 100B mainly perform a function of an outputting device (a printer) for the host computer HC. Each of the image forming apparatuses 100, 100A and 100B and the host computer HC may be connected with each other via wireless communication instead of a cable. Process conditions, etc. for forming an outputting image with one of the image forming apparatuses 100, 100A and 100B are inputted in accordance with guidance messages displayed in a display of the host computer HC. Statuses of the image forming apparatuses 100, 100A and 100B can be also displayed in the display of the host computer HC. Control instructions can be inputted through the operation panels OP of the image forming apparatuses 100, 100A and 100B or a keyboard of the host computer HC. For example, when performing both-side printing in which an image is formed on each side of a recording medium, an instruction for the both-side printing may be inputted by operating a both-side printing button provided on each operation panel OP or by operating the keyboard of the host computer HC. Further, when a plurality of the sheet feeding cassettes 24 accommodating various types of papers are provided in the image forming apparatus 100, 100A or 100B, selection of a special paper among the various types of paper accommodated in the sheet feeding cassettes 24 or selection of one of the sheet feeding cassettes 24 maybe also similarly performed by operating a sheet selecting button of the operation panel OP or by operating the keyboard of the host computer HC.

As described above, in the image forming system configured by connecting the image forming apparatus of the present invention with the host computer HC, information can be printed on a recording medium according to the object of printing and the kind of the recording medium. Further, image forming conditions in the image forming apparatus can be set at the image forming apparatus or from a location remote from the image forming apparatus by the host computer HC. Further, when the recognizing device for automatically recognizing which of the belt units 64, 64A and 64B is installed in the installing part IP of the main body housing 1 is provided, as described above, the recognition result can be provided to the host computer HC and the size of an intermediary image bearing member included in the installed one of the belt units 64, 64A and 64B can be recognized from the location of host computer HC that is remote from the image forming apparatus.

Figure 19:
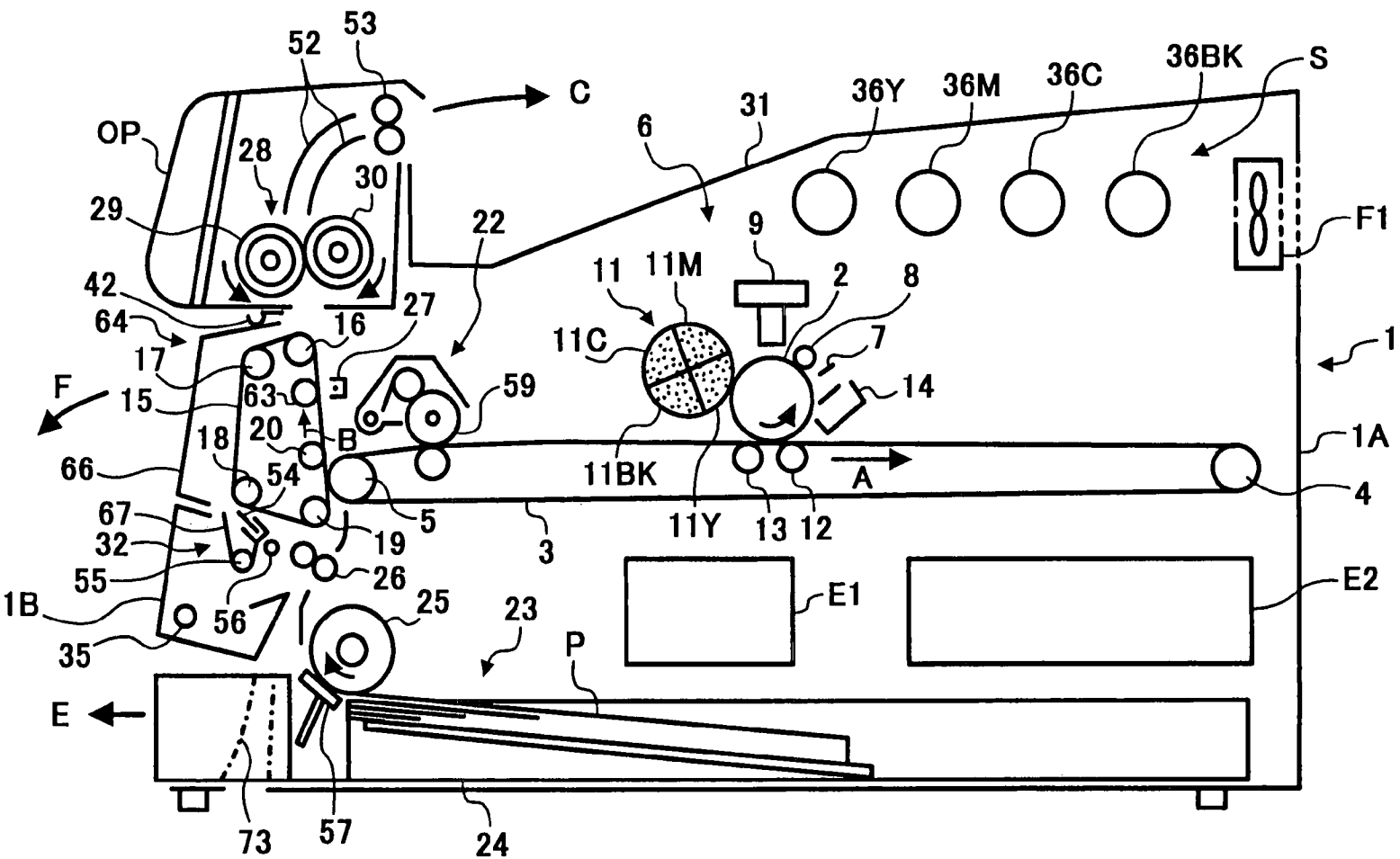
FIG. 19 is a vertical sectional view of the image forming apparatus including a single image bearing member, according to another embodiment of the present invention.

Each of the image forming apparatuses of FIG. 1 and FIG. 6 includes the plurality of image bearing members 2Y, 2M, 2C and 2BK. However, as illustrated in FIG. 19, the image forming apparatus may be configured to include a single image bearing member 2 contacting the intermediary transfer member 3. Visible toner images of different colors are sequentially formed on the image bearing member 2 by an image forming device 6, which are then transferred onto the intermediary transfer member 3 being superimposed one upon another. That is, after discharging a surface of the image bearing member 2 rotating in the arrow direction by the discharging device 7, the surface of the image bearing member 2 is charged by the charging device 8, the charged surface of the image bearing member 2 is selectively irradiated by a light emitted by the exposure device 9, and thereby an electrostatic latent image is formed on the image bearing member 2. The electrostatic latent image is made visible as a yellow toner image by a first developing device 11Y of the rotatably supported developing device 11. The yellow toner image is transferred by a function of the transfer roller 12 onto the intermediary transfer member 3 rotating in the direction indicated by the arrow A. A surface of the image bearing member 2 after transfer of the yellow toner image is cleaned by the cleaning device 14.

In substantially the same manner, a magenta toner image, a cyan toner image, and a black toner image are sequentially formed on the image bearing member 2 by a magenta developing device 11M, a cyan developing device 11C, and a black developing device 11BK of the developing device 11, and these visible toner images are sequentially transferred onto the intermediary transfer member 3 onto which the yellow toner image has been transferred, being superimposed one upon another and thereby forming the first image on the intermediary transfer member 3. Residual toner adhering to a surface of the intermediary transfer member 3 after transfer of the first image onto the intermediary image bearing member 15 is removed by the cleaning device 22. In the cleaning device 22 illustrated in FIG. 19, a brush roller 59 provided as a cleaning member of the cleaning device 22 is supported to contact and separate from the intermediary transfer member 3. When a visible image on the intermediary transfer member 3 passes the cleaning device 22, the brush roller 59 of the cleaning device 22 is separated from a surface of the intermediary transfer member 3. The brush roller 59 contacts a surface of the intermediary transfer member 3 only when removing residual toner on the intermediary transfer member 3.

The other parts of the configuration and operation of the image forming apparatus are substantially the same as those of the image forming apparatus of FIG. 1. The above-described first image is transferred onto the intermediary image bearing member 15, the first image is transferred onto one side of a recording medium P, the second image formed on the intermediary transfer member 3 by superimposed visible images is transferred onto the other side of the recording medium P, and the first and second images are fixed to the recording medium P by the fixing device 28. The intermediary image bearing member 15 is supported so as to contact and separate from the intermediary transfer member 3, and when the first image on the intermediary transfer member 3 passes the intermediary image bearing member 15, the intermediary image bearing member 15 separates from the intermediary transfer member 3, and when transferring the first image on the intermediary transfer member 3 onto the intermediary image bearing member 15 and when transferring the first image and the second image onto one and the other sides of the recording medium P, the intermediary image bearing member 15 contacts the intermediary transfer member 3 directly or via the recording medium P. In FIG. 19, each component of the image forming apparatus is denoted by the same reference signs used for a corresponding component of the image forming apparatus illustrated in FIG. 1, and further description of the apparatus is omitted.

Also, in the image forming apparatus of FIG. 19, the above-described configurations of the present invention can be adopted, so that the belt unit 64 including the intermediary image bearing member 15 can be exchanged with another belt unit including another intermediary image bearing member that is different in size from the intermediary image bearing member 15. Thereby, an image forming apparatus meeting specific a need of the user can be easily configured.

In each of the image forming apparatuses illustrated in FIG. 1 and FIG. 19, the image bearing members 2Y, 2M, 2C and 2BK and the image bearing member 2, and the image forming devices 6Y, 6M, 6C and 6BK and the image forming device 6 are arranged above the intermediary transfer member 3, respectively, however, these components can be arranged below the intermediary transfer member 3, as in an image forming apparatus described below with reference to FIG. 20. When the image bearing members 2Y, 2M, 2C and 2BK and the image bearing member 2, and the image forming devices 6Y, 6M, 6C and 6BK and the image forming device 6 are arranged below the intermediary transfer member 3, respectively, the time for an image on the intermediary transfer member 3 to reach a transfer position where the image is transferred onto the intermediary image bearing member 15 or onto a recording medium can be decreased, so that image forming efficiency can be enhanced.

Figure 20:
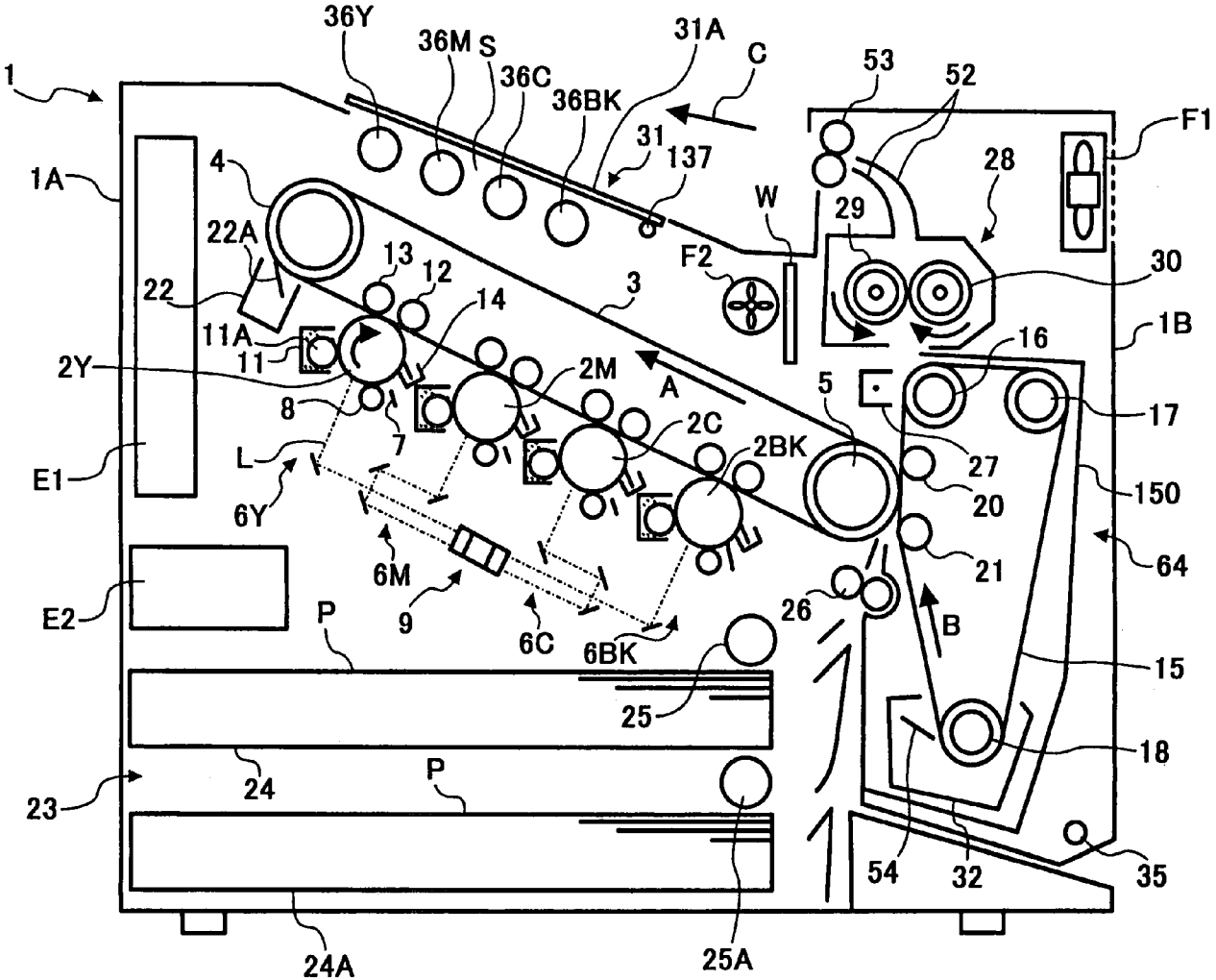
FIG. 20 is a vertical sectional view of the image forming apparatus according to still another embodiment of the present invention.
Figure 22:
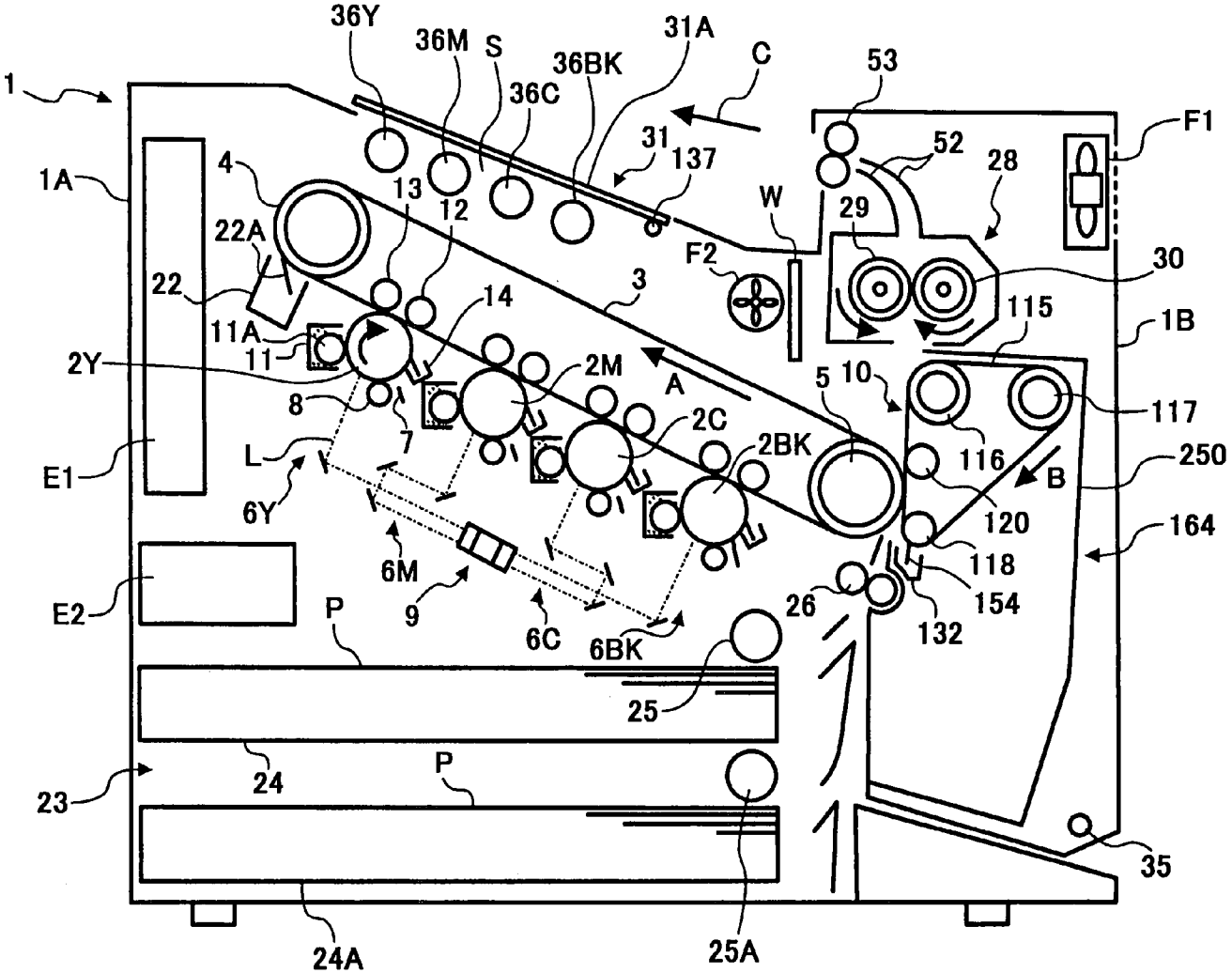
FIG. 22 is a vertical sectional view of the image forming apparatus according to still another embodiment of the present invention.

FIG. 20 is a vertical cross section illustrating such an image forming apparatus configured as a printer, and FIG. 22 is a vertical cross section of still another image forming apparatus configured as a printer that is configured differently from the one of FIG. 20.

The image forming apparatus illustrated in FIG. 1 and FIG. 6 and the image forming apparatus illustrated in FIG. 20 are similar to each other in basic structure. Accordingly, only those portions of the image forming apparatus of FIG. 20, different from corresponding portions of the image forming apparatus of FIG. 1 and FIG. 6, will be described. Respective components of the image forming apparatus of FIG. 20 are denoted by same reference signs as those used for corresponding components of the image forming apparatus illustrated in FIG. 1 and FIG. 6.

In the image forming apparatus illustrated in FIG. 20, at least one image bearing member driven to rotate in the clockwise direction, in the illustrated example, the first through fourth image bearing members 2Y, 2M, 2C and 2BK are arranged inside of the main body housing 1, as in the image forming apparatus of FIG. 1, and visible toner images of different colors, i.e., yellow, magenta, cyan and black colors, are formed by the image forming devices 6Y, 6M, 6C and 6BK on the image bearing members 2Y, 2M, 2C and 2BK, which are then transferred onto the intermediary transfer member 3 formed as an endless belt spanned around the supporting rollers 4 and 5 and rotated in the direction of the arrow A, so as to be superimposed one upon another, thereby forming the first image thereupon. Thus, the image forming apparatus in this example also includes at least one image bearing member on which a visible image is formed, a developing device to form the visible image on the at least one image bearing member, and an intermediary transfer member onto which visible images of different colors formed on the at least one image bearing member are transferred being superimposed one upon another, and the configurations of the image bearing member and the intermediary transfer member, such as material thereof, are substantially the same as those of the image forming apparatus described above. A laser writing device emitting a laser light L is used for the exposure device 9 illustrated in FIG. 20, however, an exposure device including an LED array may be used as in the image forming apparatus illustrated in FIG. 1 and FIG. 6.

The intermediary image bearing member 15 formed as an endless belt is arranged at the right side of the intermediary transfer member 3 in FIG. 20, and the intermediary image bearing member 15 is spanned around the supporting rollers 16, 17 and 18 and is driven to rotate in the direction of the arrow B in synchronism with the intermediary transfer member 3. Material and characteristics of the intermediary image bearing member 15 are substantially the same as those of the intermediary image bearing member 15 illustrated in FIG. 1 and FIG. 6. The transfer roller 20 acting as a transfer device and the backing roller 21 are arranged in the positions opposing the supporting roller 5 for the intermediary transfer member 3 inside of the intermediary image bearing member 15 to contact a rear side of the intermediary image bearing member 15. Thereby, the intermediary transfer member 3 and the intermediary image bearing member 15 contact each other with an appropriate nip formed between them.

A transfer voltage is applied to the transfer roller 20, so that the first image on the intermediary transfer member 3 is transferred onto the intermediary image bearing member 15, and residual toner adhering on a surface of the intermediary transfer member 3 after transfer of the first image is removed by a cleaning member 22A of the cleaning device 22.

Subsequently, toner images of different colors formed on the image bearing members 2Y, 2M, 2C and 2BK are transferred onto the intermediary transfer member 3, being superimposed one upon another, so that the second image is formed on the intermediary transfer member 3.

The sheet feeding device 23 illustrated in FIG. 20 includes two sheet feeding cassettes 24 and 24A, each stacking and accommodating therein a recording medium P, e.g., a transfer sheet, a resin sheet, etc., and two feeding roller 25 and 25A to feed out the recording medium P from the sheet feeding cassettes 24 and 24A. Either of the two feeding rollers 25 and 25A rotates while contacting a surface of a top recording medium P, thereby the top recording medium P being fed out to the registration roller pair 26. The registration roller pair 26 feeds out the recording medium P upward with a predetermined timing, and by a function of the corona discharging device 27 serving as a transfer device arranged opposing the intermediary image bearing member 15, the first image on the intermediary image bearing member 15 is transferred onto one side of the recording medium P, and by a function of the transfer roller 20, the second image on the intermediary transfer member 3 is transferred onto the other side of the recording medium P. A surface of the intermediary transfer member 3, after transferring the second image, is cleaned by the cleaning device 22. Residual toner adhering to a surface of the intermediary image bearing member 15 is removed by the cleaning blade 54 of the cleaning device 32. The cleaning blade 54 also separates from a surface of the intermediary image bearing member 15 when the first image on the intermediary image bearing member 15 passes the cleaning blade 54.

The recording medium P on which the first and the second images have been transferred passes the fixing device 28, and at that time, both of the first and second images are fixed onto respective surfaces of the recording medium P. The recording medium P is then fed by the sheet feeding roller pair 53 onto the sheet expelling part 31 as indicated by the arrow C.

The image forming apparatus illustrated in FIG. 20 also includes the toner containers 36Y, 36M, 36C and 36BK containing yellow toner, magenta toner, cyan toner and black toner for replenishment, respectively. These containers are provided in the toner container accommodating space S above the intermediary transfer member 3. A cover 31A constituting a part of the sheet expelling part 31 is opened upward in figure (as in an image forming apparatus illustrated at a lower part of FIG. 24), so that each of the toner containers 36Y, 36M, 36C and 36BK can be replaced with a new one. The cover 31A is supported at one end side thereof by a rotating fulcrum 137 so as to open around the fulcrum 137. Because this rotating fulcrum 137 is located at the side of the sheet feeding roller pair 53, even if the cover 31A is opened when a recording medium P on which an image has been recorded exists on the sheet expelling part 31, such a trouble that the recording medium P falls down or the page sequence thereof goes out of order will never occur. In FIG. 20, numeral 34 denotes a knob of the cover 31A, and the cover 31A can be opened by grabbing the knob 34 by hand. The knob 34 is arranged in such a position that the knob 34 will not hinder conveyance and stacking of a recording medium P being fed onto the sheet expelling part 31.

Figure 24:
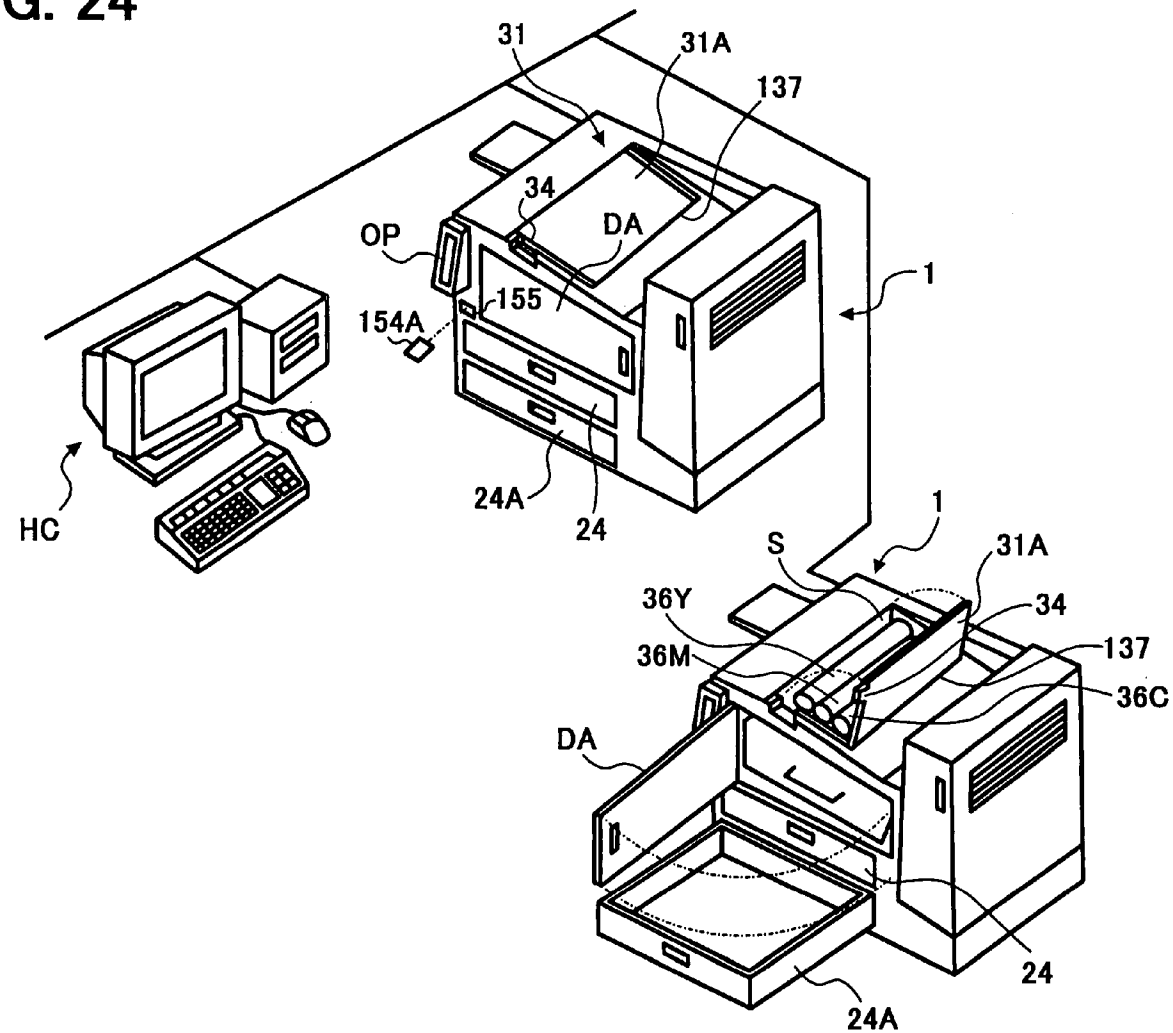
FIG. 24 is a perspective view of an image forming system including the image forming apparatuses illustrated in FIG. 20 and FIG. 22.

The image forming apparatus illustrated at a lower part of FIG. 24 is in a condition where a front door DA of the main body housing 1 is opened so that maintenance work for the inside part of the image forming apparatus can be performed, and further the sheet feeding cassette 24A at the lower side is drawn out so that a recording medium P can be replenished or replaced with another one. By opening the front cover DA, image bearing members, an intermediary transfer member, and other components around them can be drawn out forward while being guided by a guide rail (not shown), with an exposure device being left inside the main body housing 1, so that the image bearing members and the intermediary transfer member can be removed from the main body housing 1 in this condition. The front door DA is supported by a part of the main body housing 1 via a hinge arranged in a vertical direction, so that even when the front door DA is opened, visibility of other parts of the image forming apparatus below the front door DA is never blocked.

Further, as illustrated in FIG. 20, a heat insulating member W is inserted between the toner container accommodating space Sand the fixing device 28. Thereby, the toner for replenishment can be prevented from being melted and fixed as a result of repetition of heating and cooling. Resin, hair transplanted resin, or a member in which a plurality of layers of resin or hair transplanted resin are formed such that an air layer is formed therein may be used for the heat insulating member W. Provision of an air circulating path for circulating air to pass a fan F2 can also be effective for preventing the replenishing toner from being melted and fixed.

The above-described configurations can be adopted in the image forming apparatus illustrated in FIG. 1 and FIG. 6.

In the image forming apparatus illustrated in FIG. 20, at least the intermediary image bearing member 15 and the supporting rollers 15, 16 and 17 around which the intermediary image bearing member 15 is spanned around are integrated with each other to be formed as the belt unit 64. In the example illustrated in FIG. 20, the transfer roller 20 and the corona discharging device 27 serving as the transfer devices, the backing roller 21, and the cleaning device 32 also constitute components of the belt unit 64, and these components 15, 16, 17, 18, 20, 21 and 27 are integrally attached to a case 150 to be configured as the belt unit 64.

In contrast, in the image forming apparatus illustrated in FIG. 22, instead of the belt unit 64 illustrated in FIG. 20, a transfer device 10 is provided. The transfer device 10 may be configured only by a transfer roller or a transfer brush to which a transfer voltage is applied or a corona discharging device. However, the transfer device 10 illustrated in FIG. 22 includes a plurality of supporting rollers 116, 117 and 118, an endless transfer belt 115 which is spanned around the supporting rollers 116, 117 and 118 to be driven to rotate in the direction of the arrow B, a transfer roller 120 functioning as a transfer device to transfer a visible image on the intermediary transfer member 3 onto a recording medium, and a cleaning device 132 cleaning a surface of the transfer belt 115. In this case also, the supporting rollers 116, 117 and 118, and the endless transfer belt 115 spanned around the supporting rollers 116, 117 and 118 to be driven to rotate can be integrated with each other to be formed as a transfer unit 164. In the example illustrated in FIG. 22, the supporting rollers 116, 117 and 118, the transfer belt 115, the transfer roller 120, and the cleaning device 132 are integrally attached to a case 250 to be configured as the transfer unit 164. In the image forming apparatus illustrated in FIG. 22, the corona discharging device 27 illustrated in FIG. 20 is not provided.

The transfer roller 120 contacts a backside of the transfer belt 115 and is positioned to substantially oppose the supporting roller 5 around which the intermediary transfer member 3 is spanned. In this example, the transfer roller 120 is used as a transfer device, however, any other appropriate transfer devices, such as a corona discharging device, etc. can be also used. However, by using the transfer roller 120, because the transfer belt 115 can be pressed against a part of the intermediary transfer member 3 spanned around the supporting roller 5, transfer efficiency can be enhanced. Further, the cleaning device 132 includes a cleaning blade 154 as an example of a cleaning member, and the cleaning blade 154 is pressed to contact a surface of the transfer belt 115 to clean the surface of the transfer belt 115. The other portions of the image forming apparatus illustrated in FIG. 22 are substantially the same as those of the image forming apparatus illustrated in FIG. 20, and therefore, respective components of the image forming apparatus illustrated in FIG. 22 are denoted by the same references signs as those used for corresponding components illustrated in FIG. 20, and description thereof is omitted.

Also, in the image forming apparatus illustrated in FIG. 22, substantially in the same manner as in the image forming apparatus of FIG. 20, visible toner images of different colors, i.e., yellow, magenta, cyan and black colors, are formed by the image forming devices 6Y, 6M, 6C and 6BK on the image bearing members 2Y, 2M, 2C and 2BK, which are then transferred onto the intermediary transfer member 3 formed as an endless belt spanned around the supporting rollers 4 and 5 and rotated in the direction of the arrow A, so as to be superimposed one upon another, thereby forming the first image thereupon. The surfaces of the image bearing members 2Y, 2M, 2C and 2BK after transfer of the toner images are cleaned by the cleaning devices 14. Thus, a superimposed visible image is formed on the intermediary transfer member 3.

A recording medium P fed out from the sheet feeding device 23 and conveyed by the registration roller pair 26 in a predetermined timing passes a nip part, where the intermediary transfer member 3 and the transfer belt 115, rotating in synchronism with each other in the directions of arrows, respectively, contact each other, to be further conveyed upward. At this time, a transfer voltage having a polarity opposite to that of the toner of the superimposed visible image on the intermediary transfer member 3 (in the illustrated example, a plus polarity) is applied to the transfer roller 120, and thereby the superimposed visible image on the intermediary transfer member 3 is transferred onto one side of the recording medium being conveyed. Toner adhering to a surface of the transfer belt 115 is removed by the cleaning blade 154 of the cleaning device 132, so that the surface of the transfer belt 115 is cleaned. Thus, the transfer device 10 in this example is configured to cause a recording medium P to pass the nip part of the transfer belt 115 and the intermediary transfer member 3 so that a visible image on the intermediary transfer member 3 is transferred onto one side of the recording medium P.

The transfer belt 115 is configured as a belt having conductivity enabling transfer of a visible toner image from the intermediary transfer member 3 onto a recording medium P. By using the transfer belt 115, a relatively large nip part can be formed between the transfer belt 115 and the intermediary transfer member 3, so that the visible image is efficiently transferred from the intermediary transfer member 3 onto the recording medium P at the nip part, and further the recording medium P is securely conveyed upward continuously thereafter.

The recording medium P onto which the visible image has been transferred is conveyed upward while being in close contact with the transfer belt 115, and after having been separated from the transfer belt 115, the recording medium P passes the fixing device 28, where the visible image transferred onto the one side of the recording medium P is fixed thereon. The recording medium P passing the fixing device 28 is fed by the sheet feeding roller pair 53 onto the sheet expelling part 31 as indicated by the arrow C. At this time, the recording medium P is fed onto the sheet expelling part 31 with the side thereof carrying the fixed visible image face down. Residual toner adhering to a surface of the intermediary transfer member 3 after transferring the visible image onto the recording medium P is removed by the cleaning member 22A of the cleaning device 22, so that the surface of the intermediary transfer member 3 is cleaned.

The intermediary image bearing member 15 illustrated in FIG. 20 must have a circumferential length for one page of the first image. In contrast, the transfer belt 115 illustrated in FIG. 22 does not bear an image thereupon and therefore does not need to have a circumferential length for one page of the first image. Thus, the transfer belt 115 and the intermediary image bearing member 15 differ from each other in configuration because of the difference in function.

According to the image forming apparatus of FIG. 20, a color image can be formed on each side of a recording medium. On the other hand, the image forming apparatus of FIG. 22 can form a color image only on one side of a recording medium. However, the image forming apparatus of FIG. 20 is more complicated in configuration and thereby is more expensive than the image forming apparatus of FIG. 22. Thus, the image forming apparatuses of FIG. 20 and FIG. 22 have merits and demerits respectively, and a user obtains either of the image forming apparatuses meeting its needs taking into consideration such merits and demerits. In this case, however, when a user who has obtained the image forming apparatus of FIG. 22 must later also obtain the image forming apparatus of FIG. 20, the financial burden on such a user is increased.

Accordingly, each of the image forming apparatuses of FIG. 20 and FIG. 22 includes the above-described installing mechanism configured, in this case, to install either of the transfer device 10 illustrated in FIG. 20 and the intermediary image bearing member 15 illustrated in FIG. 22 in the installing part IP of the main body housing 1 in a detachable manner. Thereby, the transfer device 10 and the intermediary image bearing member 15 can be freely exchanged with each other in the image forming apparatuses of FIG. 20*a* and FIG. 22. In the description below, the belt unit 64 including the intermediary image bearing member 15 is called the first belt unit and the transfer unit 164 including the transfer belt 115 is called the second belt unit as necessary.

Figure 21:
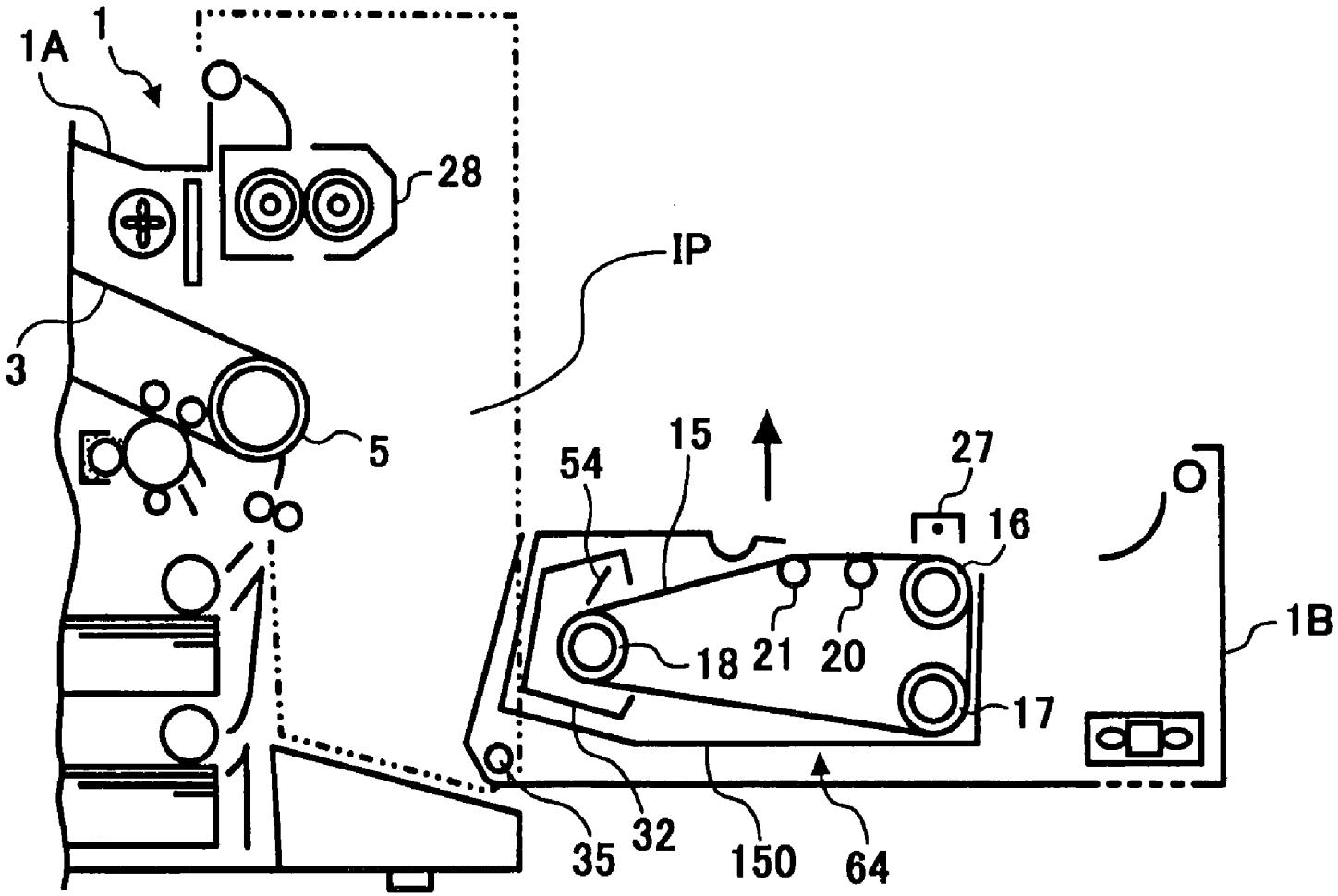
FIG. 21 is a vertical sectional view of the image forming apparatus illustrated in FIG. 20, in which the movable housing is opened.
Figure 23:
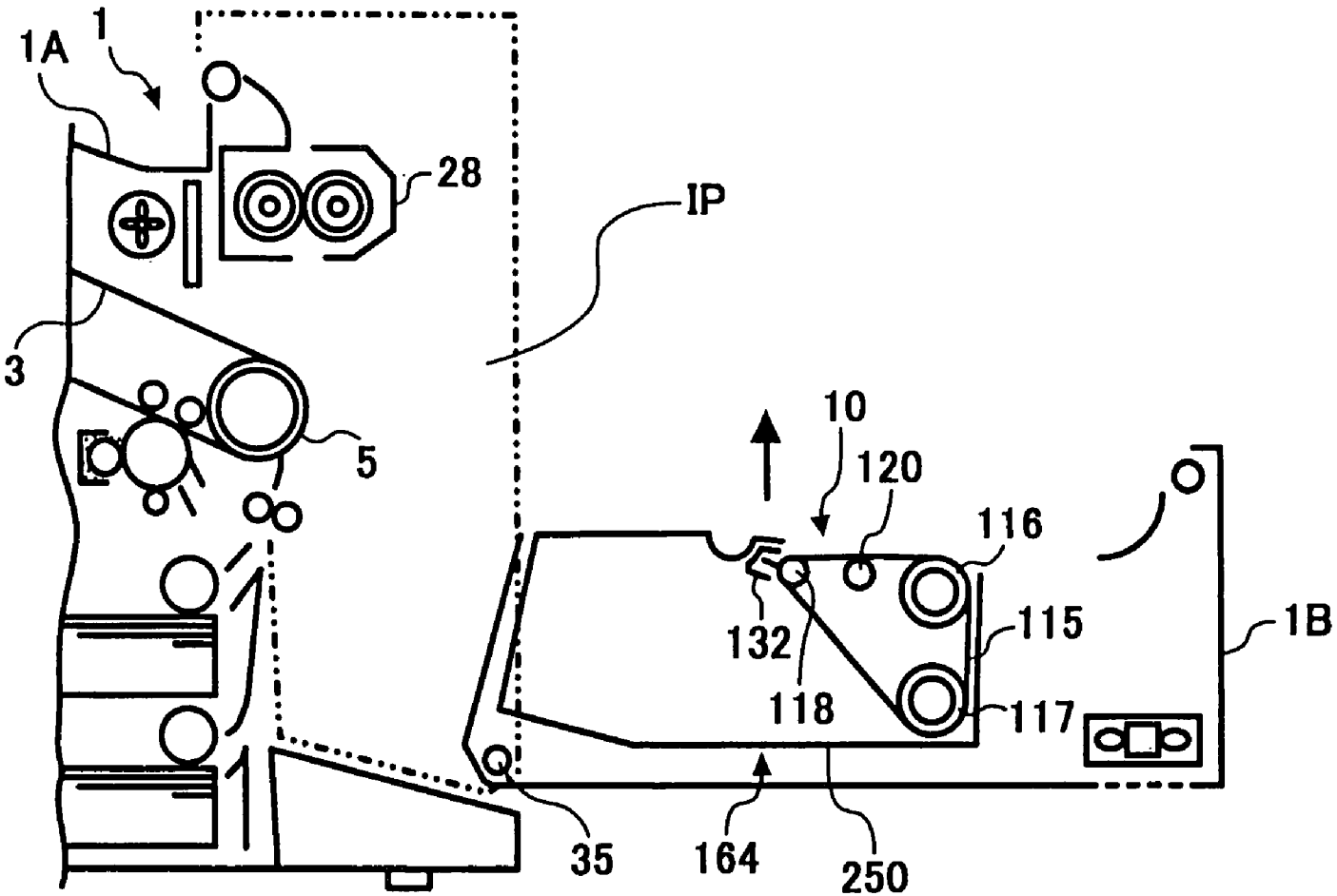
FIG. 23 is a vertical sectional view of the image forming apparatus illustrated in FIG. 22, in which the movable housing is opened.

In each of the image forming apparatuses illustrated in FIG. 20 and FIG. 22, as in the image forming apparatus illustrated in FIG. 1 and FIG. 6, the main body housing 1 includes the fixed housing 1A and the movable housing 1B supported by the fixed housing 1A to open and close relative to the fixed housing 1A, and further, the receiving and guiding mechanism is provided to the movable housing 1B, so that when the movable housing 1B is in the opened position, the transfer device 10 or the intermediary image bearing member 15 can be received by and taken out from the movable housing 1B. More specifically, the movable housing 1B is supported via the supporting axis 35 by the fixed housing 1A so as to rotate to open and close, and the first belt unit 64 illustrated in FIG. 20 and the second belt unit 164 illustrated in FIG. 22 are received by the movable housing 1B in a freely detachable manner, respectively. FIG. 21 and FIG. 23 illustrate states that the movable housing 1B illustrated in FIG. 20 and the movable housing 1B illustrated in FIG. 22 are rotated to the opened positions, respectively. At this time, because the space above the movable housing 1B is opened, the first and second belt units 64 and 164 can be lifted upward to be taken out from the movable cover 1B, respectively.

Because the receiving and guiding mechanism provided to the movable housing 1B is configured such that either of the first belt unit 64 including the intermediary image bearing member 15 and the second belt unit 164 including the transfer belt 115 can be received, when a user using the image forming apparatus of FIG. 22 must obtain an image forming apparatus that can form a color image on each side of a recording medium, the user can obtain the image forming apparatus that can form a color image on each side of a recording medium by obtaining the first belt unit 64 including the intermediary image bearing member 15. That is, the user opens the removable housing 1B, thereby removing the second belt unit 164 including the intermediary image bearing member 115 from the installing part IP of the main body housing 1, as illustrated in FIG. 23, and takes out the second belt unit 164 including the transfer belt 115. The user then causes the newly obtained first belt unit 64 including the intermediary image bearing member 15 to be received by the movable housing 1B, and closes the movable housing 1B, and thereby the first belt unit 64 including the intermediary image bearing member 15 is installed in the installing IP of the main body housing 1 of the image forming apparatus illustrated in FIG. 22, so that the image forming apparatus configured as illustrated in FIG. 20 is realized. The first belt unit 64 including the intermediary image bearing member 15 may be sometimes exchanged to obtain the second belt unit 164 including the transfer belt 115 kept, or sold separately, as the case may be. Thus, by exchanging a part of an image forming apparatus with another part, the image forming apparatus can be freely configured to form an image on only on one side of a recording medium or to form an image one each side of a recording medium.

Further, when manufacturing image forming apparatuses, by installing either the first belt unit 64 and the second belt unit 164 in the main body housing 1 of each image forming apparatus, image forming apparatuses having different functions can be manufactured. Thereby, meeting the diverse needs of users can be easily realized.

Futhermore, by opening the movable housing 1B, a recording medium conveying path is opened to a large extent, so that a recording medium jammed in the conveying path can easily be cleared. Thus, the movable housing 1B can be opened for other purposes than exchanging of the first belt unit 64 and the second belt unit 164 with each other, thereby facilitating performance of necessary works such as paper jam removal.

The image forming apparatuses of FIG. 20 and FIG. 22 differ from each other as described above in the operations of forming visible images, the timings of conveying a recording medium P from the sheet feeding device 23, the operations of the cleaning devices 23 and 132, etc. Further, the fixing temperature when the fixing device 28 illustrated in FIG. 22 fixes a visible image onto a recording medium P is different from that when the fixing device 28 of FIG. 20 fixes a visible image onto a recording medium P. The fixing temperature is set to 170° C. by the former fixing device 28 and to 180° C. by the latter fixing device 28. In the image forming apparatus of FIG. 20, because visible images on both sides of the recording medium P are fixed onto respective sides of the recording medium P, the fixing temperature is set relatively high so that inferior fixing is avoided, and in the image forming apparatus of FIG. 22, because a visible image on one side of the recording medium P is fixed onto the recording medium P, the fixing temperature is set relatively low. That is, the fixing temperature of the fixing device 28 for fixing a visible image onto a recording medium P is set higher when the intermediary image bearing member 15 is installed than when the transfer device 10 is installed in the main body housing 1. When forming a color image on one side of a recording medium P with the image forming apparatus of FIG. 20, the fixing temperature may be set to the same as that of the image forming apparatus of FIG. 22.

As described above, because the operations of the image forming apparatuses of FIG. 20 and FIG. 22 differ from each other, each of the image forming apparatuses must be controlled, when the transfer device 10 (the second belt unit 164) and the intermediary image bearing member 15 (the first belt unit 64) are exchanged with each other, to operate in a manner corresponding to the first belt unit 64 or the second belt unit 164, installed in the installing part IP of the main body housing 1.

Accordingly, a recognition device such as a photo-sensor and a micro-switch (not shown) for recognizing if the transfer device 10 is installed or if the intermediary image bearing member 15 is installed in the installing part IP of the main body housing 1 is provided in the main body housing 1, so that according to a result of recognition with the recognition device, control when the transfer device 10 is installed or control when the intermediary image bearing member 15 is installed in the main body housing 1 is performed. Alternatively, as illustrated in FIG. 24, an insertion inlet 155 for inserting an IC card 154A as an example of a storage medium may be provided to the main body housing 1. When the intermediary image bearing member 15 is installed in the main body housing 1 in place of the transfer device 10, by inserting the IC card 154A into the insertion inlet 155, the control when the intermediary image bearing member 15 is installed in the main body housing 1 is performed. Thus, by adopting either of the above-described configurations in an image forming apparatus, the image forming apparatus can be controlled to operate in a corresponding manner after the transfer device 10 or the intermediary image bearing member 115 has been exchanged with the intermediary image bearing member 15 or the transfer device 10.

Further, the operation panel OP (FIG. 24) provided to an outer surface of the main body housing 1 may display information informing the user that the intermediary image bearing member 15 is installed in place of the transfer device 10 in the main body housing 1. Thereby, a user can be informed that an image can be formed on each side of a recording medium, so that the user will be never confused.

FIG. 24 also illustrates an image forming system configured by connecting the image forming apparatus of the present invention illustrated in FIG. 20 and FIG. 22 with the host computer HC via a network as in the image forming system described above referring to FIG. 10. In this case, when the intermediary image bearing member 15 is installed in place of the transfer device 10 in the main body housing 1 of the image forming apparatus, the information informing that the intermediary image bearing member 15 is installed in place of the transfer device 10 in the image forming apparatus can be displayed on the operation panel OP of the image forming apparatus and/or the display of the host computer HC.

Figure 25:
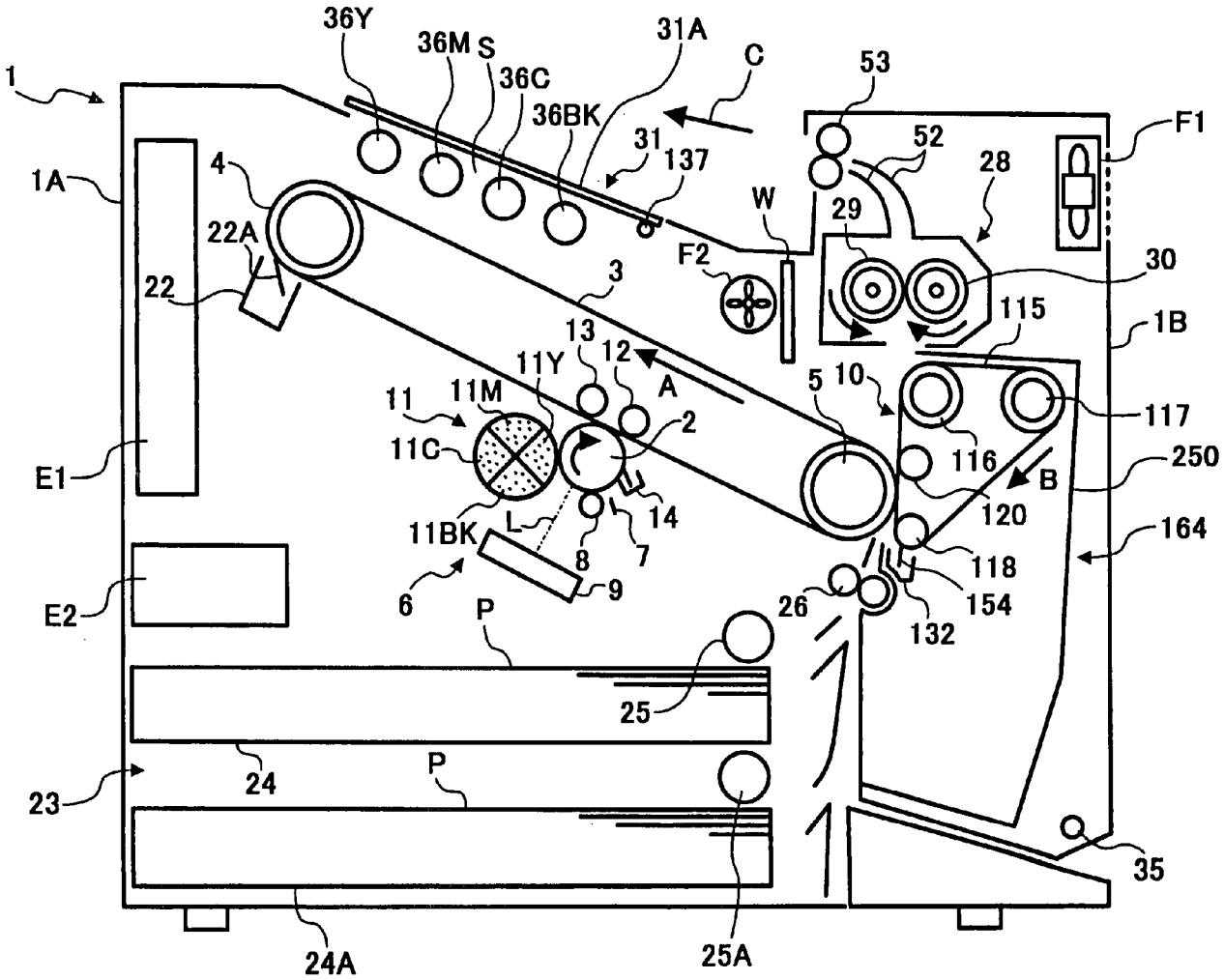
FIG. 25 is a vertical sectional view of the image forming apparatus according to still another embodiment of the present invention.
Figure 26:
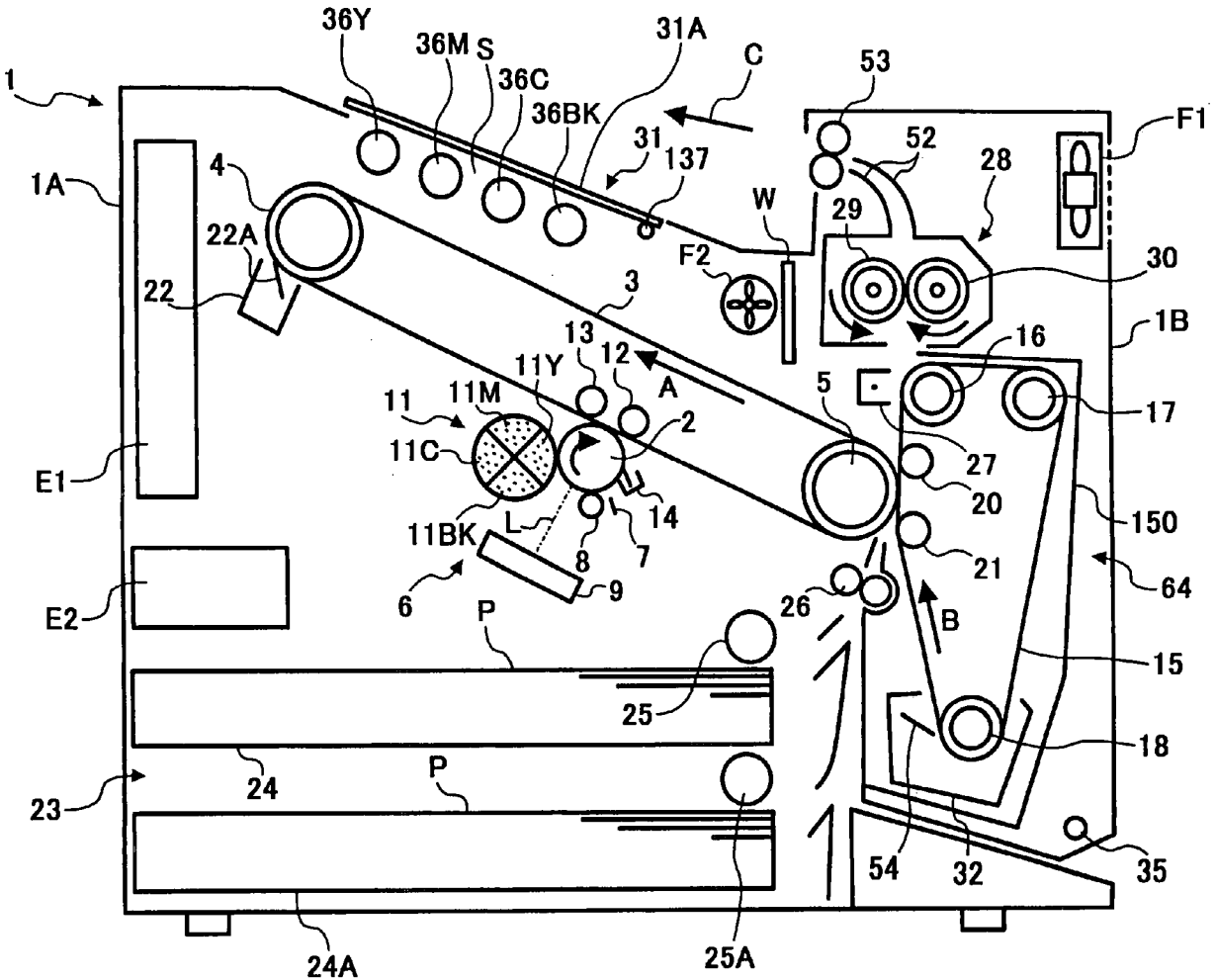
FIG. 26 is a vertical sectional view of the image forming apparatus different in configuration from the image forming apparatus illustrated in FIG. 25.

The image forming apparatuses illustrated in FIG. 20 and FIG. 22 include the plurality of image bearing members 2Y, 2M, 2C and 2BK, respectively. However, as illustrated in FIG. 25 and FIG. 26, the image forming apparatuses may be configured to include the single image bearing member 2 contacting the intermediary transfer member 3 as in the image forming apparatus described with reference to FIG. 19. Visible toner images of different colors are sequentially formed on the single image bearing member 2 by the image forming device 6, which are then transferred onto the intermediary transfer member 3 superimposing one upon another, as described above with reference to FIG. 19.

Figure 27:
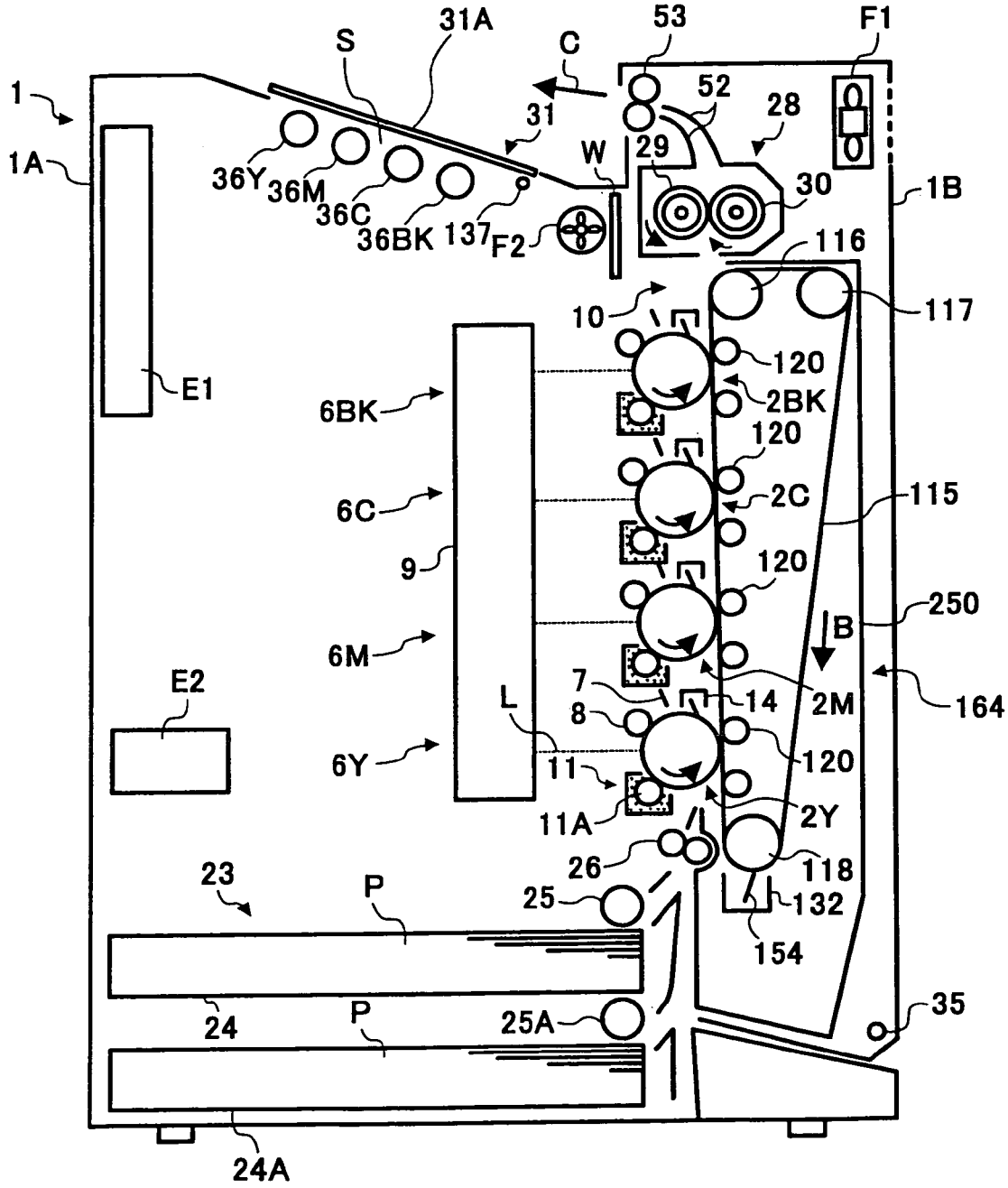
FIG. 27 is a vertical sectional view of the image forming apparatus according to still another embodiment of the present invention.

The image forming apparatus of FIG. 25 includes the transfer device 10 as in the image forming apparatus of FIG. 22, and the image forming apparatus of FIG. 27 includes the intermediary image bearing member 15 as in the image forming apparatus of FIG. 20. The transfer device 10 and the intermediary image bearing member 15 of the image forming apparatuses illustrated in FIG. 25 and FIG. 26 are supported so as to freely contact and separate from the intermediary transfer member 3, respectively. The transfer belt 115 of the transfer device 10 and the intermediary image bearing member 15 are separated from the intermediary transfer member 3 except when transferring a visible image onto a recording medium P or the intermediary image bearing member 15 as described below.

In the image forming apparatus of FIG. 25, a superimposed visible image on the intermediary transfer member 3 is transferred by a function of the transfer roller 120 only onto one side of a recording medium P conveyed from the sheet feeding device 23. On the other hand, in the image forming apparatus of FIG. 26, the first image formed on the intermediary tranfer member 3 by superimposed visible images is once transferred onto the intermediary image bearing member 15 rotating in the directon indicated by the arrow B by a function of the transfer roller 20. The first image is transferred by a function of the corona discharging device 27 onto the side of the recording medium P, and subsequently the second image formed by superimposed visible images on the intermediary transfer member 3 is transferred by a function of the transfer roller 20 onto the other side of the recording medium P. Both images on the recording medium P are fixed by the fixing device 28, and the recording medium P after fixing the images thereon is fed onto the sheet expelling part 31. Residual toner adhering to a surface of the intermediary transfer member 3 after transfer of the first image is removed by the cleaning device 22. A cleaning member 22A of the cleaning device 22 illustrated in FIG. 25 and FIG. 26 is supported to contact and separate from the intermediary transfer member 3. When a visible image on the intermediary transfer member 22 is separated from a surface of the intermediary transfer member 3. The cleaning member 22A contacts a surface of the intermediary transfer member 3 only when removing residual toner on the intermediary transfer member 3.

In the image forming apparatuses of FIG. 25 and FIG. 26 also, the second belt unit 164 including the transfer device 10 and the first belt unit 64 including the intermediary image bearing member 15 can be exchanged with each other. Thereby, an image forming apparatus meeting the needs of the user can be configured. Further, by connecting a host computer with each of the image forming apparatuses of FIG. 25 and FIG. 26, an image forming system similar to the one described above can be realized.

The other parts of the configuration and operation of the image forming apparatuses of FIG. 25 and FIG. 26 are substantially the same as those of the image forming apparatuses of FIG. 20 and FIG. 22, and respective components of the image forming apparatuses of FIG. 25 and FIG. 26 are denoted by same reference signs used for corresponding components in FIG. 20 and FIG. 22. Therefore, further description is omitted.

As described above, each of the image forming apparatuses illustrated in FIG. 20 through FIG. 26 includes at least one of the image bearing member 2Y, 2M, 2C and 2BK or the single image bearing member 2, on which visible images are formed, the image forming devices 6Y, 6M, 6C and 6BK or the image forming device 6 configured to form visible images on the at least one of the image bearing members 2Y, 2M, 2C and 2BK or the single image bearing member 2, and the intermediary transfer member 3 onto which visible images of different colors formed on the at least one of the image bearing members 2Y, 2M, 2C and 2BK or the single image bearing member 2 are transferred superimposing one upon another, forming the first image thereupon. Further, the image forming apparatus includes the installing part IP provided in the main body housing 1 and configured such that either of the transfer device 10 configured to transfer, when installed in the installing part IP of the main body housing 1, a superimposed visible image on the intermediary transfer member 3 onto a recording medium P and the intermediary image bearing member 15 configured such that, when installed in the installing part IP, the first image formed on the intermediary transfer member 3 is transferred thereupon, can be installed therein in a detachable manner. When the intermediary image bearing member 15 is installed in the installing part IP of the main body housing 1, the image forming apparatus is configured such that the first image on the intermediary image bearing member 15 is transferred onto one side of the recording medium P and a second image formed on the intermediary transfer member 3 by superimposed visible images subsequently transferred from the at least one of the image bearing members 2Y, 2M, 2C and 2BK or the single image bearing member 2 is transferred onto the other side of the recording medium P. Thus, the image forming apparatus can be easily configured to be another image forming apparatus meeting a need of the user.

Figure 28:
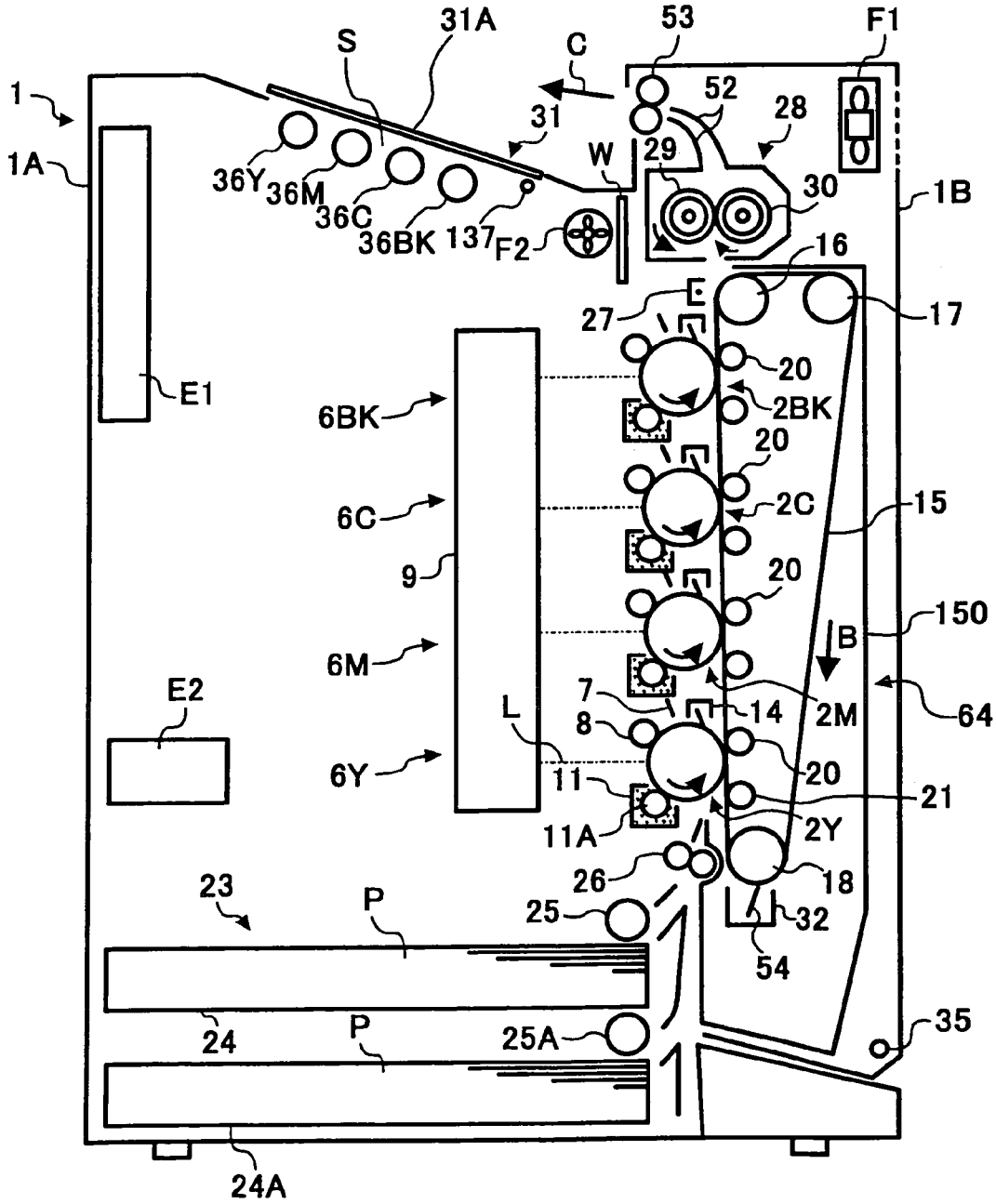
FIG. 28 is a vertical sectional view of the image forming apparatus different in configuration from the image forming apparatus illustrated in FIG. 27.

Further, as illustrated in FIG. 27 and FIG. 28, the image forming apparatuses of the present invention can be configured omitting an intermediary transfer member. In an image forming apparatus illustrated in FIG. 27, the transfer belt 115 of the transfer device 10 is arranged to oppose the plurality of image bearing members 2Y, 2M, 2C and 2BK, and the transfer belt 115 is rotated in the direction of the arrow B. Yellow toner images, magenta toner images, cyan toner images, and black toner images are formed by the image forming devices 6Y, 6M, 6C and 6BK on the image bearing members 2Y, 2M, 2C and 2BK, respectively, as in the image forming apparatuses of FIG. 20 and FIG. 22. These toner images of different colors are transferred onto one side of a recording medium P conveyed from the sheet feeding device 23 by a function of each transfer roller 120 of the transfer device 10. The recording medium P is caused to pass respective nip parts between the transfer belt 115 and the image bearing members 2Y, 2M, 2C and 2BK, so that the visible toner images on the image bearing members 2Y, 2M, 2C and 2BK are transferred onto the recording medium P to be superimposed one upon another thereon.

In the image forming apparatus illustrated in FIG. 28, the intermediary image bearing member 15 is arranged to oppose the image bearing members 2Y, 2M, 2C and 2BK, and visible toner images of different colors formed on the image bearing members 2Y, 2M, 2C and 2BK, respectively, are transferred onto the intermediary image bearing member 15 being rotated in the direction of the arrow B to be superimposed one upon another by a function of the transfer rollers 20, thereby forming the first image thereupon. The first image is then transferred by a function of the corona discharging device 27 onto one side of a recording medium P conveyed from the sheet feeding device 23, and visible toner images of different colors subsequently formed on the image bearing members 2Y, 2M, 2C and 2BK are transferred onto the other side of the recording medium P by a function of the transfer rollers 20 to be superimposed one upon another, thereby forming the second image thereupon. Both images on the recording medium P are fixed by the fixing device 28 onto the recording medium P, and the recording medium P is fed onto the sheet expelling part 31. The image forming apparatus of FIG. 28 can also form a color image only on one side of a recording medium P.

As described above, the image forming apparatuses of FIG. 27 and FIG. 28 differ from the image forming apparatuses of FIG. 20 through FIG. 24 in that visible images formed on the image bearing members 2Y, 2M, 2C, and 2BK are transferred onto a recording medium P without use of an intermediary transfer member, and other parts of the image forming apparatuses of FIG. 27 and FIG. 28 are substantially the same as those of the image forming apparatuses of FIG. 20 through FIG. 24. Further, as in the image forming apparatuses of FIG. 20 and FIG. 22, in the image forming apparatus of FIG. 27, the second belt unit 164 is configured by the transfer device 10, etc., and in the image forming apparatus of FIG. 28, the first belt unit 64 is configured by the intermediary image bearing member 15, etc., and the installing mechanism configured to install in the main body housing 1 either of the second belt unit 164 including the transfer device 10 and the first belt unit 64 including the intermediary transfer member 15 is provided in the image forming apparatuses of FIG. 27 and FIG. 28, respectively. Thereby, the second belt unit 164 including the transfer device 10 and the first belt unit 64 including the intermediary image bearing member 15 can be exchanged with each other in the image forming apparatuses of FIG. 27 and FIG. 28. Thus, an image forming apparatus meeting a need of a user can be easily configured. Respective components of the image forming apparatuses of FIG. 28 and FIG. 27 are denoted by the same reference signs as those used for corresponding components of the image forming apparatuses of FIG. 20 and FIG. 22.

Further, in the image forming apparatuses of FIG. 27 and FIG. 28, the plurality of image bearing members 2Y, 2M, 2C and 2BK are provided. However, each of the apparatuses may be configured to include a single image bearing member and toner images formed on the single image bearing member may be sequentially transferred onto a recording medium, as in the image forming apparatuses described above.

As described above, each of the image forming apparatuses described above referring to FIG. 27 and FIG. 28 includes at least one of the image bearing members 2Y, 2M, 2C and 2BK on which visible images are formed, the image forming devices 6Y, 6M, 6C and 6BK configured to form visible images on the at least one of the image bearing members 2Y, 2M, 2C and 2BK, and the installing part IP provided in the main body housing 1 and configured such that either of the transfer device 10 configured to transfer a visible images formed on the at least one of the image bearing members 2Y, 2M, 2C and 2BK onto a recording medium P and the intermediary image bearing member 15 on which visible images formed on the at least one of the image bearing members 2Y, 2M, 2C and 2BK are transferred to be superimposed one upon another, thereby forming a first image thereupon, can be installed therein. The image forming apparatus is configured such that when the intermediary image bearing member 15 is installed in the installing part IP of the main body housing 1, the first image formed on the intermediary image bearing member 15 is transferred onto one side of the recording medium P and a second image is formed on the other side of the recording medium P by visible images subsequently transferred from the at least one of the image bearing members 2Y, 2M, 2C and 2BK to be superimposed one upon another.

In the image forming apparatuses illustrated in FIG. 20 through FIG. 28, as described above, the installing mechanism is configured such that either of the transfer device 10 and the intermediary image bearing member 15 can be installed in the installing part IP of the main body housing 1. In this case also, the installing mechanism can be advantageously configured such that either of at least two intermediary image bearing members different from each other in size can be installed in the installing part IP of the main body housing 1. Here also, intermediary image bearing members being different in size includes three cases, one case in which widths of the intermediary image bearing members in a direction perpendicular to surface moving directions of the intermediary image bearing members are different from each other, another case in which circumferential lengths of the intermediary image bearing members are different from each other, and still another case in which both of widths of the intermediary image bearing members in a direction perpendicular to surface moving directions of the intermediary image bearing members and circumferential lengths of the intermediary image bearing members are different from each other. In this case also, the configurations described above with reference to FIG. 1 thorough FIG. 19 may be adopted for the installing mechanism, respectively.

Figure 29:
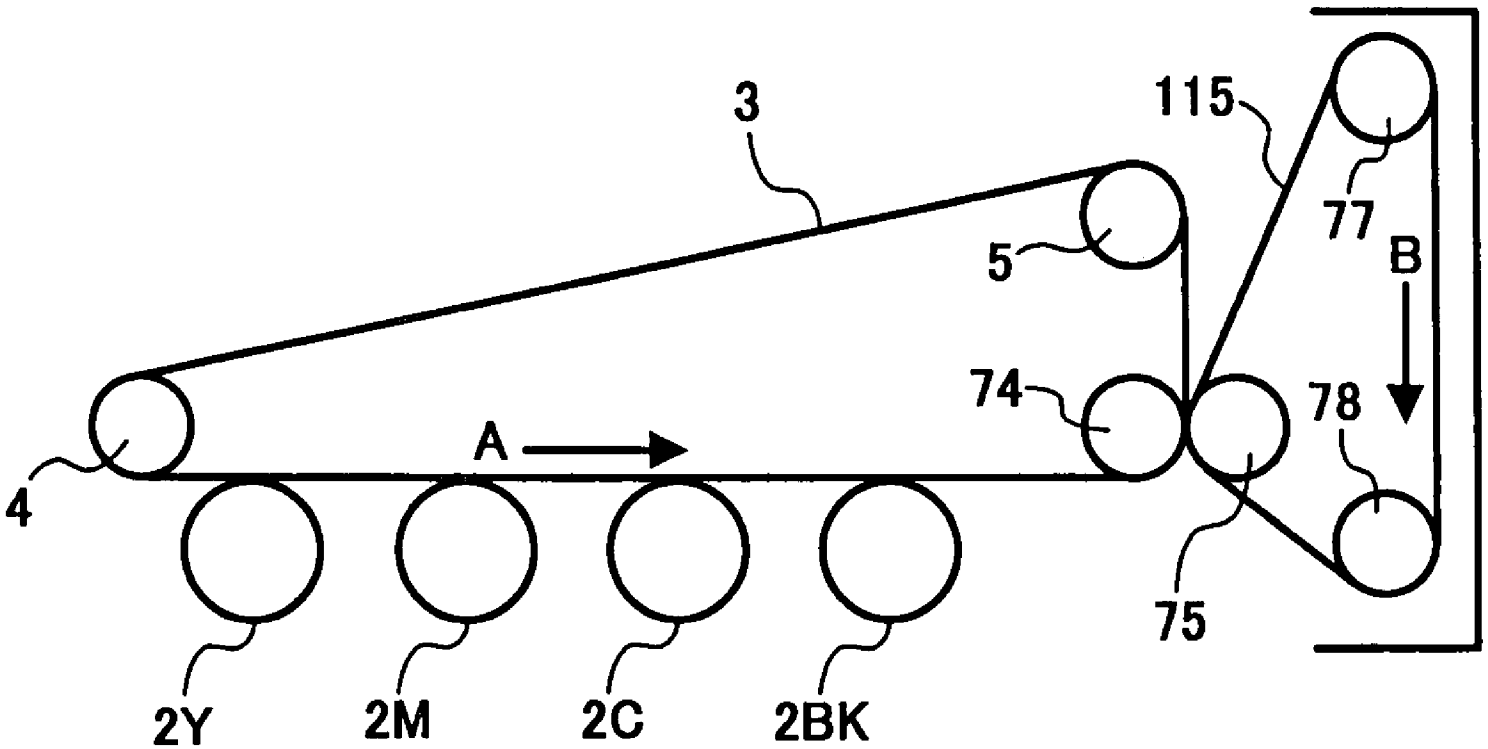
FIG. 29 is a diagram of another belt unit.

Further, when the configurations illustrated in FIG. 15 and FIG. 16 are adopted in the image forming apparatuses illustrated in FIG. 20 through 28, the transfer belt 115 used for transferring a visible image onto only one side of a recording medium P may be configured, for example, as illustrated in FIG. 29 relative to an endless belt spanned around the supporting rollers 75, 77 and 78, and the supporting roller 75 may be configured to function as a transfer roller. When a recording medium P is conveyed between the transfer belt 115 and the intermediary transfer member 3, a transfer voltage having a polarity opposite to that of the toner of a superimposed visible image on the intermediary transfer member 3 is applied to the supporting roller 75 so that the visible image on the intermediary transfer member 3 can be transferred onto one side of the recording medium P.

Further, in place of applying a transfer voltage to the supporting roller 75 illustrated in FIG. 15, FIG. 16 and FIG. 29, a transfer voltage having a same polarity as the charging polarity of the toner on the intermediary transfer member 3 may be applied to the supporting roller 74 for the intermediary transfer member 3 so that a visible image on the intermediary transfer 3 is transferred onto an intermediary image bearing member or a recording medium. This also applies to the configurations illustrated in FIG. 1, FIG. 6, FIG. 19, FIG. 20, FIG. 33, FIG. 25 and FIG. 26. Namely, a transfer voltage is applied to the supporting roller 5 for the intermediary transfer member 3 so that a visible image is transferred onto an intermediary image bearing member or a recording medium.

Each of the above-described configurations may be appropriately combined with each other to configure an image forming apparatus. In particular, each of the configurations illustrated in and described with reference to FIG. 1 through FIG. 19 may be appropriately adopted in the image forming apparatuses configured such that the transfer device 10 and the intermediary image bearing member 15 can be exchanged with each other.

Figure 30:
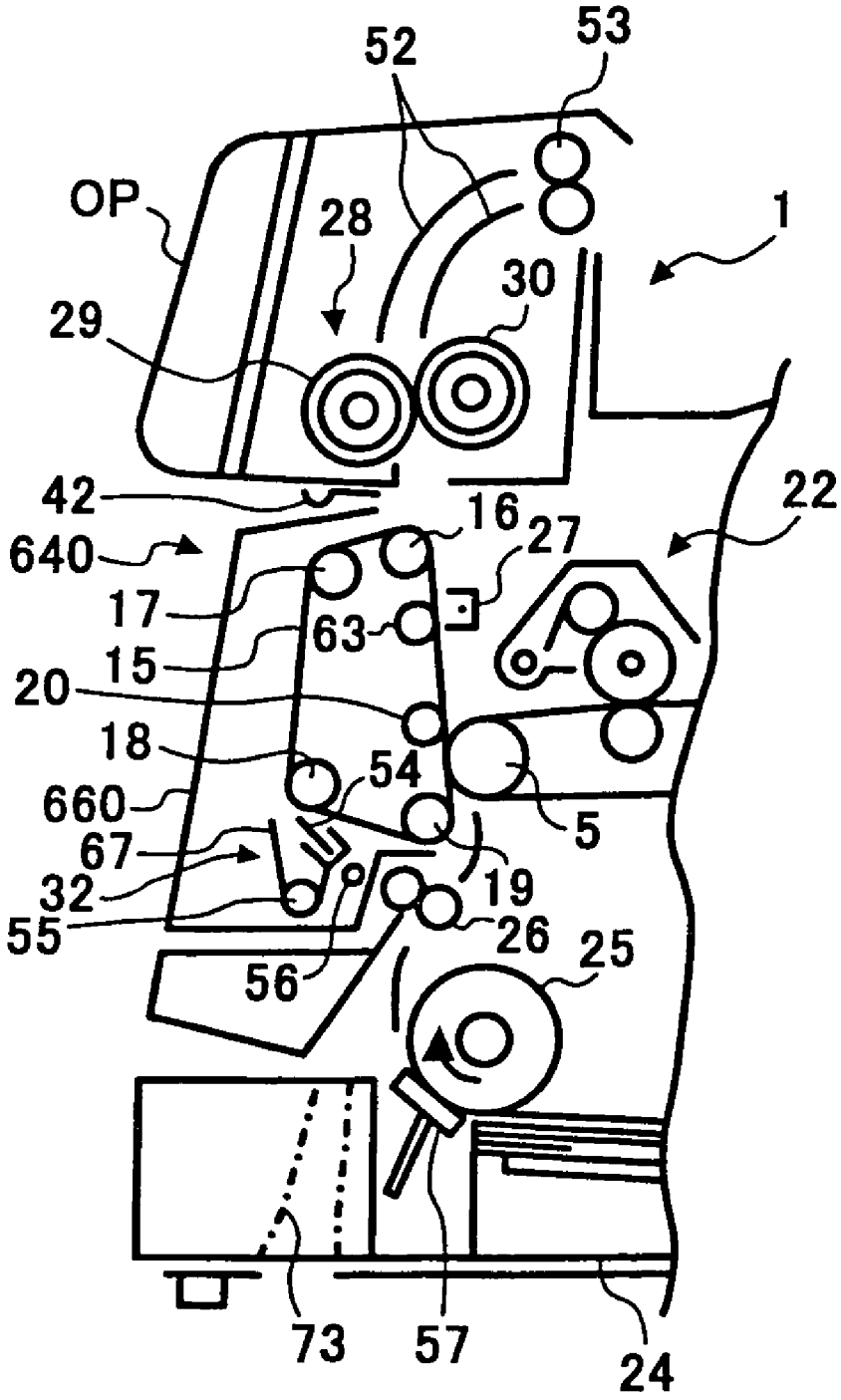
FIG. 30 is a partial sectional view of the image forming apparatus of FIG. 1, in which still another belt unit including the intermediary image bearing member that is short in circumferential length is installed in the main body housing according to another example of the receiving and guiding mechanism.
Figure 31:
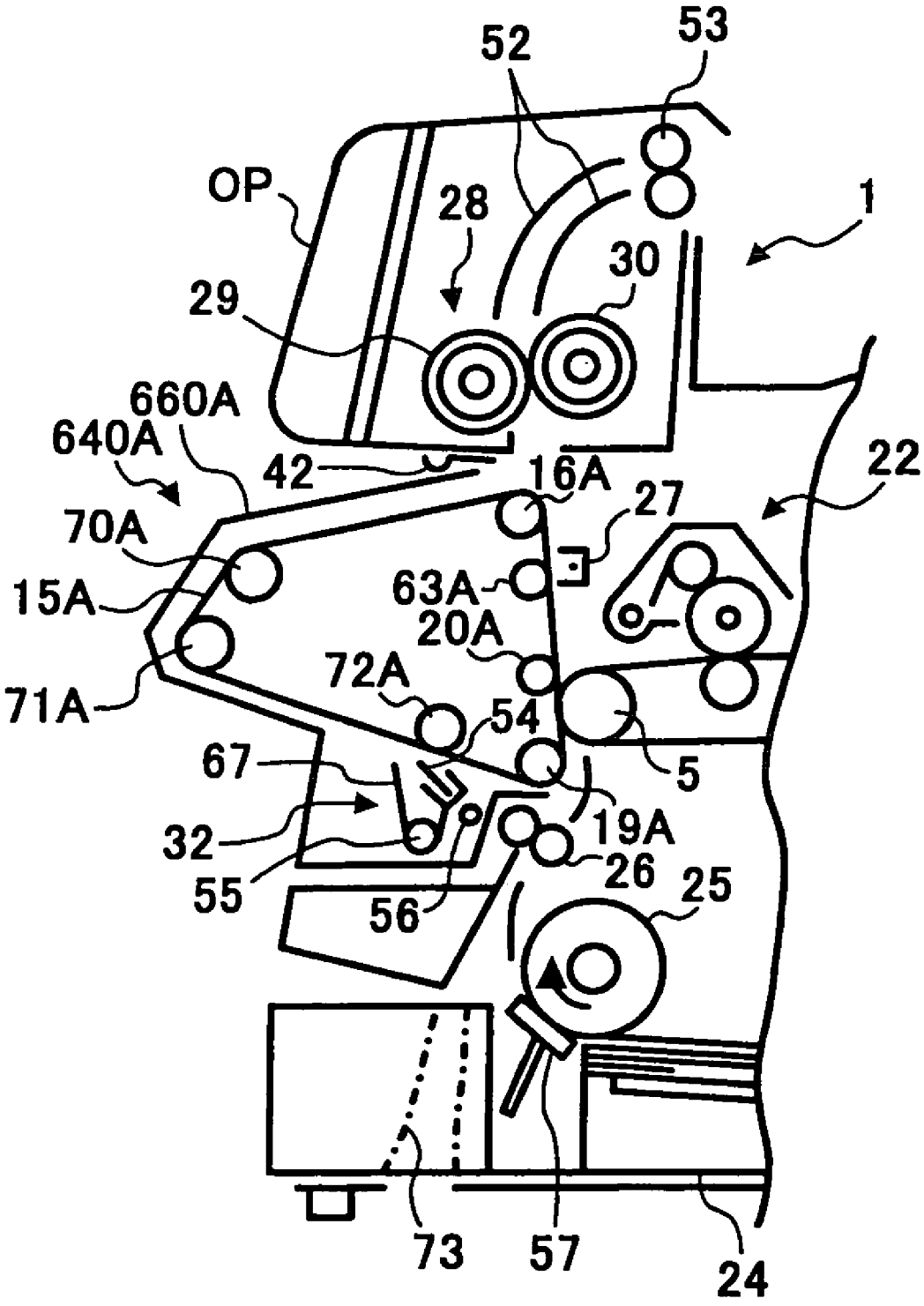
FIG. 31 is a partial sectional view of the image forming apparatus, in which still another belt unit including the intermediary image bearing member long in circumferential length is installed in the main body housing according to the another example of the receiving and guiding mechanism.
Figure 32:
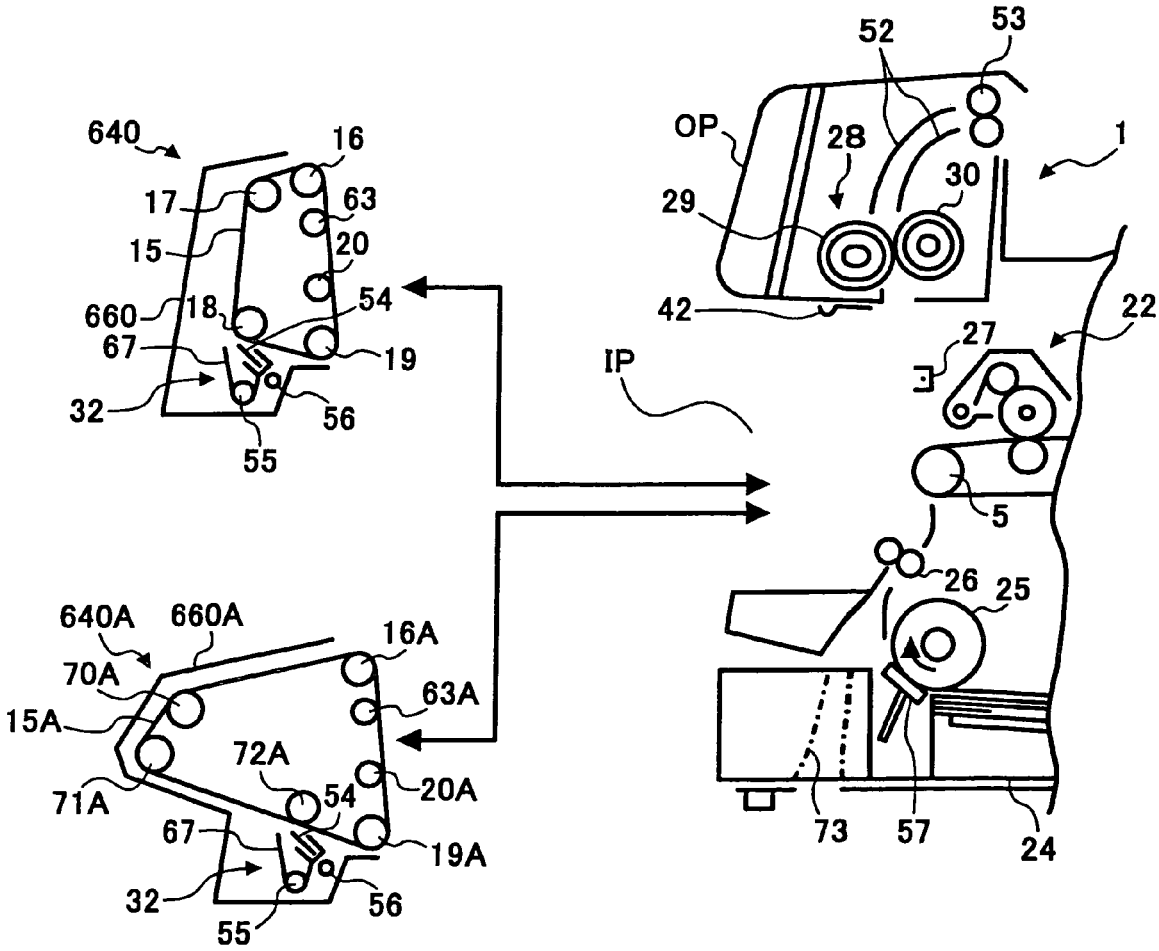
FIG. 32 is a sectional view for explaining each of the still another belt units in FIG. 30
Figure 33:
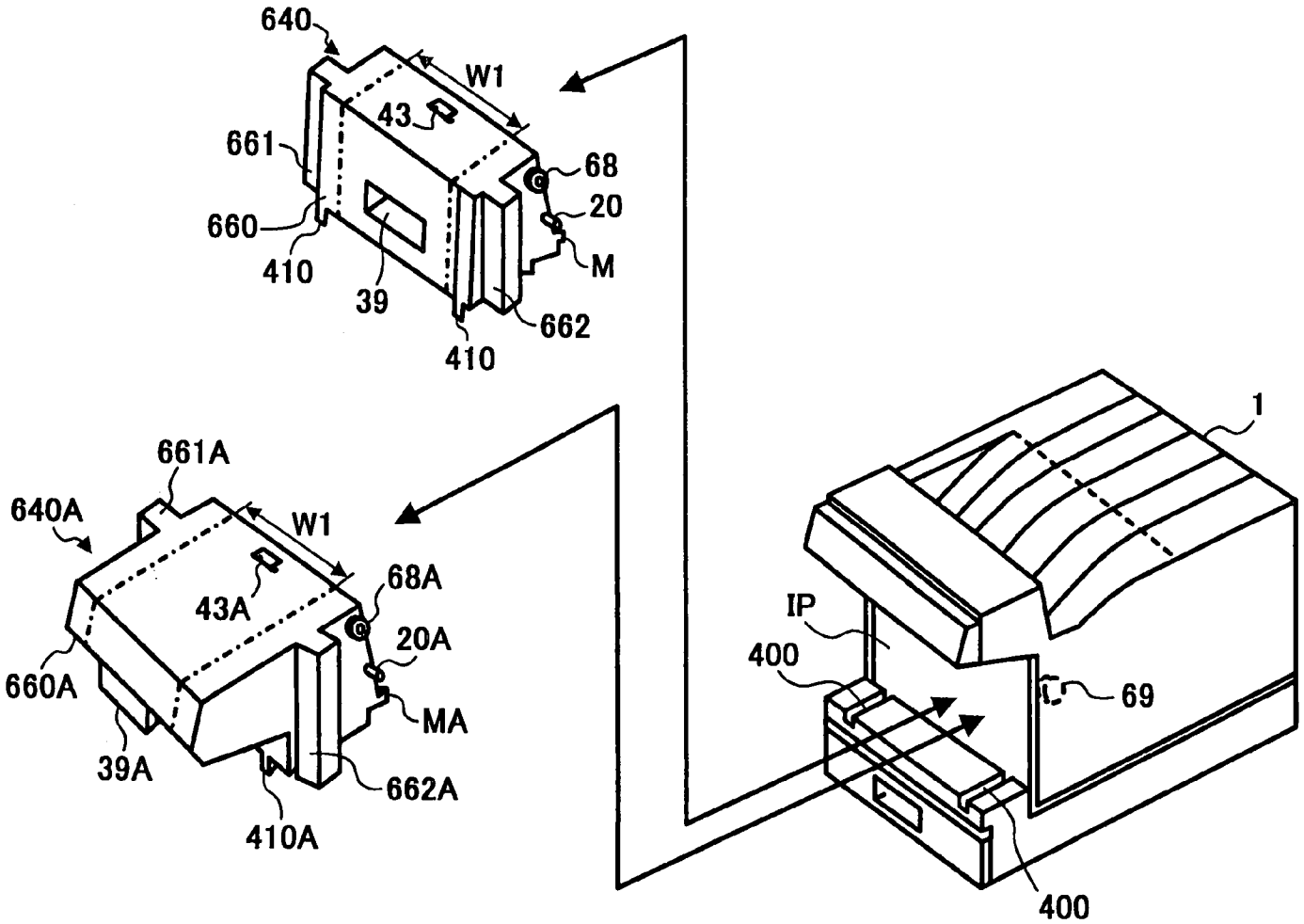
FIG. 33 is a perspective view for explaining the another example of the receiving and guiding mechanism.

Furthermore, FIG. 30 through FIG. 33 illustrate another example of the receiving and guiding mechanism configured to receive and guide any of a plurality of intermediary image bearing members that are different in size to be installed in and removed from the installing part IP of the main body housing 1, thereby enabling exchanging an installed intermediary image bearing member with another one. FIG. 30 illustrates a state that a belt unit 640 including the intermediary image bearing member 15 that is short in circumferential length is installed in the main body housing 1, and FIG. 31 illustrates a state that another belt unit 640A including the intermediary image bearing member 15A that is long in circumferential length is installed in the main body housing 1. FIG. 32 illustrates the belt units 640 and 640A removed from the installing part IP of the main body housing 1 and a part of the main body housing 1 from which the belt units 640 and 640A have been removed, and FIG. 33 illustrates respective outer appearences of the belt units 640 and 640A and the main body housing 1.

In this example, as illustrated in FIG. 33, the belt units 640 and 640A are directly installed in the installing part IP of the main body housing 1. Specifically, guide grooves 400, serving as the receiving and guiding mechanism of the present invention, are provided to portions of the part of the main body housing 1 forming the installing part IP, and protrusions 410 and 410A of the belt units 640 and 640A are engaged with the guide grooves 400 of the main body housing 1, respectively, and by being pushed substantially in a horizontal direction, the belt units 640 and 640A are guided by the guide grooves 400 to be installed in the installing part IP of the main body housing 1, respectively. The belt units 640 and 640A are removed from the installing part IP of the main body housing 1 by being pulled in the reverse direction, respectively. The width of the opening part of the installing part IP of the main body housing 1 when viewed from the side of the apparatus where the operation panel OP is provided is substantially the same as that of the width of the main body housing 1. Therefore, the belt units 640 and 640A can be easily installed in and removed from the installing part IP of the main body housing 1. Further, when the belt units 640 and 640A are installed in the installing part IP of the main body housing 1, the front sides of the covers 660 and 660A of the belt units 640 and 640A (when viewed from the side of the apparatus where the operation panel OP is provided) and front portions of both sides thereof are exposed, respectively, so that the covers 660 and 660A of the belt units 640 and 640A are formed in different shapes from those of the belt units 64 and 64A, respectively. Specifically, the covers 640 and 640A include protruded parts 661, 662 and 661A, 662A, respectively. In the examples described earlier, the cleaning device 32 is not included in the belt units 64 and 64A. However, in this example, the cleaning device 32 is integrally included in each of the belt units 64 and 64A, so that the operation of installing in and removing from the main body housing 1 the belt units 64 and 64A is simplified. The knobs 39 and 39A that are grabbed when installing in and removing the belt units 64 and 64A from the main body housing 1 are provided to the front sides of the covers 660 and 660A, respectively. In this example, the grooves 400 are provided to the main body housing 1 and the protrusions 410 and 410A are provided to the belt units 640 and 640A. However, it may be configured such that grooves are provided to the belt unit 640 and 640A and protrusions are provided to the main body housing 1.

It is needless to say that the configurations described immediately above can be appropriately adopted in the image forming apparatuses described earlier, including those configured such that the transfer device 10 and the intermediary image bearing member 15 can be exchanged with each other.

Furthermore, in the above description, a plurality of intermediary image bearing members that are different in size from each other, and a combination of an intermediary image bearing member and a transfer device are taken as examples of two devices having different functions either of which can be installed in the installing part IP of the main body housing 1 of the image forming apparatus of the present invention. However, devices that can be installed in the installing part IP of the main body housing 1 are not limited to those described herein as these examples. By appropriately configuring the installing part IP of the main body housing 1 or the receiving and guiding mechanism such that either of at least two devices having different functions can be installed in the installing part IP, the image forming apparatus can be changed from one having a certain function to another one having a different function.

The present invention can be applied to other image forming apparatuses than printers, for example, copying machines, facsimile machines, and multi-function machines having at least two of printing, facsimile and copying functions.

Numerous additional modifications and variations of the present invention are possible in light of the above teachings. It is therefore to be understood that within the scope of the appended claims, the present invention may be practiced otherwise than as specifically described herein.

The present application claims priority and contains subject matter related to Japanese Patent Applications No. 2001-385316, NO. 2001-395508, and NO. 2002-324421 filed in the Japanese Patent Office on Dec. 18, 2001, Dec. 26, 2001 and Nov. 7, 2002, respectively, and the entire contents of which are hereby incorporated by reference.

The invention claimed is:

1. An image forming apparatus, comprising:

an optical unit configured to emit a light in accordance with image information;

at least two image bearing members each configured to bear a latent image formed by the light emitted from the optical unit:

at least two developing units configured to develop the at least two latent images with toner;

an intermediate transfer belt configured to receive and superimpose the toner images at a first transfer station from the at least two image bearing members;

a transfer device connected to a cover of a main body, configured to transfer the superimposed toner images from the intermediate transfer belt to a recording medium at a second transfer station; wherein said intermediate transfer belt is inclined to the second transfer station, and said transfer device being arranged in the vicinity of the lower end of the intermediate transfer belt, and the transfer device being separated from the intermediate transfer belt when the cover is opened.

2. An image forming apparatus, comprising:

an optical unit configured to emit light in accordance with image information, said optical unit inclining in a prescribed direction;

at least two image bearing members each configured to bear a latent image formed by the light emitted from the optical unit, shafts of said at least two image bearing members being arranged on a line inclining in the prescribed direction;

at least two developing units configured to develop the at least two latent images with toner, shafts of said at least two developing units being arranged on a line inclining in the prescribed direction;

an intermediate transfer belt configured to receive and superimpose the toner images at a first transfer station from the at least two image bearing members, said intermediate transfer belt inclining in the prescribed direction; and a transfer device connected to a cover of a main body, configured to transfer the superimposed toner images from the intermediate transfer belt to a recording medium at a second transfer station, said transfer device being arranged in a vicinity of a lower end of the intermediate transfer belt, and said transfer device being separated from the intermediate transfer belt when the cover is open.

3. The image forming apparatus according to claim 2, further comprising a fixing device configured to fix the toner image onto the recording medium, said fixing device being arranged above the lower end of the intermediate transfer belt.

4. The image forming apparatus according to claim 3, further comprising a sheet feeding path configured to vertically guide the recording medium through the second transfer station and the fixing device.

5. The image forming apparatus according to claim 3, wherein said fixing device is secured to the image forming apparatus.

6. The image forming apparatus according to claim 2, further comprising a sheet ejection section configured to receive the sheet ejected from the image forming apparatus, said sheet ejection section inclining in the prescribed direction on the image forming apparatus.

7. The image forming apparatus according to claim 6, wherein said optical unit emits a plurality of beams on the at least two image bearing members.

8. The image forming apparatus according to claim 7, wherein said at least two developing units include four units.

9. The image forming apparatus according to claim 8, wherein the four units-store toner of yellow, magenta, cyan, and black, respectively.

10. An image forming apparatus, comprising:

an optical means for emitting light in accordance with image information, said optical means inclining in a prescribed direction;

at least two image bearing means each for bearing a latent image formed by the light emitted from the optical means, shafts of said at least two image bearing means being arranged on a line inclining in the prescribed direction;

at least two developing means for developing the at least two latent images with toner, shafts of said at least two developing means units being arranged on a line inclining in the prescribed direction;

an intermediate transfer means for receiving and superimposing the toner images at a first transfer station from the at least two image bearing means, said intermediate transfer means inclining in the prescribed direction; and a transfer means connected to a cover of a main body, the transfer means transferring the superimposed toner images from the intermediate transfer means to a recording medium at a second transfer station, said transfer means arranged in a vicinity of the lower end of the intermediate transfer means, and the transfer means being separated from the intermediate transfer means when the cover is opened.

11. An image forming apparatus, comprising:

an optical unit configured to emit a light in accordance with image information, said optical unit inclining in a prescribed direction;

at least two image bearing members each configured to bear a latent image formed by the light emitted from the optical unit, shafts of said at least two image bearing members being arranged on a line inclining in the prescribed direction;

at least two developing units configured to develop the at least two latent images with toner, shafts of said at least two developing units being arranged on a line inclining in the prescribed direction;

an intermediate transfer belt configured to receive and superimpose the toner images at a first transfer station from the at least two image bearing members, said intermediate transfer belt inclining in the prescribed direction;

a transfer device configured to transfer the superimposed toner images from the intermediate transfer belt onto a recording medium at a second transfer station, said transfer device pressure contacting the intermediate transfer belt;

a cover configured to cover at least one side surface of the image forming apparatus; and a mechanism coupled with the cover and configured to open the second transfer station when the cover is open.

* * * * *